US010344948B1

(12) United States Patent
Gordin et al.

(10) Patent No.: US 10,344,948 B1
(45) Date of Patent: Jul. 9, 2019

(54) GLARE CONTROL, HORIZONTAL BEAM CONTAINMENT, AND CONTROLS IN COST-EFFECTIVE LED LIGHTING SYSTEM RETROFITS AND OTHER APPLICATIONS

(71) Applicant: Musco Corporation, Oskaloosa, IA (US)

(72) Inventors: Myron Gordin, Oskaloosa, IA (US); Joel D. DeBoef, New Sharon, IA (US); Aric D. Klyn, Pella, IA (US); Alan W. Sheldon, Pella, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 16/136,330

(22) Filed: Sep. 20, 2018

Related U.S. Application Data

(63) Continuation-in-part of application No. 15/826,772, filed on Nov. 30, 2017.

(60) Provisional application No. 62/522,345, filed on Jun. 20, 2017, provisional application No. 62/457,641, filed on Feb. 10, 2017.

(51) Int. Cl.

| | |
|---|---|
| ***F21V 11/04*** | (2006.01) |
| ***F21Y 115/10*** | (2016.01) |
| ***H05B 37/02*** | (2006.01) |
| ***H05B 33/08*** | (2006.01) |
| *F21W 131/105* | (2006.01) |

(52) U.S. Cl.
CPC ..... *F21V 11/04* (2013.01); *H05B 33/0845* (2013.01); *H05B 37/0272* (2013.01); *F21W 2131/105* (2013.01); *F21Y 2115/10* (2016.08)

(58) Field of Classification Search
USPC ..... 362/235
See application file for complete search history.

(56) References Cited

U.S. PATENT DOCUMENTS

| | | | |
|---|---|---|---|
| 4,107,770 | A | 8/1978 | Weber |
| 4,353,009 | A | 10/1982 | Knoll |
| 4,414,493 | A | 11/1983 | Henrich |
| 4,979,086 | A | 12/1990 | Heinisch |

(Continued)

OTHER PUBLICATIONS

Gordin, Myron et al., unpublished Pending Design U.S. Appl. No. 29/637,422, Adjustable Lighting Fixture With Wraparound Visor, filed Feb. 19, 2018.

(Continued)

*Primary Examiner* — Michael G Lee
*Assistant Examiner* — David Tardif
(74) *Attorney, Agent, or Firm* — Jessica R. Boer

(57) ABSTRACT

There is a category of situations which may have previously been considered direct replacement but in fact takes on many elements of a true retrofit; namely, replacing existing LED lighting systems (which they themselves were retrofits) with different LED lighting systems that (i) overcome a deficiency or inadequacy of the existing LED lighting system retrofit, (ii) adds a functionality to the existing LED lighting system retrofit, or (iii) reestablishes functionality that would otherwise be lost with the existing LED lighting system retrofit. Discussed herein are means to provide improved glare control, horizontal beam containment, playability and control functionality for interfacing with third party controls in these so-called retrofit-of-a-retrofit, or "upgrade" situations.

20 Claims, 57 Drawing Sheets

(56) References Cited

U.S. PATENT DOCUMENTS

| | | | | |
|---|---|---|---|---|
| 5,274,534 | A | 12/1993 | Armstrong | |
| 5,426,577 | A | 6/1995 | Gordin et al. | |
| 5,486,989 | A | 1/1996 | Compton | |
| 5,600,537 | A | 2/1997 | Gordin et al. | |
| 6,078,148 | A | 6/2000 | Hochstein | |
| 6,250,596 | B1 | 6/2001 | Gordin et al. | |
| 6,250,774 | B1 | 6/2001 | Begemann et al. | |
| 6,960,892 | B2 | 11/2005 | Loughrey | |
| 7,080,927 | B2 | 7/2006 | Feuerborn et al. | |
| 7,209,958 | B2 | 4/2007 | Crookham et al. | |
| 7,387,403 | B2 | 6/2008 | Mighetto | |
| 7,600,901 | B2 | 10/2009 | Gordin et al. | |
| 7,688,007 | B2 | 3/2010 | Gordin et al. | |
| 7,766,518 | B2 | 8/2010 | Piepgras et al. | |
| 7,843,144 | B2 | 11/2010 | Gordin et al. | |
| 7,848,079 | B1 | 12/2010 | Gordin et al. | |
| 7,976,198 | B1 | 7/2011 | Gordin et al. | |
| 8,154,218 | B2 | 4/2012 | Gordin et al. | |
| 8,163,993 | B2 | 4/2012 | Gordin et al. | |
| 8,322,881 | B1 | 12/2012 | Wassel | |
| 8,337,058 | B2 | 12/2012 | Gordin et al. | |
| 8,449,144 | B2 | 5/2013 | Boxler et al. | |
| 8,588,942 | B2 | 11/2013 | Agrawal | |
| D695,949 | S | 12/2013 | Gordin et al. | |
| D695,952 | S | 12/2013 | Gordin et al. | |
| 8,717,552 | B1 | 5/2014 | Gordin et al. | |
| 8,729,809 | B2 | 5/2014 | Kit et al. | |
| 8,770,796 | B2 | 7/2014 | Gordin et al. | |
| 8,789,967 | B2 * | 7/2014 | Gordin | F21S 4/00 362/223 |
| D734,532 | S | 7/2015 | Gordin et al. | |
| D743,602 | S | 11/2015 | Gordin et al. | |
| 9,402,292 | B1 | 7/2016 | Gordin et al. | |
| 9,435,517 | B2 | 9/2016 | Gordin et al. | |
| D771,854 | S | 11/2016 | Gordin et al. | |
| 9,631,795 | B2 * | 4/2017 | Gordin | F21S 8/088 |
| 9,706,622 | B2 | 7/2017 | Gordin et al. | |
| 9,786,251 | B1 | 10/2017 | Gordin et al. | |
| D808,052 | S | 1/2018 | Gordin et al. | |
| D808,053 | S | 1/2018 | Gordin et al. | |
| 2011/0149582 | A1 | 6/2011 | McKee | |
| 2013/0077304 | A1 * | 3/2013 | Gordin | F21K 9/90 362/235 |
| 2014/0092593 | A1 | 4/2014 | Gordin et al. | |
| 2015/0285464 | A1 * | 10/2015 | Finn | F21S 2/005 362/232 |
| 2018/0010772 | A1 * | 1/2018 | Gordin | F21V 21/30 |

OTHER PUBLICATIONS

Gordin, Myron et al., unpublished Pending Design U.S. Appl. No. 29/637,423, Adjustable Lighting Fixture With Wraparound Visor, filed Feb. 19, 2018.

Gordin, Myron et al., unpublished Pending Design U.S. Appl. No. 29/637,425, Adjustable Lighting Fixture With Wraparound Visor, filed Feb. 19, 2018.

Gordin, Myron et al., unpublished Pending Design U.S. Appl. No. 29/637,504, Adjustable Lighting Fixture With Wraparound Visor, filed Feb. 19, 2018.

Gordin, Myron et al., unpublished Pending Design U.S. Appl. No. 29/637,505, Adjustable Lighting Fixture With Wraparound Visor, filed Feb. 19, 2018.

Gordin, Myron et al., unpublished Pending Design U.S. Appl. No. 29/637,508, Adjustable Lighting Fixture With Wraparound Visor, filed Feb. 19, 2018.

Gordin, Myron et al,, unpublished Pending Design U.S. Appl. No. 29/627,868, Adjustable Lighting Fixture, filed Nov. 30, 2017.

Gordin, Myron et al., unpublished Pending Design U.S. Appl. No. 29/627,873, Adjustable Lighting Fixture, filed Nov. 30, 2017.

Gordin, Myron et al., unpublished Pending Design U.S. Appl. No. 29/627,901, Adjustable Lighting Fixture, filed Nov. 30, 2017.

Gordin, Myron et al., unpublished Pending Non-Provisional U.S. Appl. No. 16/000,567, Apparatus, Method, and System for Precise LED Lighting.

Illuminating Engineering Society of North America, IES RP-6-15, "Sports and Recreational Area Lighting", Appendix A, 5 pages, copyright Mar. 30, 2015.

GE Lighting, "GE LED replacement lamp for 400 watt HID", 2 pages, copyright 2015.

Hylite LED Lighting LED OMNI-COB, "High Performance LED Omni-Cob Bulb, 200W", 2 pages, copyright 2016.

Lunera, "Lunera Ballasted Technology and Ballast Life", 3 pages, copyright 2015.

Lunera, Lunera Susan Lamp, "LED Replacement for Metal Halide Lamp", 4 pages, copyright 2015.

Pearson, Mark, EE Times, "Current Limiting Key to Hot-Swap Circuit Protection", 6 pages, Sep. 18, 2002.

Horowitz, et al., "The Art of Electronics", Cambridge University, Second Edition, Chapter 14, pp. 940-941, published 1989.

* cited by examiner

Section A

Section B

GLARE CONTROL, HORIZONTAL BEAM CONTAINMENT, AND CONTROLS IN COST-EFFECTIVE LED LIGHTING SYSTEM RETROFITS AND OTHER APPLICATIONS

CROSS-REFERENCE TO RELATED APPLICATIONS

This application is a continuation-in-part of co-pending U.S. application Ser. No. 15/826,772, filed Nov. 30, 2017, which claims the benefit of U.S. Provisional Application Ser. No. 62/522,345, filed Jun. 20, 2017 and 62/457,641, filed Feb. 10, 2017, all of which are hereby incorporated by reference in their entirety.

I. TECHNICAL FIELD OF INVENTION

The present invention generally relates to improved glare control, horizontal beam containment, and control means in LED lighting fixtures. More specifically, the present invention relates to providing a high level of glare control and horizontal beam containment for enhanced playability in lighting system retrofits and other applications. The present invention also more specifically relates to preserving or improving control functionality of said LED lighting fixtures when used in retrofit or other applications; particularly, with respect to interfacing with third party controls to provide dimming.

II. BACKGROUND OF THE INVENTION

As discussed in co-pending parent U.S. application Ser. No. 15/826,772, there is a need for cost-effective retrofit solutions for specialized lighting systems such as sports and wide area lighting systems. The conventional approach in the residential bulb market—namely, where an LED bulb with an onboard driver can replace an incandescent bulb provided bulb bases are the same—cannot be adapted to specialized lighting systems because there are no standard bulb sizes, bulb bases, incoming power, controls, etc. Said co-pending parent application set forth a number of apparatus and methods which could be used to retrofit said specialized lighting systems in a manner that produces levels of light and/or glare control comparable to the technology retrofitted. However, in some cases there may be a need to provide greater glare control or greater horizontal beam containment than what was possible in the lighting system retrofitted (e.g., to improve playability)—such that the retrofit is more of an upgrade. This is likewise true for controls—sometimes there is a need to add functionality (e.g., dimming) which was not possible prior to the retrofit (or was lost during a first retrofit) so to provide more of an upgrade.

Thus, there is room for improvement in the art.

III. SUMMARY OF THE INVENTION

Oftentimes a customer looking to retrofit an outdated or out-of-warranty specialized lighting system does not realize exactly how outdated the lighting conditions (e.g., light levels, onsite glare, lighting uniformity) are. Many times providing a retrofit system with a more updated technology (e.g., LEDs) does not alone address the fact that lighting standards are more rigorous now than ever, glare science is more advanced than ever, and designing to preexisting lighting conditions simply will not meet current day standards; see, for example, standard RP-6-15 published by the Illuminating Engineering Society of North America which governs lighting conditions for sports and recreational area lighting. Quite simply, sometimes a retrofit needs to also be an upgrade for it to function in a current day setting.

FIGS. 1-20 illustrate a sports lighting system designed to illuminate a sports field and an aerial space above the sports field using apparatus and methods discussed in co-pending parent U.S. application Ser. No. 15/826,772. FIGS. 1-20 represent a significant improvement in the art as it relates to lighting system retrofits for specialized lighting systems. However, in some cases there is a need for additional value instead of comparable value—the aforementioned upgrade—for example, in the areas of glare control and horizontal beam containment. Also, in some cases a retrofit may have already occurred and some functionality was lost or is otherwise unsatisfactory, or was simply never there—for example, dimming functionality—and there is a need to preserve functionality that originally existed or, in the case of an upgrade, provide additional functionality.

It is therefore a principle object, feature, advantage, or aspect of the present invention to improve over the state of the art and/or address problems, issues, or deficiencies in the art.

Set forth herein are further improvements to the apparatus and methods of FIGS. 1-20 and more generally, further improvements to inventive aspects described in co-pending parent U.S. application Ser. No. 15/826,772. Envisioned are apparatus and methods directed to improving glare control and horizontal beam containment which could be used with or in lieu of embodiments in said co-pending parent application, and could be used in retrofit situations or other applications (e.g., new installations). Also envisioned are apparatus and methods directed to preserving or improving control functionality during the retrofit process, and which could be used in situations where a retrofit has already occurred or in other applications (e.g., new installations). Any of the embodiments set forth, in part or in whole, could be used alone or with inventive aspects described in co-pending parent U.S. application Ser. No. 15/826,772 to produce cost-effective LED lighting systems that interface with third party controls and allow for a range of glare control and horizontal beam containment options for enhanced playability.

Further objects, features, advantages, or aspects of the present invention may include one or more of the following:

a. modular, interchangeable, or otherwise selectable apparatus to provide varying degrees of glare control;
b. modular, interchangeable, or otherwise selectable apparatus to provide varying degrees of horizontal beam containment; and
c. apparatus to permit dimming of lighting fixtures via preexisting third party controls.

These and other objects, features, advantages, or aspects of the present invention will become more apparent with reference to the accompanying specification and claims.

IV. BRIEF DESCRIPTION OF THE DRAWINGS

From time-to-time in this description reference will be taken to the drawings which are identified by figure number and are summarized below.

FIG. 1 illustrates a typical sports lighting application including retrofit LED luminaires and control means according to co-pending parent U.S. application Ser. No. 15/826,772.

FIGS. 2A-C illustrate various enlarged views of portions of the lighting system of FIG. 1; FIG. 2A is a perspective view and FIGS. 2B and C are partial section views. For the sake of clarity, section lines have been omitted from FIGS. 2B and 2C.

FIG. 5 illustrates a perspective view,

FIG. 6 illustrates a front view,

FIG. 7 illustrates a back view,

FIG. 8 illustrates a right side view,

FIG. 9 illustrates a left side view,

FIG. 10 illustrates a top view,

FIG. 11 illustrates a bottom view,

FIG. 12 illustrates an enlarged section view along lines A-A of FIG. 10, and FIG. 13 illustrates a reduced in scale exploded perspective view detailing internal components (electrical connections, knuckle, and fastening devices omitted for clarity).

FIG. 14 illustrates a perspective view,

FIG. 15 illustrates a front view, and

FIG. 16 illustrates a reduced in scale exploded perspective view detailing internal components (electrical connections, knuckle, and fastening devices omitted for clarity).

FIG. 17 illustrates a perspective view, and

FIG. 18 illustrates an enlarged section view along lines B-B of FIG. 17.

FIG. 23 illustrates a top front perspective view,

FIG. 24 illustrates a bottom front perspective view,

FIG. 25 illustrates a front view,

FIG. 26 illustrates a back view,

FIG. 27 illustrates a right side view,

FIG. 28 illustrates a top view,

FIG. 29 illustrates a bottom view, and

FIG. 30 illustrates a reduced in scale partially exploded perspective view detailing internal and external components (electrical connections, knuckle, and fastening devices omitted for clarity).

FIG. 31 illustrates a perspective view,

FIG. 32 illustrates a front view,

FIG. 33 illustrates a back view,

FIG. 34 illustrates a right side view,

FIG. 35 illustrates a left side view,

FIG. 36 illustrates a top view,

FIG. 37 illustrates a bottom view, and

FIG. 38 illustrates a reduced in scale partially exploded perspective view detailing internal and external components (electrical connections, knuckle, and fastening devices omitted for clarity).

FIG. 39 illustrates a perspective view,

FIG. 40 illustrates a front view,

FIG. 41 illustrates a back view,

FIG. 42 illustrates a right side view,

FIG. 43 illustrates a left side view,

FIG. 44 illustrates a top view,

FIG. 45 illustrates a bottom view, and

FIG. 46 illustrates a reduced in scale partially exploded perspective view detailing internal and external components (knuckle, electrical connections, and fastening devices (for most components) omitted for clarity).

FIG. 47 illustrates a perspective view,

FIG. 48 illustrates a front view,

FIG. 49 illustrates a back view,

FIG. 50 illustrates a right side view,

FIG. 51 illustrates a left side view,

FIG. 52 illustrates a top view,

FIG. 53 illustrates a bottom view, and

FIG. 54 illustrates a reduced in scale partially exploded perspective view detailing internal and external components (knuckle, electrical connections, and fastening devices (for most components) omitted for clarity).

FIG. 55 illustrates improved control functionality at a lighting system level, FIG. 56 illustrates improved control functionality at a gateway level, and FIG. 57 illustrates improved control functionality at a board level.

V. DETAILED DESCRIPTION OF EXEMPLARY EMBODIMENTS

A. Overview

Figure 1:
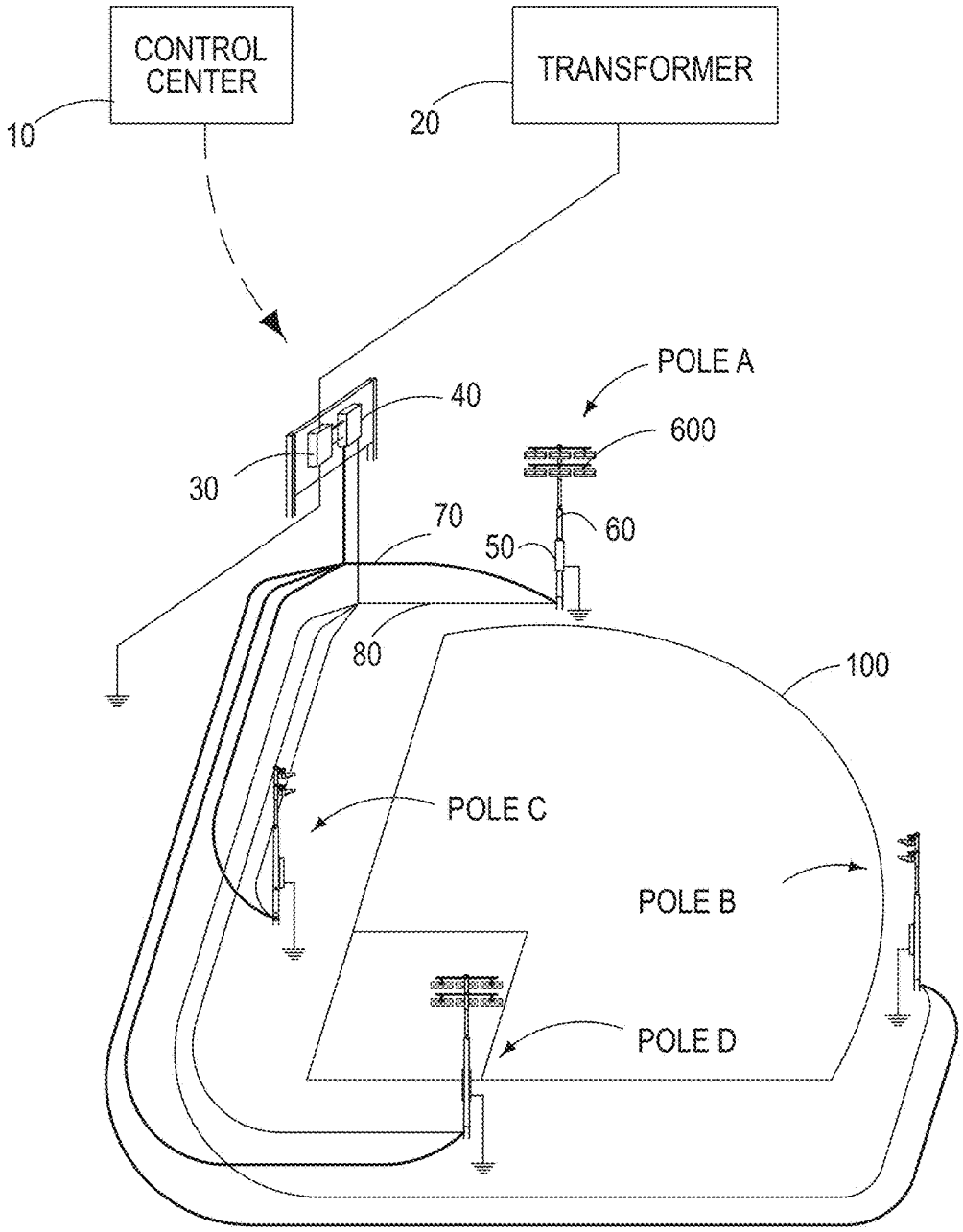

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same or similar parts throughout the drawings.

Regarding terminology, reference is given herein to "systems", "components", and "devices", any of the aforementioned "internal" or "external"; while generally speaking devices are discrete elements that form a component and one or more components make up a system, these terms are used by way of convenience and are not intended to place a limiting effect on aspects of the present invention. Therefore, for example, a louver device may be installed internally in a fixture, but the light redirecting system (which includes the louver and any reflective visor devices) includes both internal and external components. Furthermore, reference is given herein to "control means"; this term is used by way of convenience and should be understood to encompass not only means which provide control functionality, but also power regulating means, communication means, and any other means (including specific apparatus, methods, and systems described herein) that enable or facilitate control of any system, component, and/or device.

With further regards to terminology, reference is given herein to the terms "glare" and "playability". The former term can take on a number of meanings and be measured in a variety of ways in accordance with different standards (see, for example, discussion in U.S. Pat. No. 9,786,251 hereby incorporated by reference in its entirety); this is likewise true for the latter term (see, for example, discussion in U.S. Pat. No. 9,706,622 hereby incorporated by reference in its entirety). It is to be understood that while specific lighting applications are discussed, and specific beam spreads deemed not to impact playability for a limited number of test conditions are discussed, aspects according to the present invention could be selected, modified, or otherwise tailored to accommodate different or more specific definitions of glare and playability than those used herein. Still further, reference is given herein to the terms "side", "inner side", and "bottom side"; these terms are used with specific reference to the embodiments set forth and it is to be understood that if a lighting fixture had a different operational orientation than that illustrated herein, these terms may be replaced with other relevant terms so to achieve the same lighting effects. This is likewise true for the terms "horizontal" and "vertical"; these terms should be understood with respect to the operational orientation of the referenced lighting fixture so to achieve the same lighting cutoff/containment/level of playability.

Finally, as stated in co-pending parent U.S. application Ser. No. 15/826,772 a lighting system installation is typically considered a "retrofit" when the light source being replaced is somehow different from the light source replacing it; for example, replacing an incandescent light source (which operates on AC power) with an LED light source (which operates on DC power) and an associated driver. However, it has been found that there is a category of situations which may have previously been considered direct replacement but in fact takes on many elements of a retrofit; namely, so called "upgrades" or "retrofit-of-a-retrofit" wherein existing LED lighting systems (which they themselves were retrofits) are replaced with different LED lighting systems that (i) overcome a deficiency or inadequacy of the existing LED lighting system retrofit, (ii) adds a functionality to the existing LED lighting system retrofit, or (iii) reestablishes functionality that was otherwise lost with the existing LED lighting system retrofit. Therefore, while aspects of the present invention could be applied to new builds and to retrofit situations as described in co-pending parent U.S. application Ser. No. 15/826,772, they could also be applied to these particular situations, and that use of the terms "retrofit", "lighting system retrofit", "upgrade", "upgraded retrofit", "retrofit-of-a-retrofit" and the like should be considered to encompass all of these possibilities.

Figure 2A:
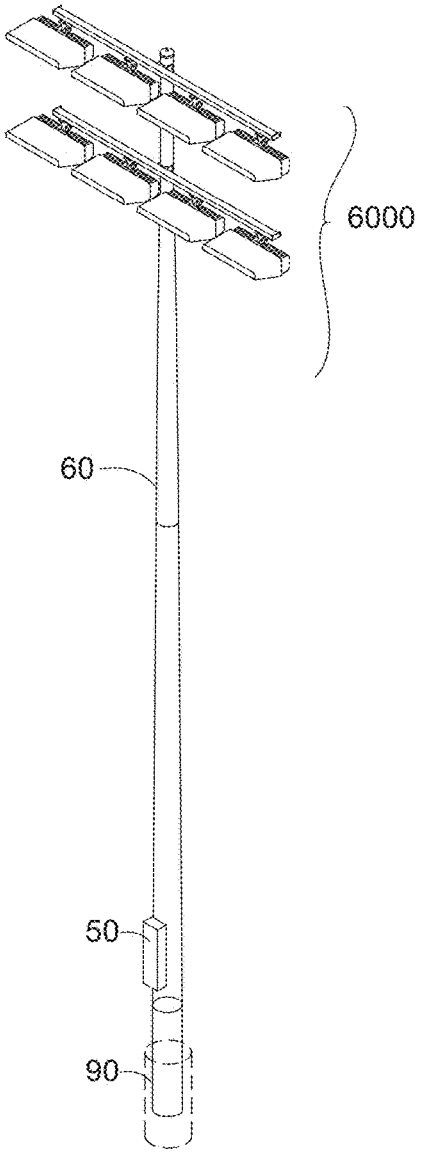
Figure 2B:
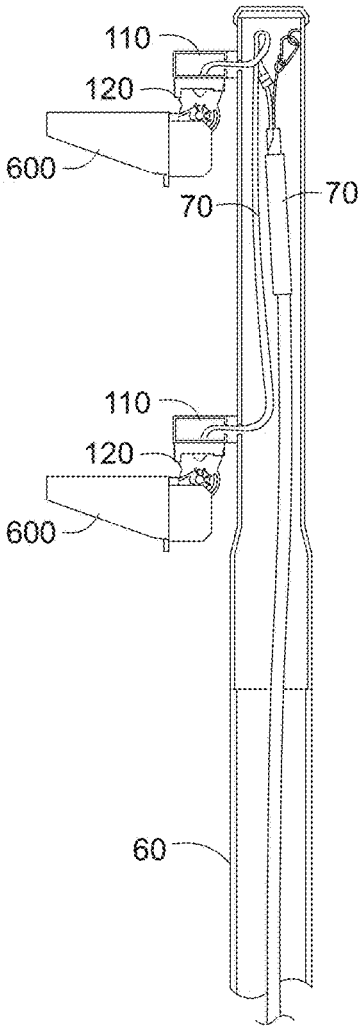
Figure 2C:
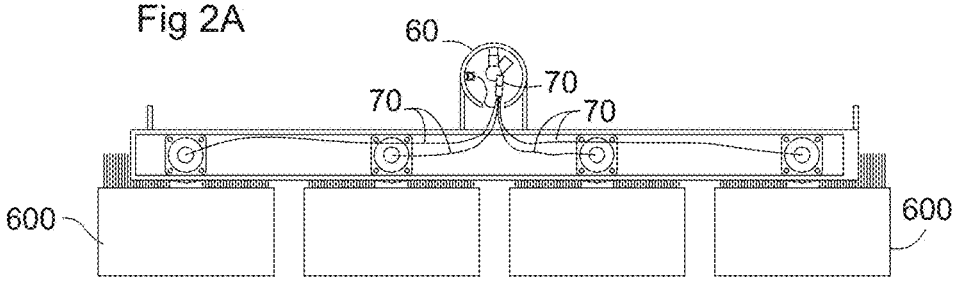

By way of introduction, consider again FIGS. 1-20 which are taken from co-pending parent U.S. application Ser. No. 15/826,772 and represent a significant improvement to the art of lighting system retrofits—and which may be suitable for the vast majority of retrofit situations, but could be improved upon according to aspects of the present invention. FIG. 1 illustrates an LED lighting system retrofit designed to illuminate a field 100 (including a space above field 100 as may be needed for aerial sports) from multiple pole-mounted positions around field 100. Each array 6000 of LED retrofit fixtures 600 is powered according to delivered site power from a transformer 20, which is distributed to one or more fields at a distribution cabinet 30, travels along power lines 70, is conditioned at pole cabinets 50 for the needs of the sport/end user, and is ultimately delivered via internally routed power lines 70 through pole 60, crossarms 110, and adjustable armatures 120 (see also FIGS. 2A-C). As discussed in the co-pending parent application, a number of variations exist: many specialized lighting systems have dedicated grounding systems (see wiring 80 which may include integral grounding in base 90); many include some form of offsite on/off control (see remote control center 10 in combination with antenna 41 and control module 42 in control cabinet 40, FIG. 3); and many have different power requirements (e.g., different site power, different regulations, different wiring both in phase and type).

To provide a cost-effective lighting system retrofit, aspects of the invention set forth in co-pending parent U.S. application Ser. No. 15/826,772 sought to preserve most of the existing lighting system (typically an HID lighting system) below luminaire level while still (i) reconciling disparate power requirements, (ii) providing comparable or better glare control, and (iii) restricting horizontal beam spread (i.e., providing horizontal beam containment). To achieve (i) said co-pending parent application discussed adding a capacitor bank 500 and a rectifier control circuit 1000 (FIGS. 3 and 4) at each pole cabinet 50 so to condition output from existing ballasts 400 for the LED loads 600. While this solution certainly reduced cost over the alternative (i.e., replacing high costs ballasts 400 with high cost drivers), and certainly preserved most existing wiring, the combination of rectifying sub-circuit 1001, inrush current limiting sub-circuit 1002, and output conditioning sub-circuit 1003 (collectively 1000, and discussed in greater detail in co-pending parent U.S. application Ser. No. 15/826,772) simply did not provide dimming functionality for the new LED load.

To achieve (ii) and (iii) said co-pending parent application discussed lightweight, pre-aimed (e.g., aimed at the factory prior to shipping) retrofit LED luminaires (also referred to as fixtures) which could be of a number of configurations depending on the needs of the lighting application—see FIGS. 5-18. All configurations generally included (i) an adjustable armature 120, (ii) an external visor 605 with rigid/semi-rigid skin 606 affixed thereupon and formed around a foam insert 610 so to support reflective inner upper and inner side portions (608, 609), (iii) a thermally conductive housing 602 with heat fins 601 and housing cap 604, (iv) a light transmissive lens 603 sealed against the opening in housing cap 604, and (v) some form of optic system 2000 associated with the LEDs contained within the housing; but as can be seen from FIGS. 5-18, each variation offered one or more features desirable in different retrofit situations. For example, a first configuration 600A (FIGS. 5-13) included slots 607 to which visor extensions could be affixed to effectuate a different cutoff angle (see FIGS. 17 and 18). The optic system 2000 of configuration 600A is predominantly internal to the fixture housing and included a board of LEDs 2001 affixed directly to an inner surface of housing 602, one or more light directing devices 2002, one or more light redirecting devices 2004, and one or more holders/fastening devices 2003 to positionally affix light directing and light redirecting devices relative each other and relative the LEDs. A second configuration 600B (FIGS. 14-16) omitted holders/fastening devices 2003 in favor of heat staked light directing devices 2002 (there, one or more sheets of secondary lenses molded from silicone), and shifted light redirecting devices to outside the housing (see reflective v-visors 630)—the final result being increased space in the housing which permitted a higher LED count for more lumen-dense lighting. A third configuration 600C (FIGS. 17 and 18) included an optic system 2000 similar to configuration 600A, and a second visor portion 615 removably affixed to visor 605 via slots 607 with a distalmost light absorbing device 650 (with windbreak portion 651)—the final result being in situ adjustable beam cutoff without increasing onsite glare. While all of the aforementioned solutions (and further solutions discussed in co-pending parent U.S. application Ser. No. 15/826,772) certainly met the needs of most retrofit situations (particularly those with older technology HID light sources), they simply did not provide a level of glare control and horizontal beam containment as might be needed in some situations such as those with greatly antiquated lighting designs.

The exemplary embodiments envision improvements to the inventive aspects of co-pending parent U.S. application Ser. No. 15/826,772 so to, in at least some situations, provide an upgrade rather than a simple retrofit; apparatus and methods described herein could be used with or in lieu of embodiments in said co-pending parent application, and could be used in retrofit situations or other applications (e.g., new installations). The exemplary embodiments still rely upon the underlying methodology of said co-pending parent application (see FIGS. 19 and 20), but supplement and improve upon solutions available in said co-pending parent application so to address, for example, retrofit-of-a-retrofit situations. As an example, according to method 6000, a first step 6001 comprises evaluating an existing lighting system. In addition to the considerations outlined in said co-pending parent application, if a retrofit has already occurred then according to aspects of the present invention one may consider not only what the original lighting system produced, but what the current lighting system retrofit is producing and in what way that is deficient. Steps 6002*a* and 6002*b* of designing the retrofit LED luminaire and reconciling disparate power means, respectively, may include modifying the existing lighting system retrofit rather than designing an entirely new retrofit system, installation according to step 6003 proceeding accordingly. As another example, in situations where there are adequate retrofit luminaires in place, but where there is still a need for further retrofitting the controls to improve functionality (for example, wiring controls into an existing building management system for centralized control), step 6001 may be expanded according to aspects of the present invention to include evaluation of said building management system, and step 6002*b* may be expanded to include evaluation of communication means. As yet another example, it has been found that in some situations dust can accumulate on reflective surfaces of some of the configurations of retrofit LED luminaires of co-pending parent U.S. application Ser. No. 15/826,772; this may not have been readily apparent in step 4001 of method 4000 when the system was first retrofitted (e.g., when first evaluating baseline glare level and beam spread prior to retrofit, and determining what lighting requirements were needed moving forward, respectively). Thus, light source requirements (step 4002) and cutoff (step 4003) may have been met initially, but there may over time be a concern with onsite glare (due to light interacting with the dust) that necessitates a wider selection of light directing and redirecting devices according to step 4004. Apparatus and methods described herein could be used with the lighting system retrofit of said co-pending parent application to resolve glare issues and preserve or improve playability even when dust is present; in essence, to provide an upgrade via retrofit of a retrofit.

B. Methodology of Exemplary Embodiments

Figure 21:
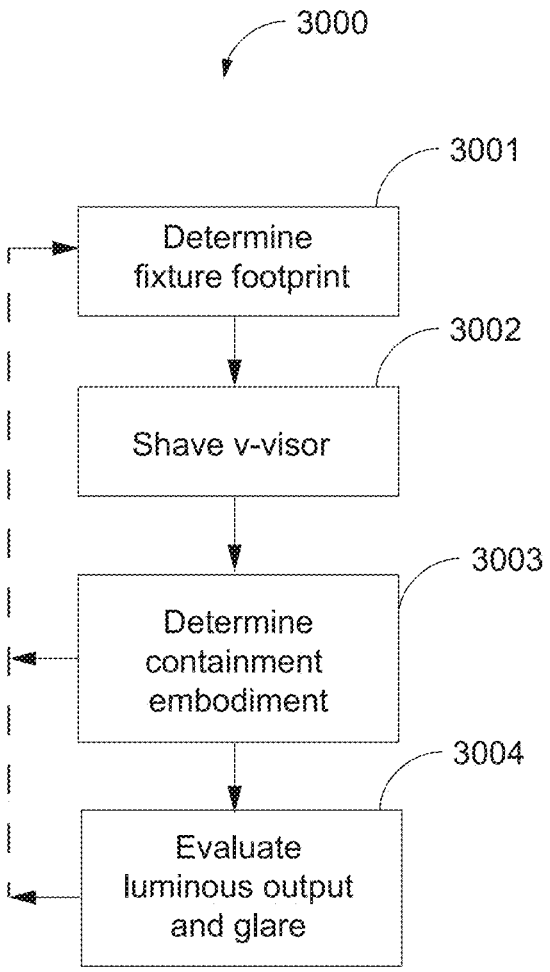
FIG. 21 illustrates in flowchart form one method of modifying the various configurations of the retrofit LED luminaires of FIGS. 5-18 according to aspects of the present invention.
Figure 22:
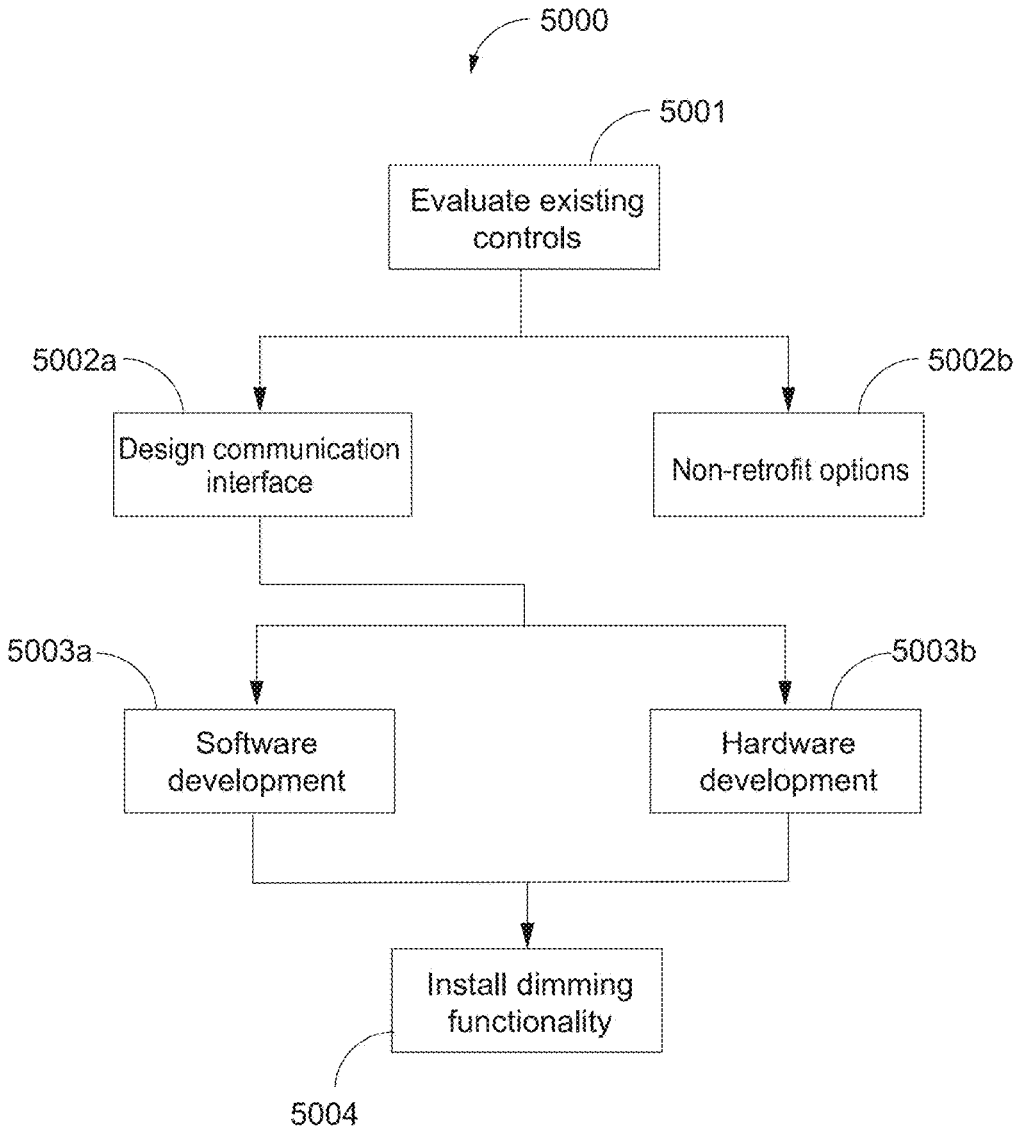
FIG. 22 illustrates in flowchart form one method of adding control functionality to enable dimming according to aspects of the present invention.
Figure 23:
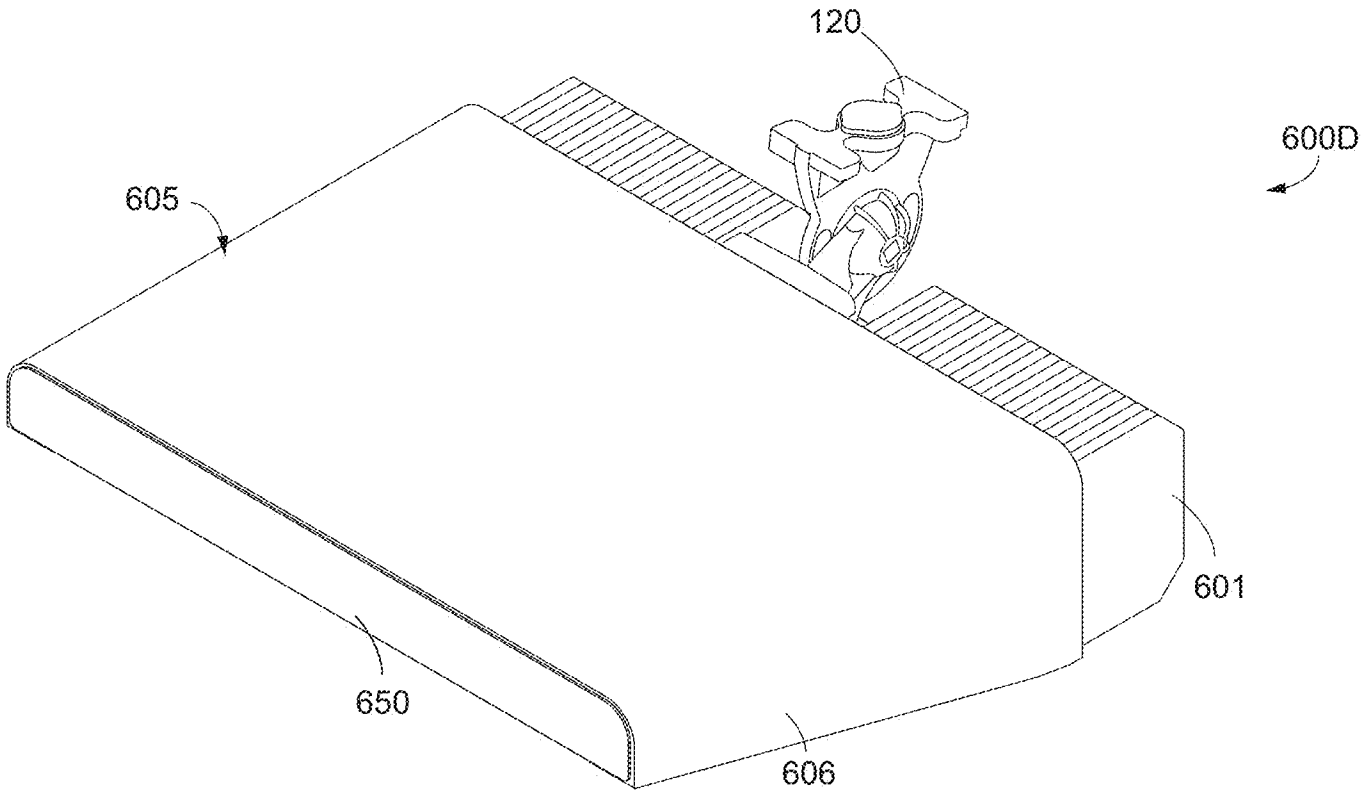
FIGS. 23-30 illustrate a first embodiment according to aspects of the present invention; here an internal louver version for improved glare control and horizontal beam containment.
Figure 24:
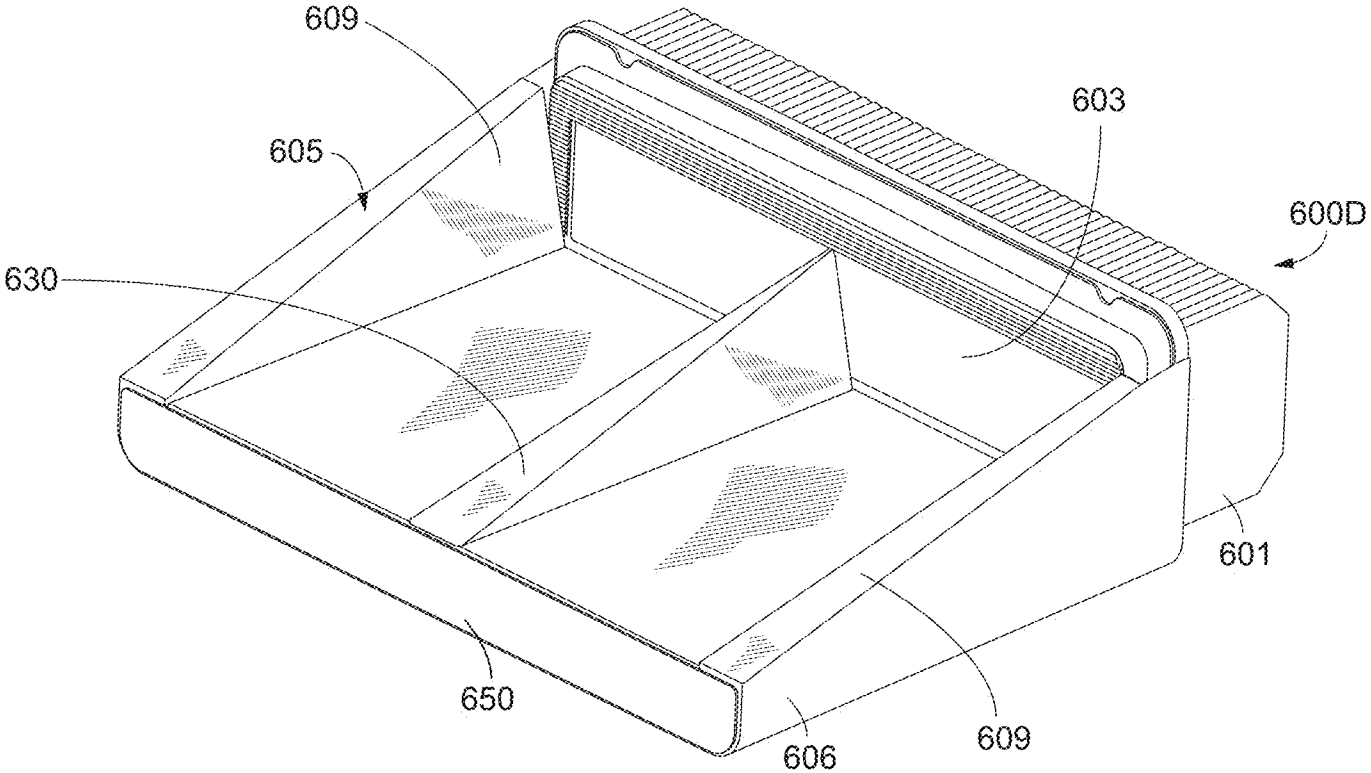
Figure 25:
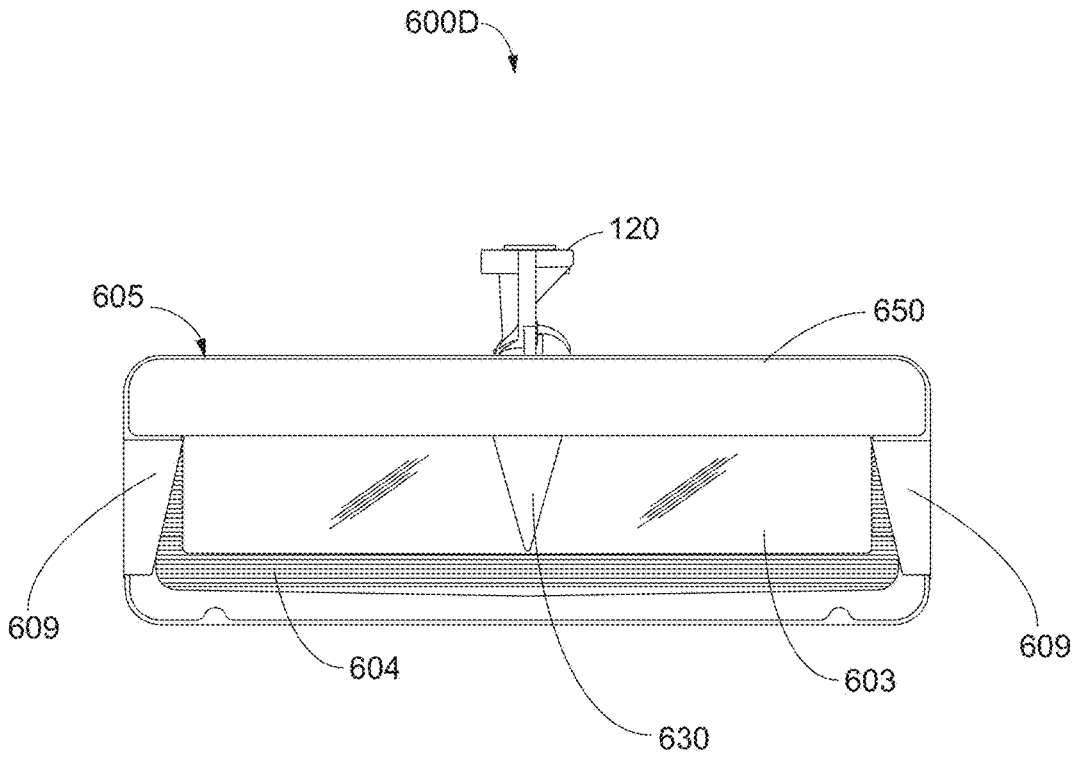
Figure 26:
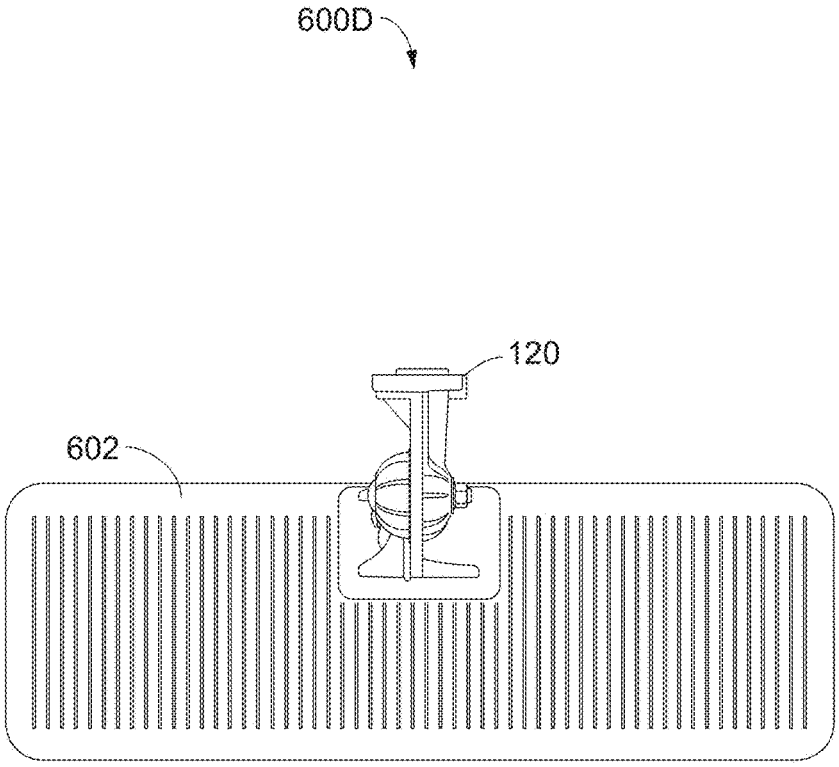
Figure 27:
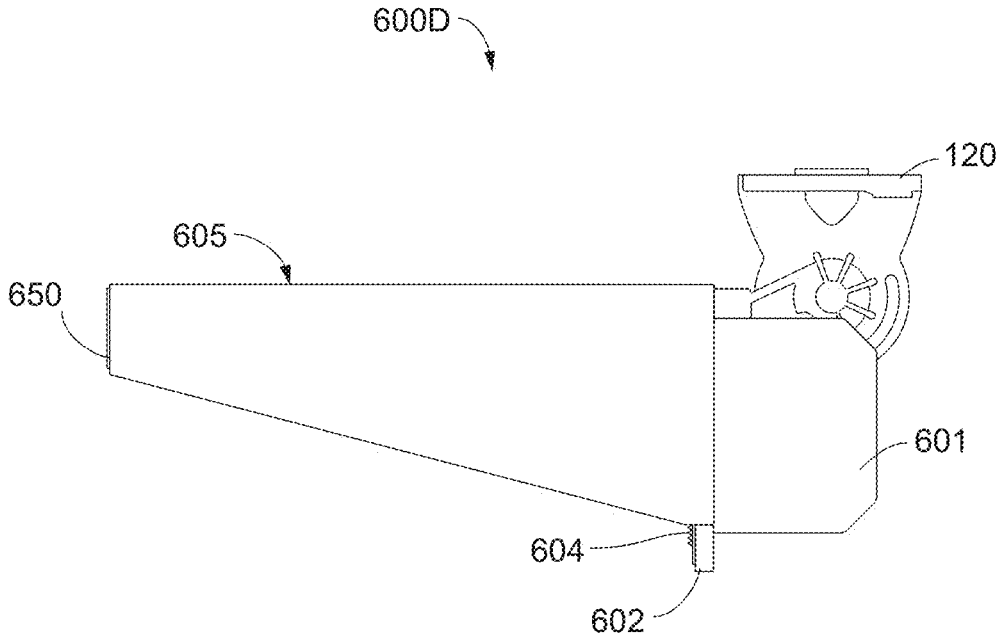
Figure 28:
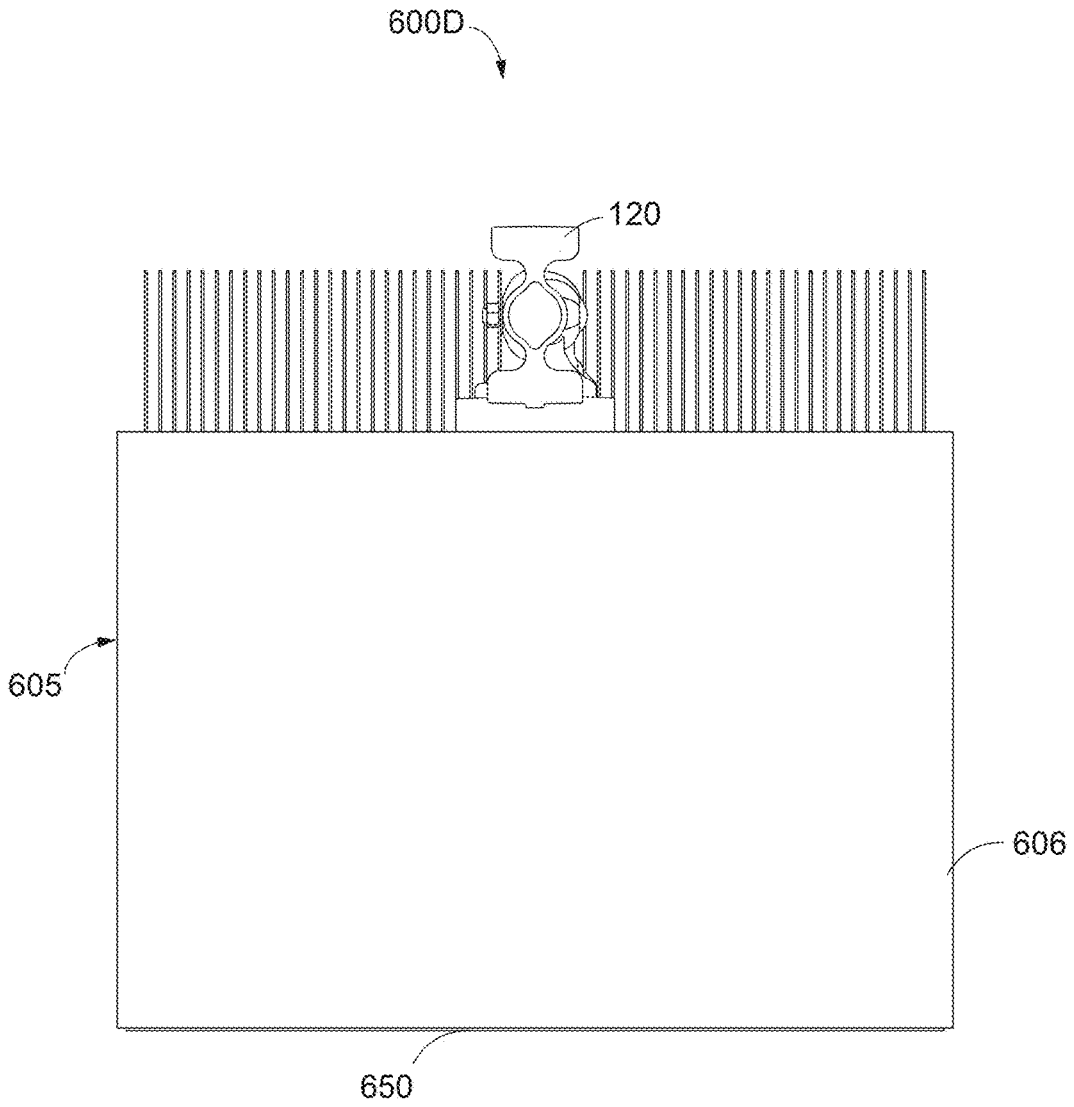
Figure 29:
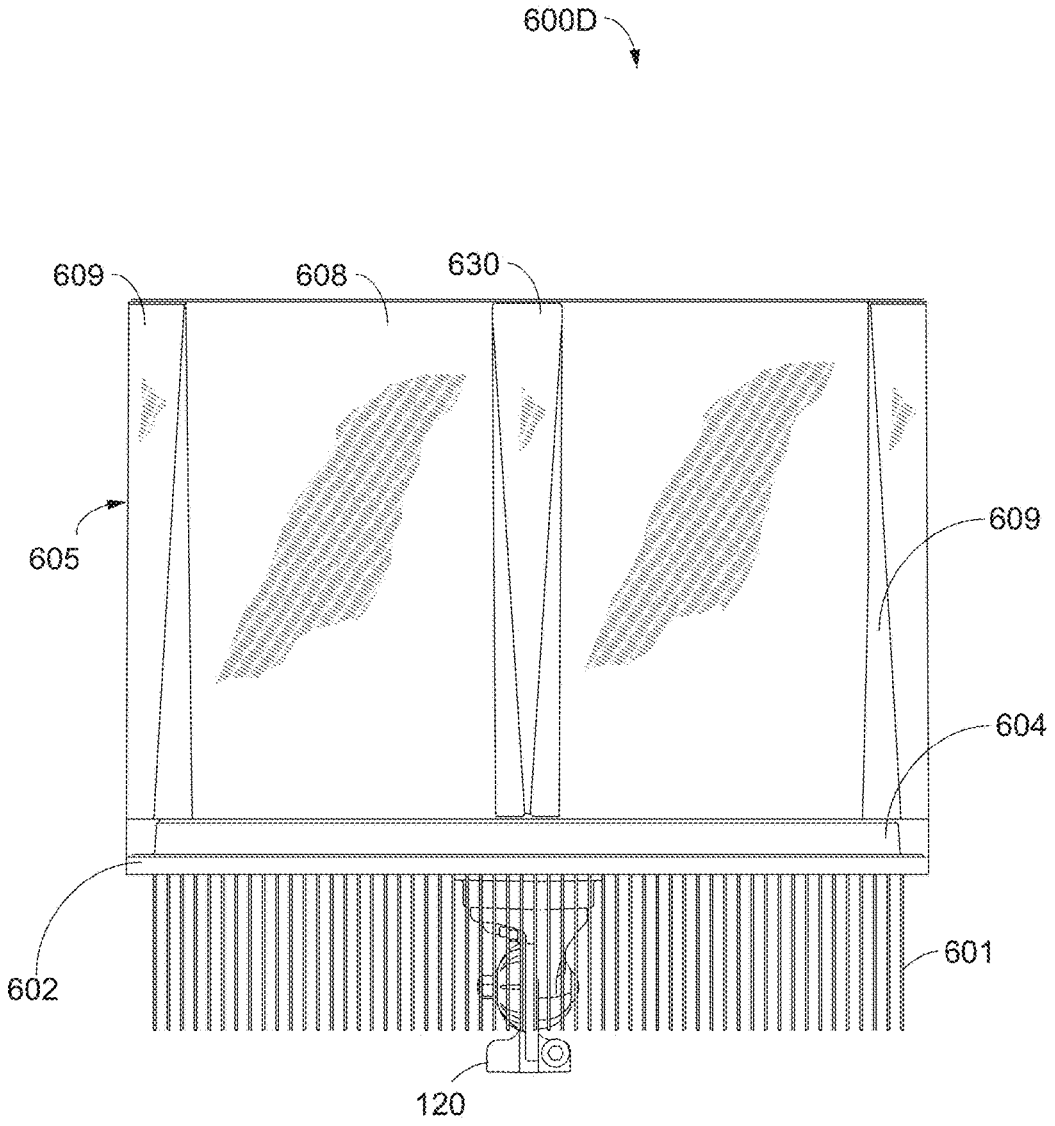
Figure 30:
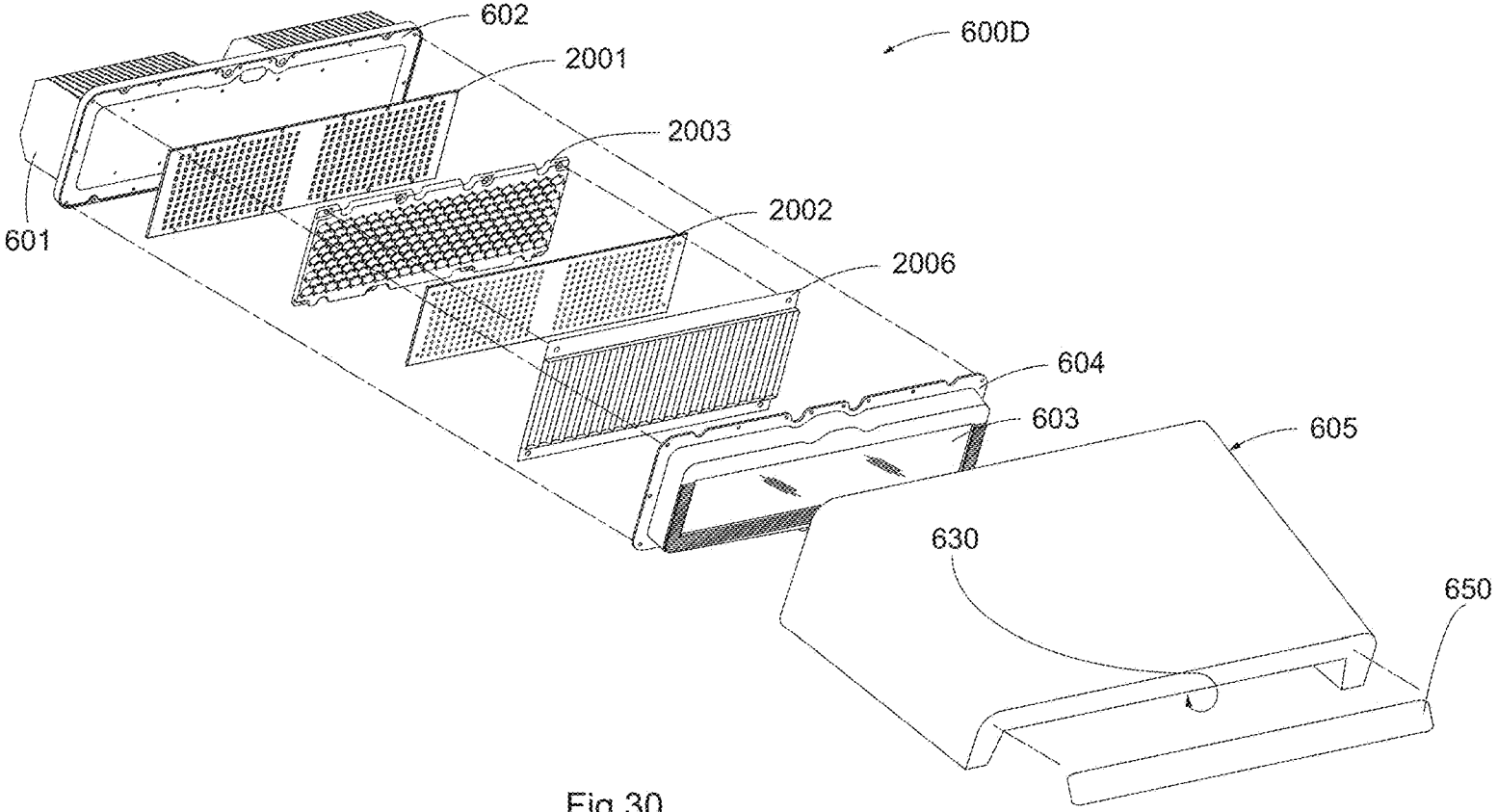
Figure 31:
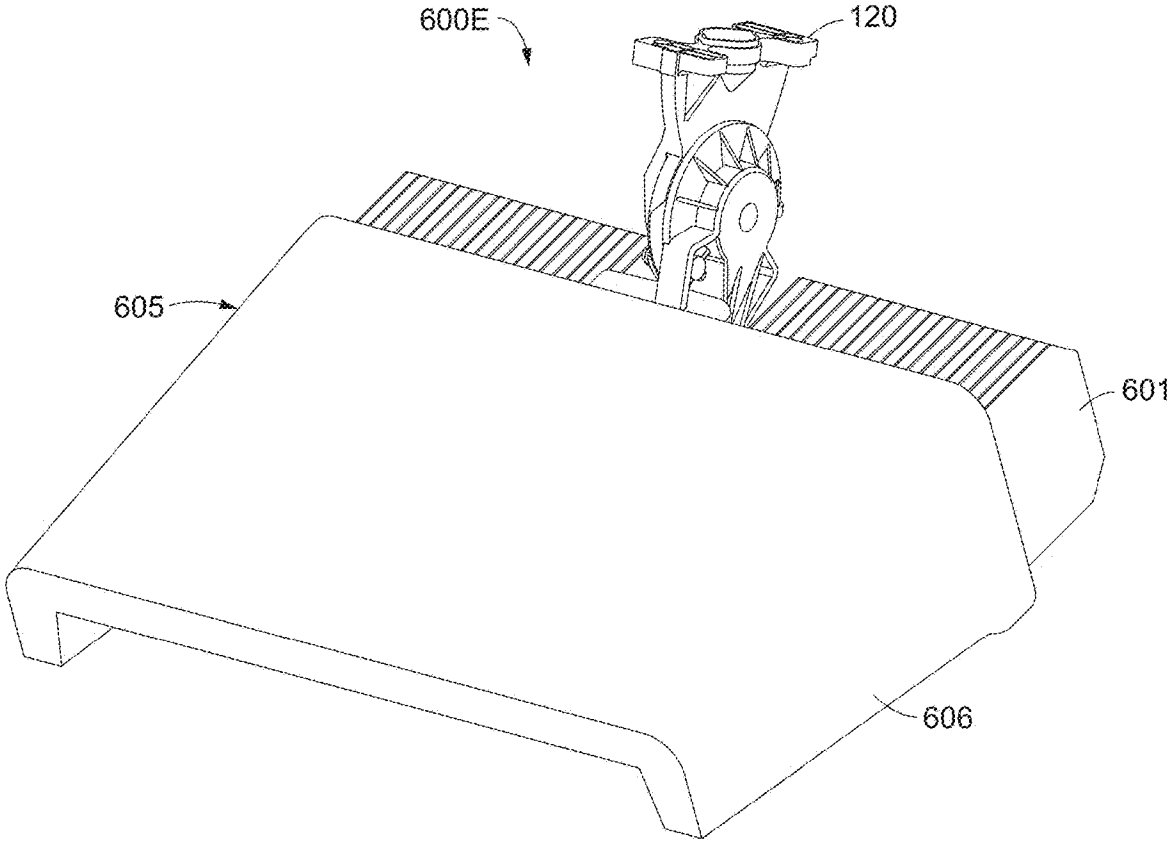
FIGS. 31-38 illustrate a second embodiment according to aspects of the present invention; here an external louver version for improved glare control and horizontal beam containment.
Figure 32:
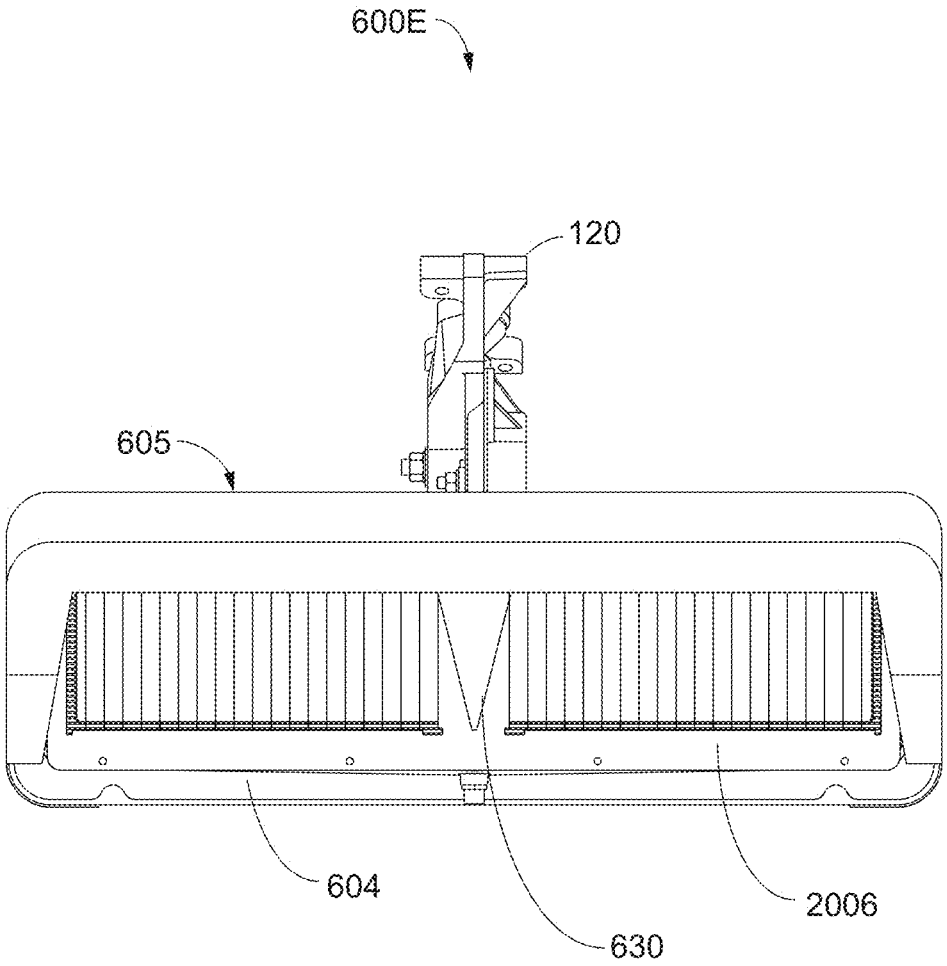
Figure 33:
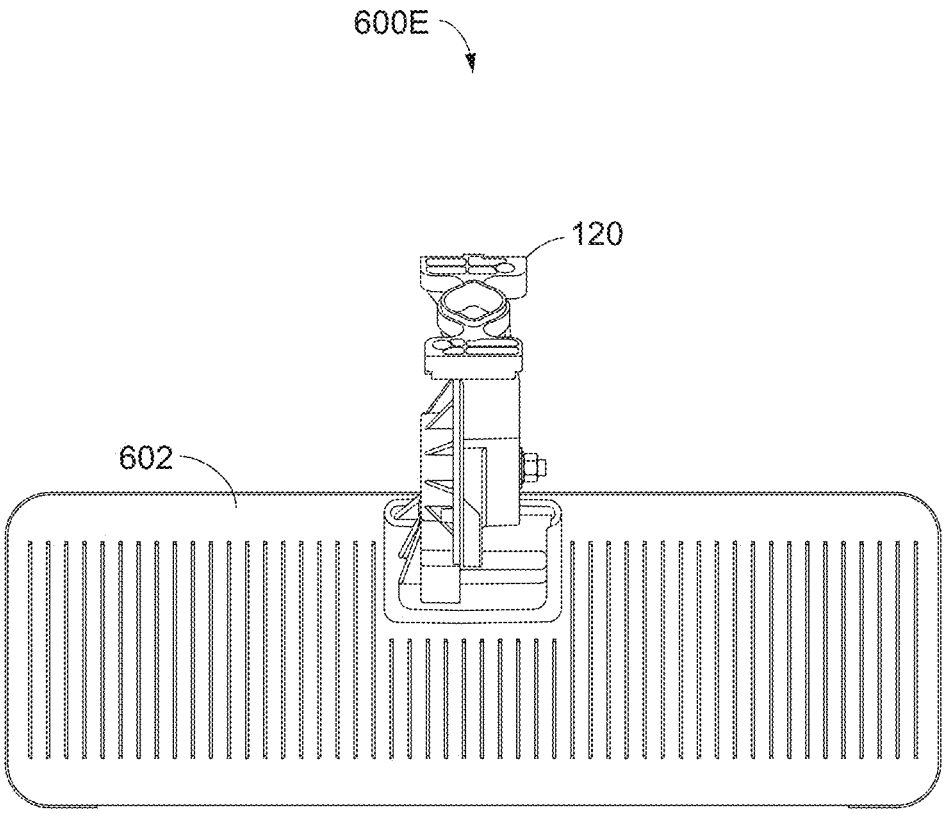
Figure 34:
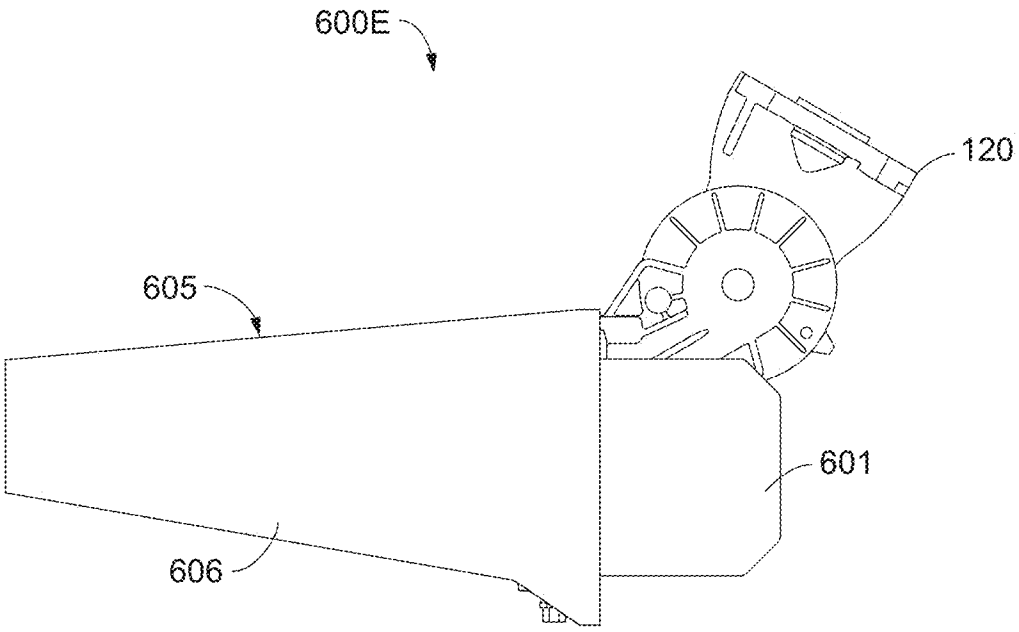
Figure 35:
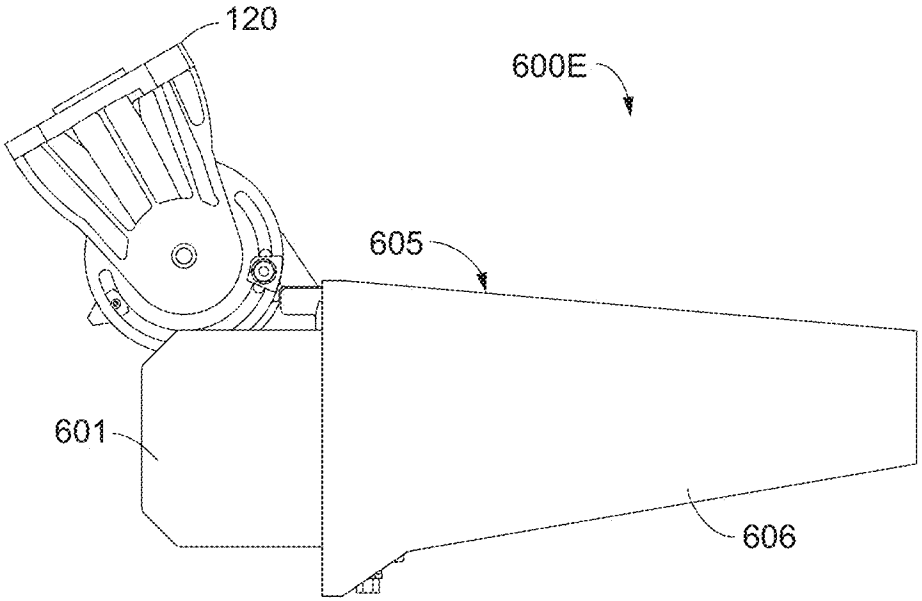
Figure 36:
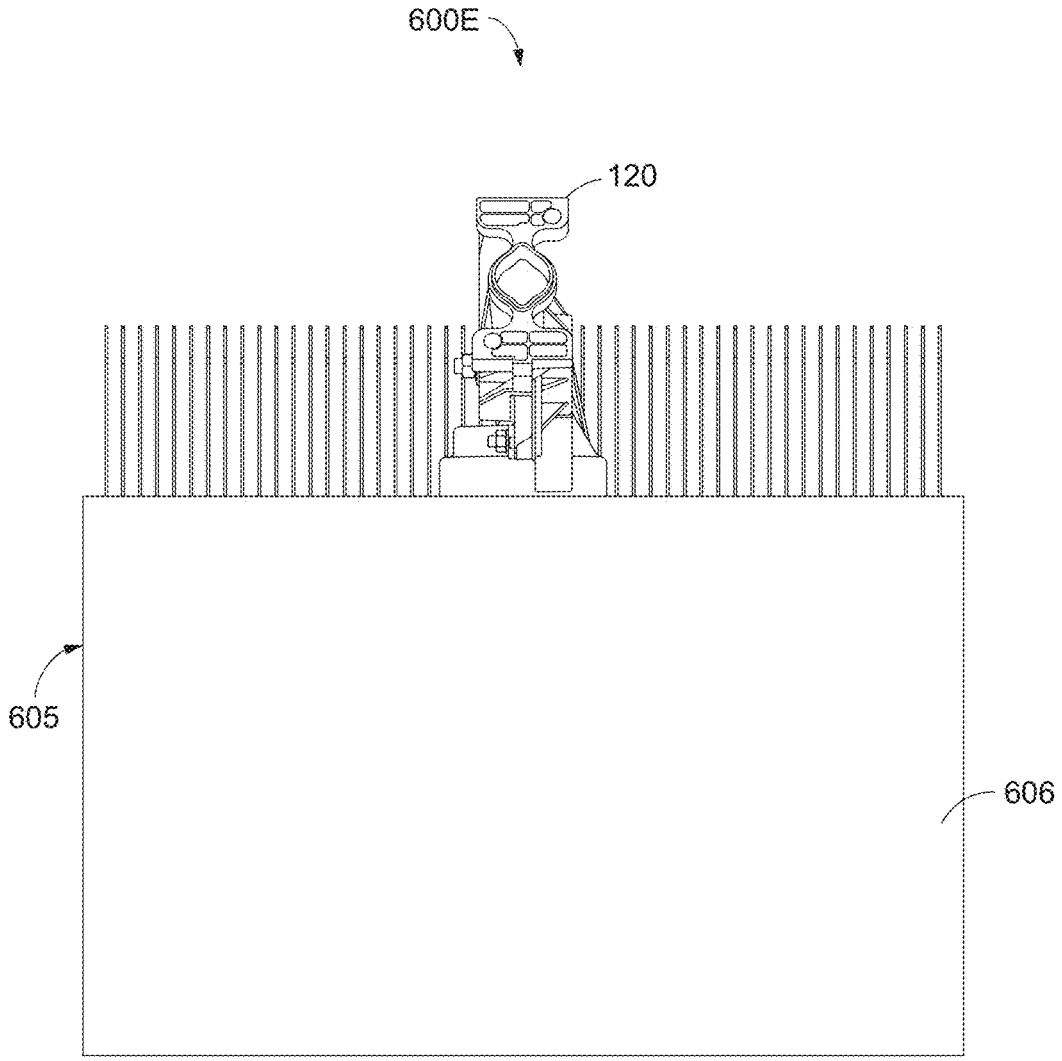
Figure 37:
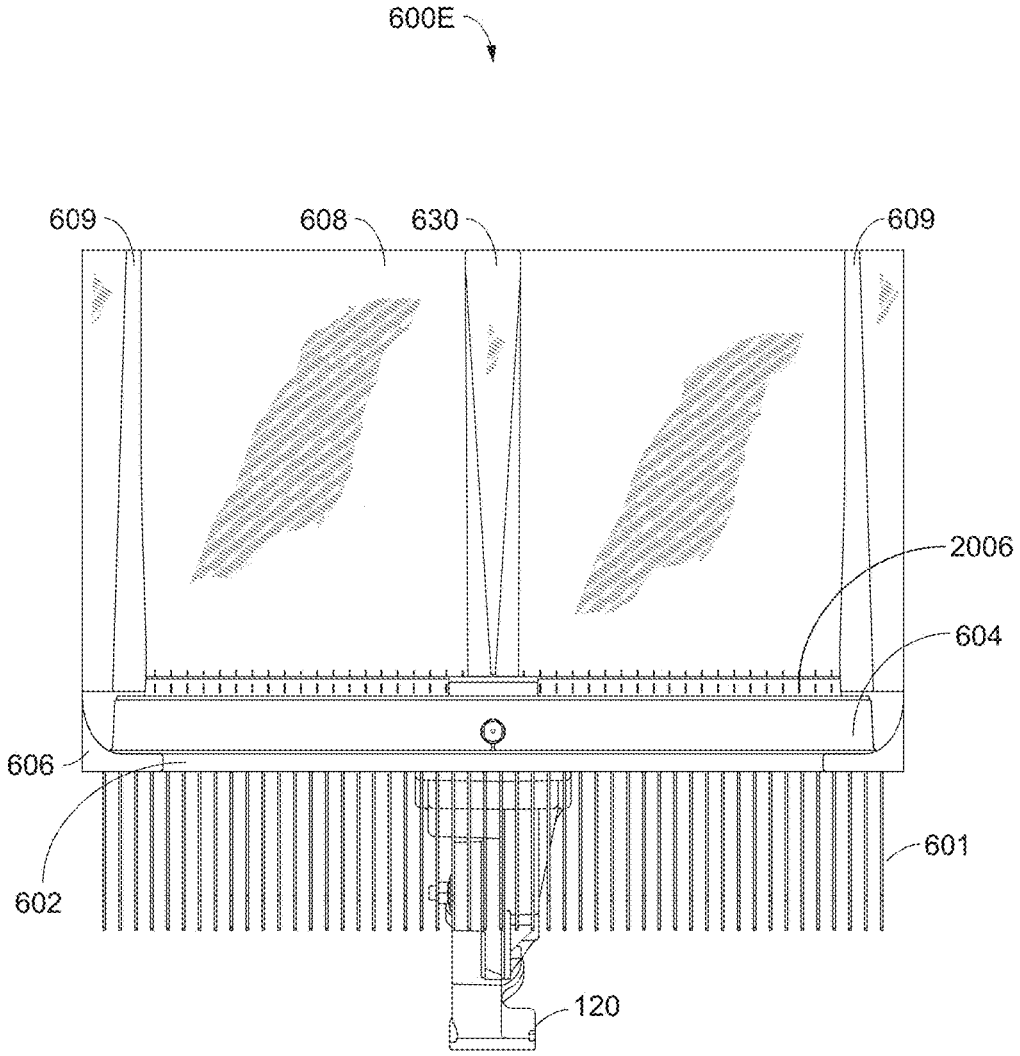
Figure 38:
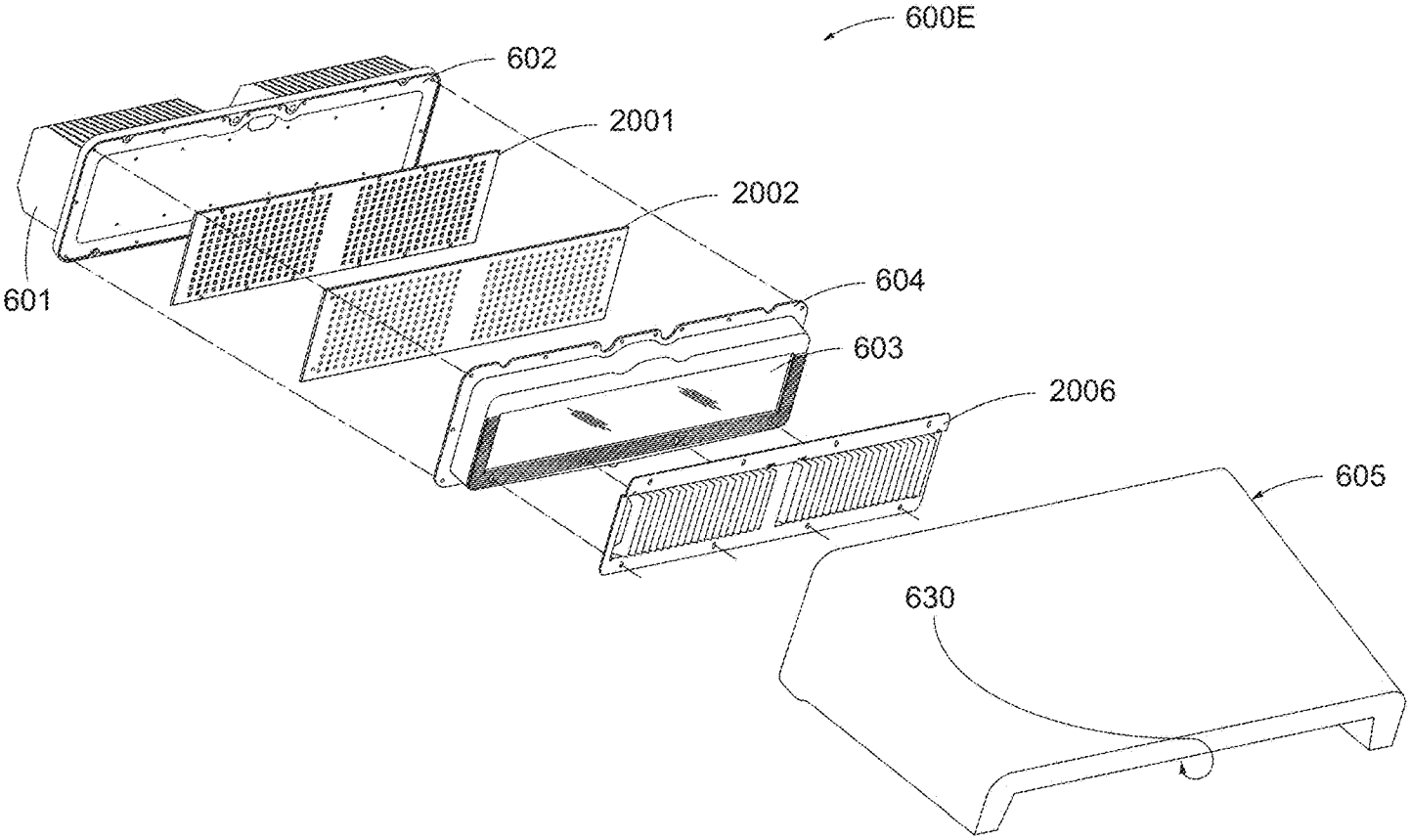
Figure 39:
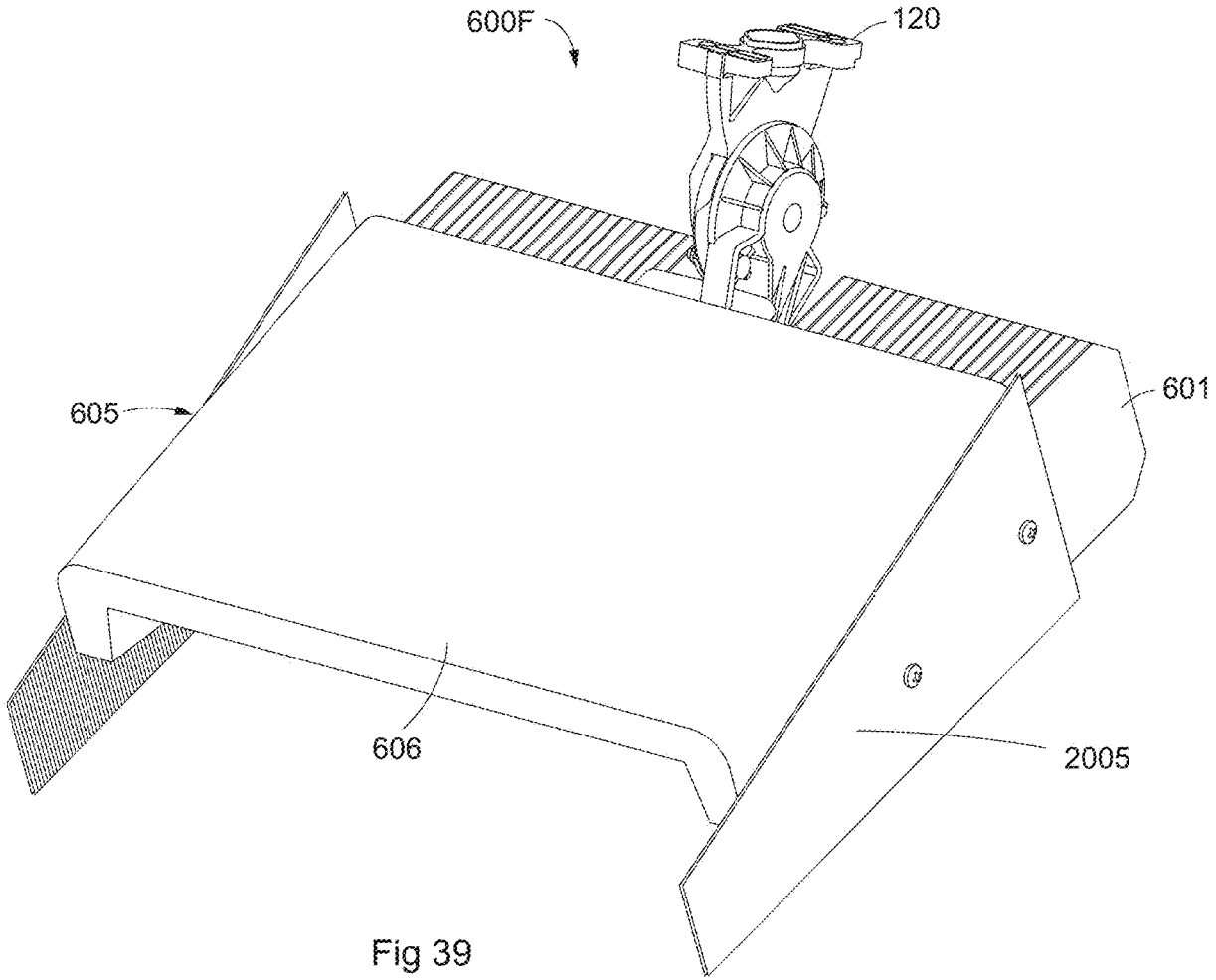
FIGS. 39-46 illustrate a third embodiment according to aspects of the present invention; here a version using removable visors on either or both sides of a luminaire for improved glare control and horizontal beam containment.
Figure 40:
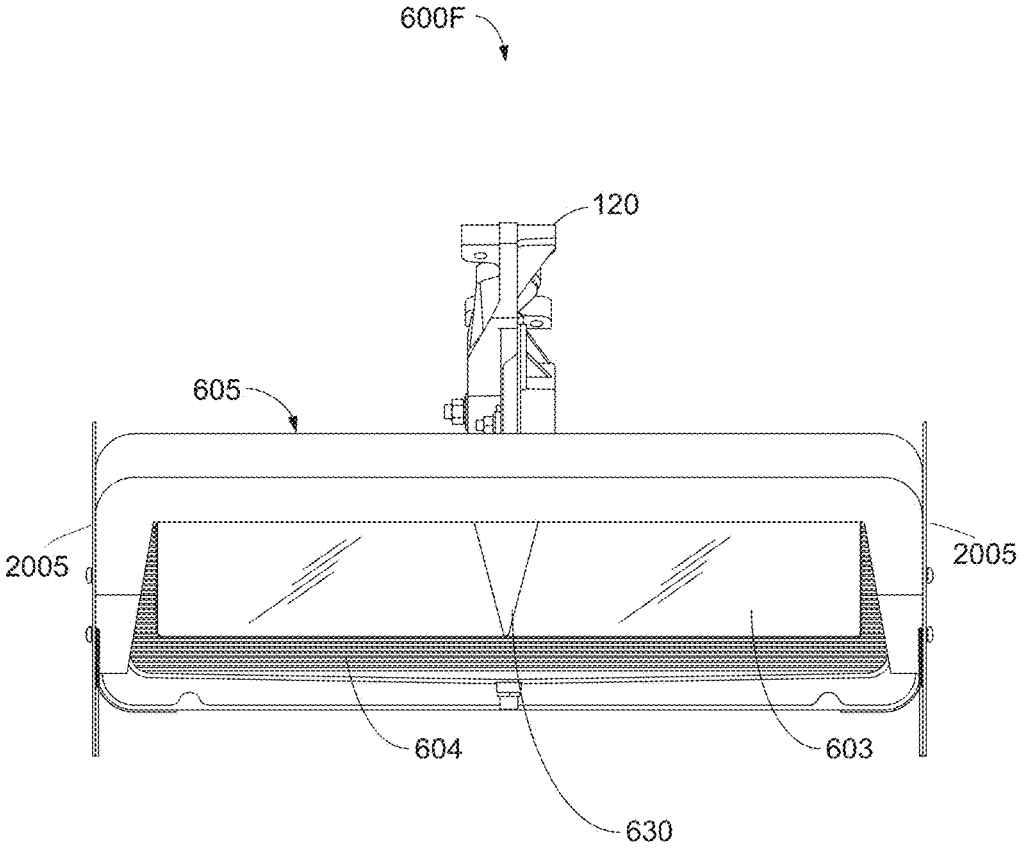
Figure 41:
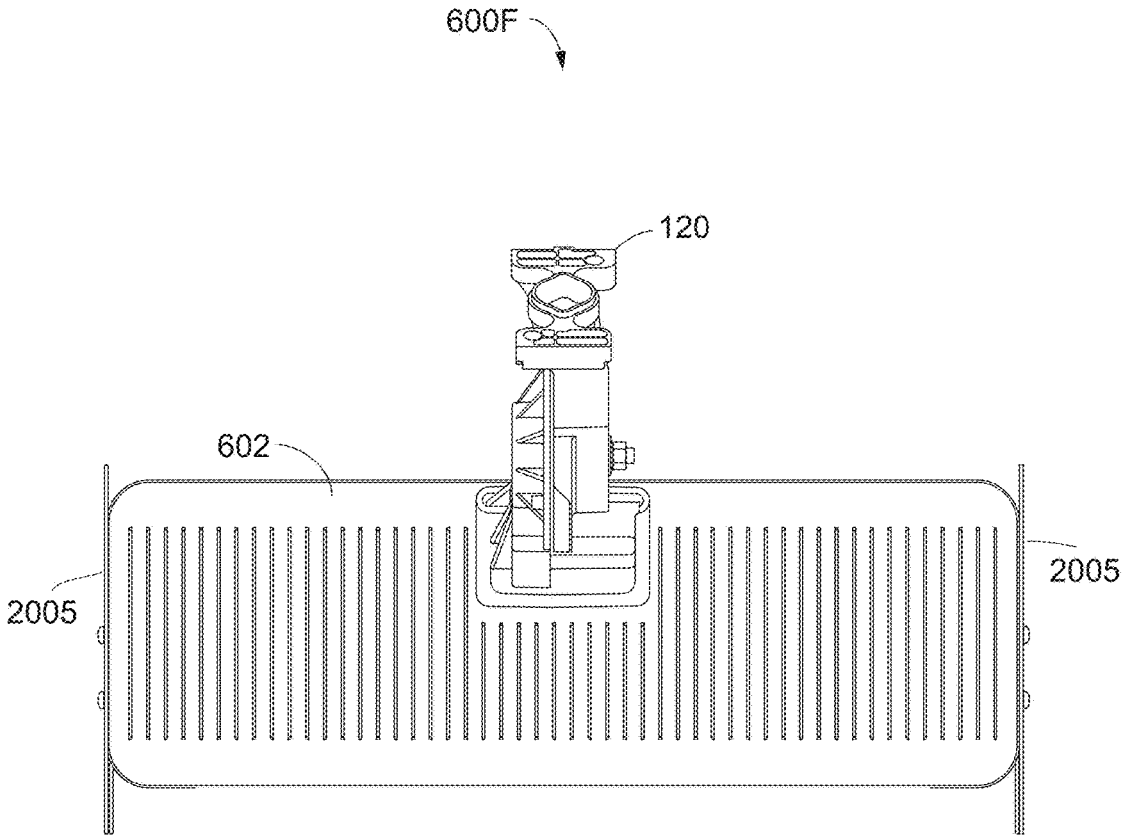
Figure 42:
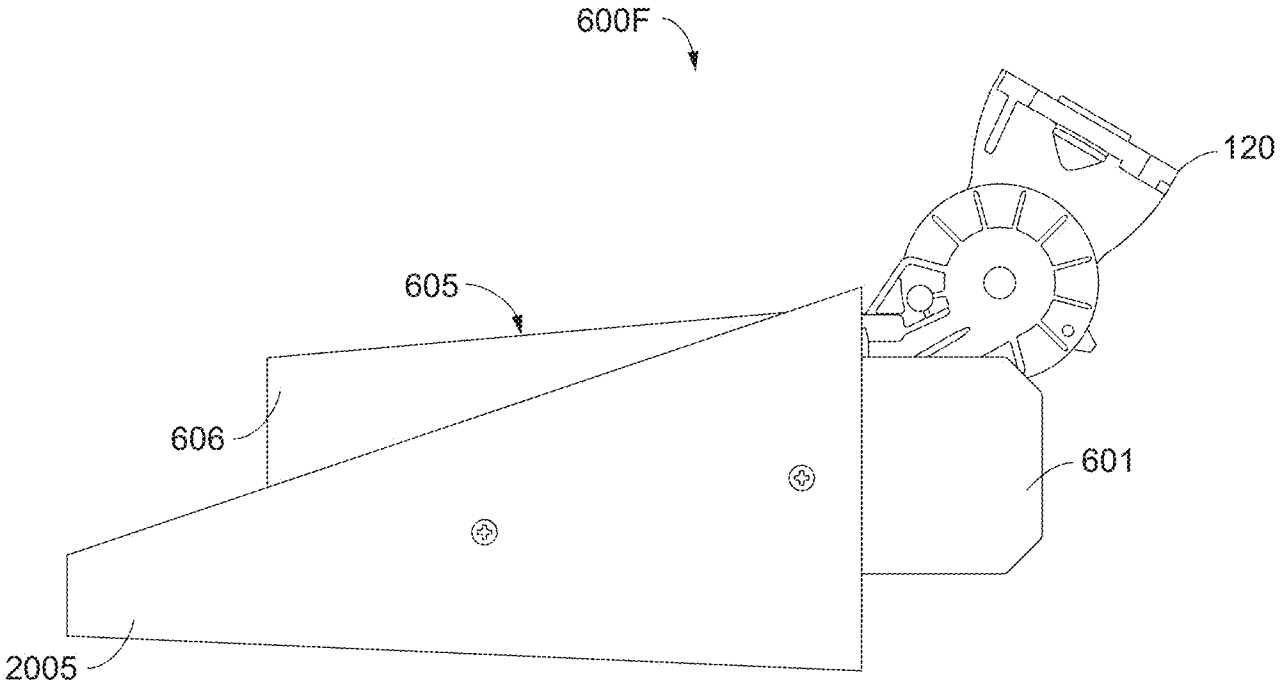
Figure 43:
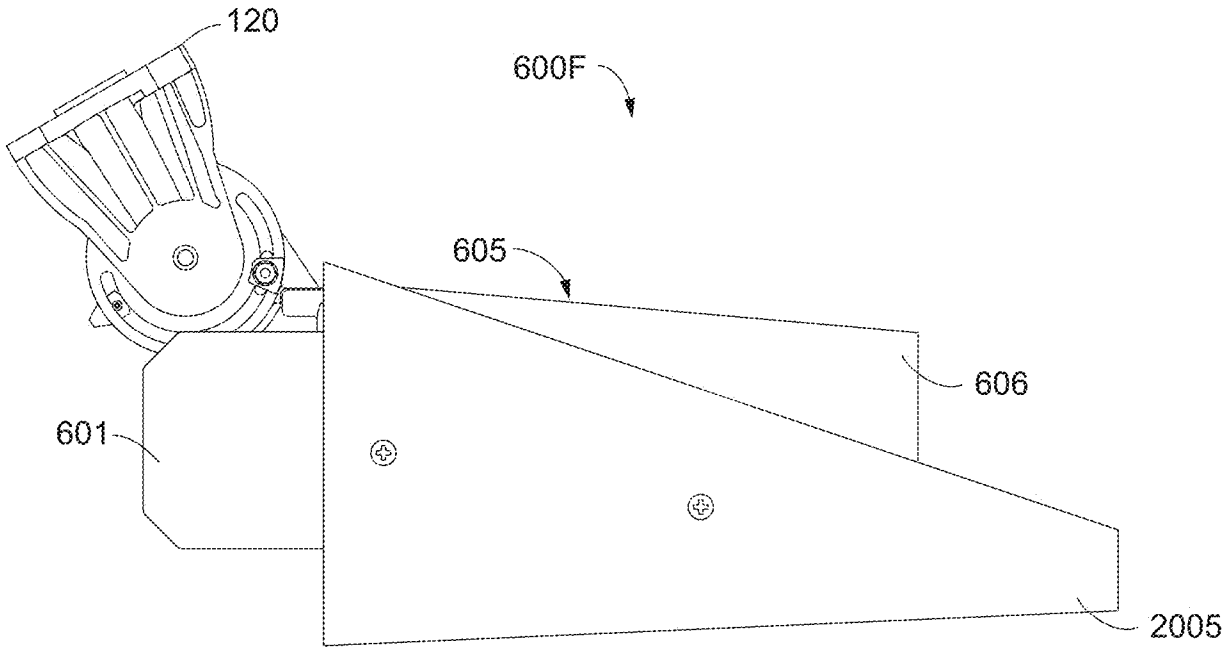
Figure 44:
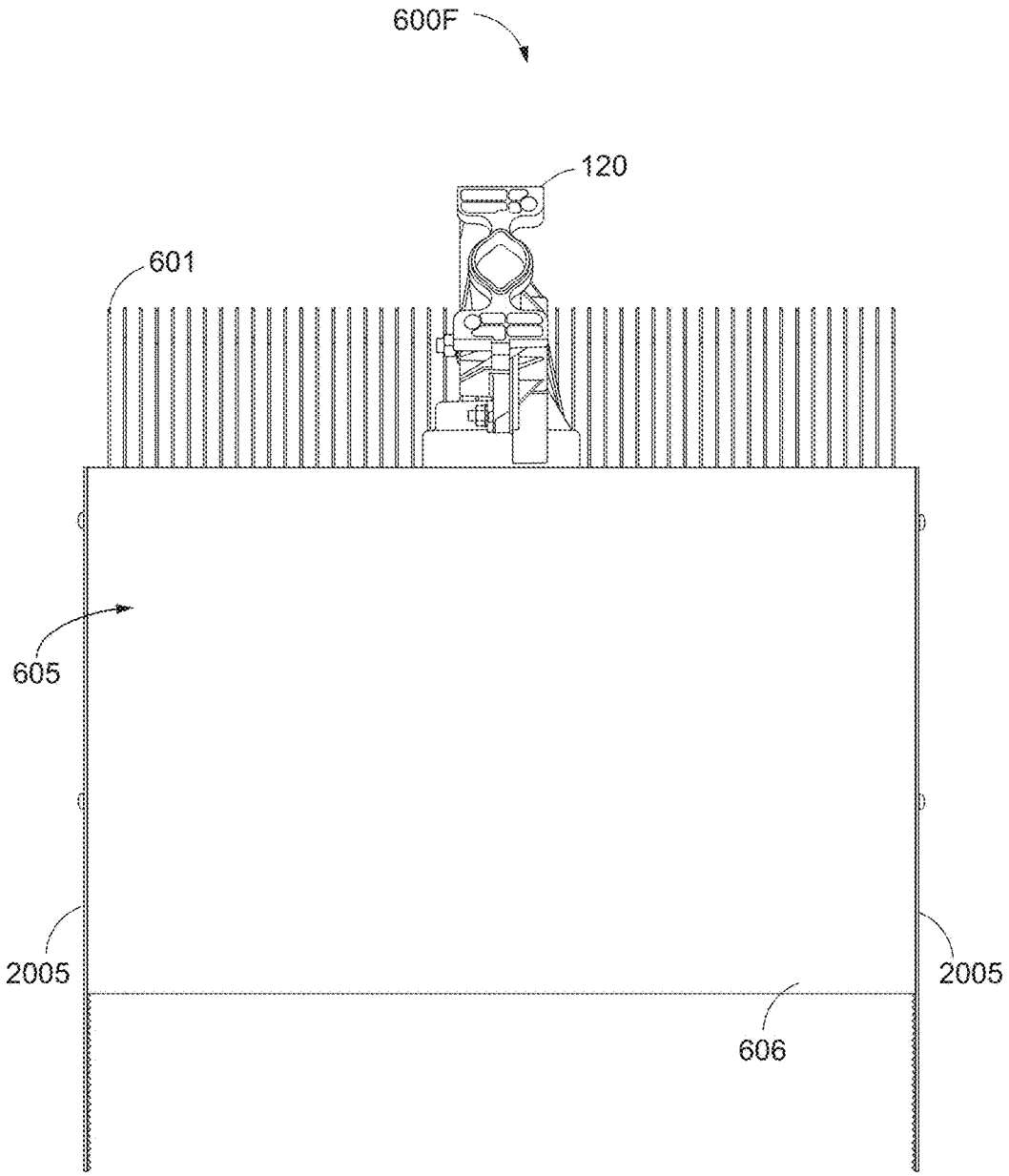
Figure 45:
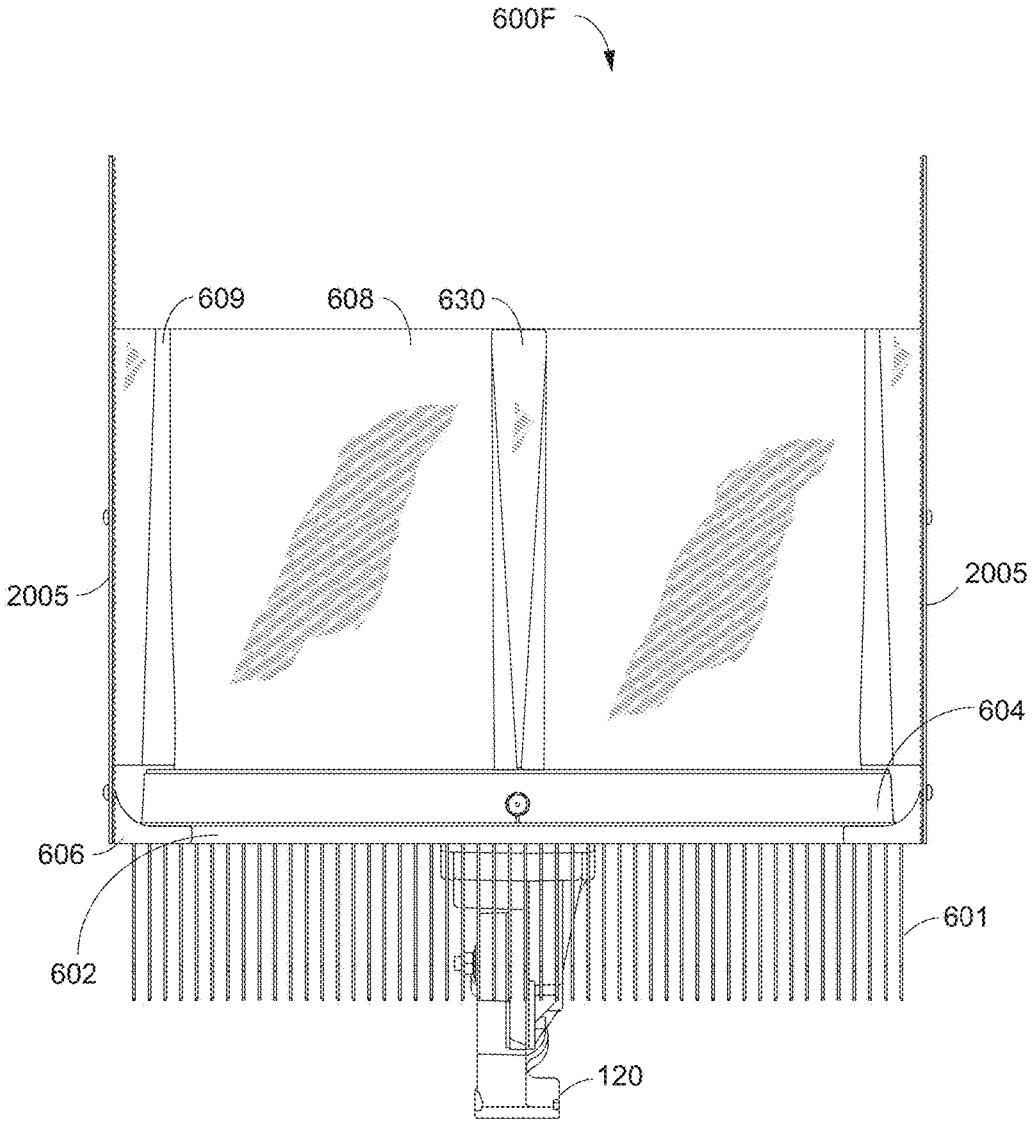

Set forth are a number of embodiments and options for providing modular, interchangeable, or otherwise selectable apparatus to provide varying degrees of glare control, horizontal beam containment, and control functionality in cost-effective lighting system retrofits and other applications. As previously stated, all of the embodiments follow the general methodologies set forth in co-pending parent U.S. application Ser. No. 15/826,772 (see also FIGS. 19 and 20); however, for so-called retrofit-of-a-retrofit situations additional methodology as set forth in FIGS. 21 and 22 may be required. It is important to note that methods 3000 and 5000 could be applied to any existing lighting system, but for illustrative purposes, said methods and the following embodiments are applied to the lighting system of FIGS. 1-18.

With regards to improving glare control and horizontal beam containment in the lighting system of FIGS. 1-18 a first step 3001 of method 3000 comprises determine the existing lighting fixture footprint—which generally encompasses determining not only physical size, but luminous output, range of aiming angles, potential photometric interference, and existing glare level and beam spread of each lighting fixture in an array. This is a critical step because it will determine the baseline for the existing system, and will yield any hard boundaries beyond which the retrofit-of-a-retrofit (hereinafter "upgraded retrofit") cannot exceed. For example, if a luminaire of the existing system has a visor length of 24" and a horizontal aiming angle of 10 degrees either side of neutral (i.e., a panning angle of 20 degrees), then the upgraded retrofit system cannot have a visor length of 30" and still maintain a horizontal aiming angle of 10 degrees either side of neutral because it will result in either photometric interference or physical interference between fixtures in the array; this is described in greater detail in said co-pending parent application. Having in hand limitations from step 3001, a second step 3002 comprises shaving the center v-visor (630) to reduce onsite glare. It is important that the v-visor be retained rather than removed completely because its presence prevents direct viewing of the LED light sources at certain viewing angles—angles which are along typical view lines in most sports—thus preserving playability. According to a third step 3003 horizontal containment lost by shaving the v-visor is reestablished—and further improved beyond the existing LED lighting system retrofit—via selection of one or more of the apparatuses set forth in the embodiments below. As will be discussed, each embodiment has some advantage, and some may be better suited to a particular application. For example, if the target area is a baseball field such as that illustrated in FIG. 1, and the existing LED retrofit fixture is aimed towards a sideline, then the upgraded retrofit fixture would likely rely upon containment apparatus discussed in either Embodiments 3 or 4—because Embodiments 3 and 4 permit visors to be installed on neither, one, or both sides of the fixture. So in this situation an upgraded retrofit fixture aimed along the first base line from the Pole B location could include containment apparatus of either Embodiments 3 or 4 only on the right side of the fixture to maximize playability for the batter by preventing onsite glare. As another example, an existing retrofit system may have luminaires with a highly desirable aesthetic, and so the upgraded retrofit fixture would likely rely upon containment apparatus discussed in either Embodiments 1 or 2—because they are cheap, lightweight, and can be discretely added without impacting aesthetics of the fixture, array, or lighting system. A final step 3004 comprises evaluating luminous output and perceived glare. In the endeavor of providing horizontal beam containment light will likely be absorbed and lost. Some embodiments exhibit higher light loss than others; as such, the upgraded LED lighting system retrofit may include a combination of embodiments to achieve the desired degree of glare control and horizontal beam containment while maintaining an acceptable luminous output.

Figure 3:
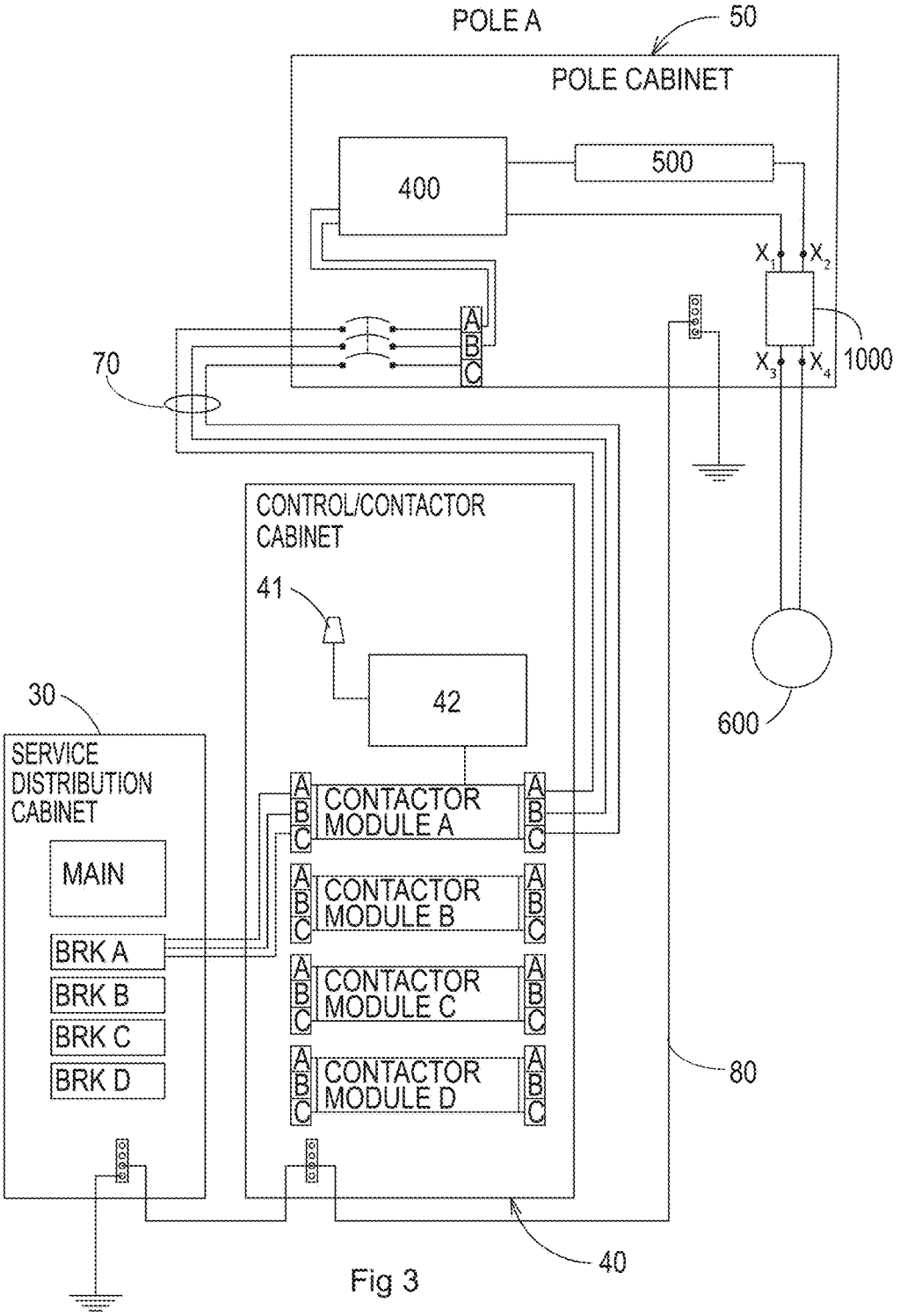
FIG. 3 illustrates a portion of the control means of the lighting system of FIG. 1; here including a complete circuit for a single LED fixture on a single pole.
Figure 4:
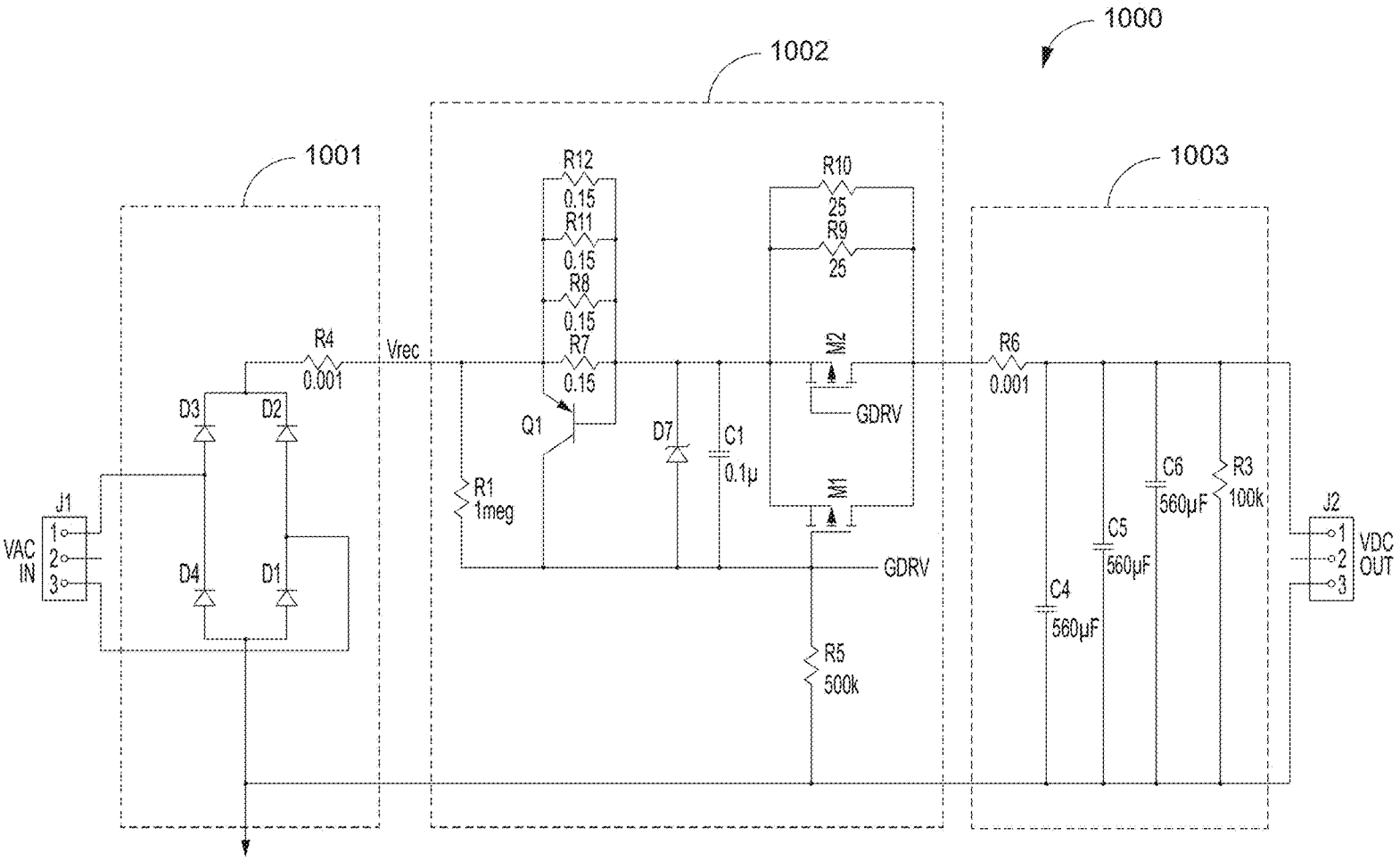
FIG. 4 illustrates a rectifier control circuit as described in co-pending parent U.S. application Ser. No. 15/826,772.
Figure 5:
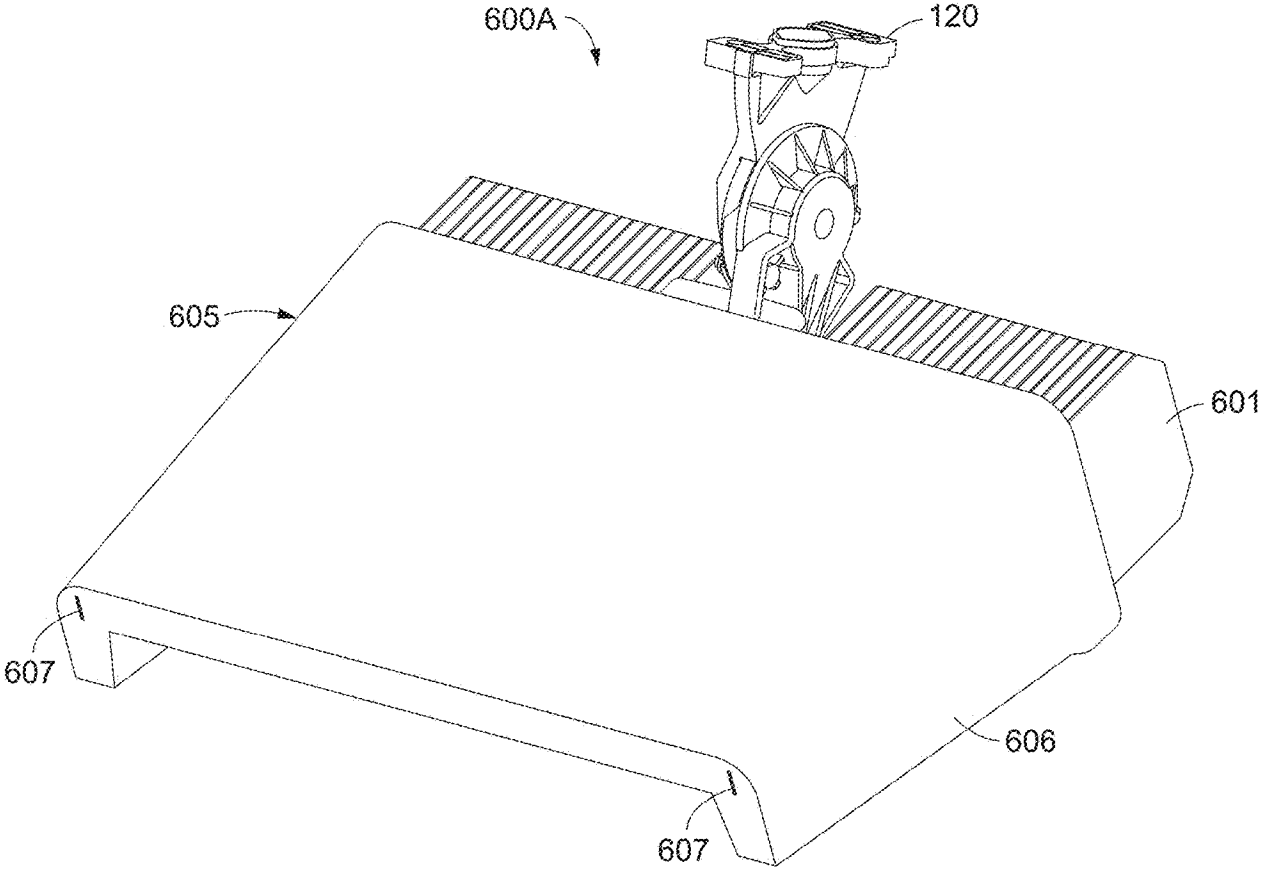
FIGS. 5-13 illustrate various views of one configuration of retrofit LED luminaire described in co-pending parent U.S. application Ser. No. 15/826,772.
Figure 6:
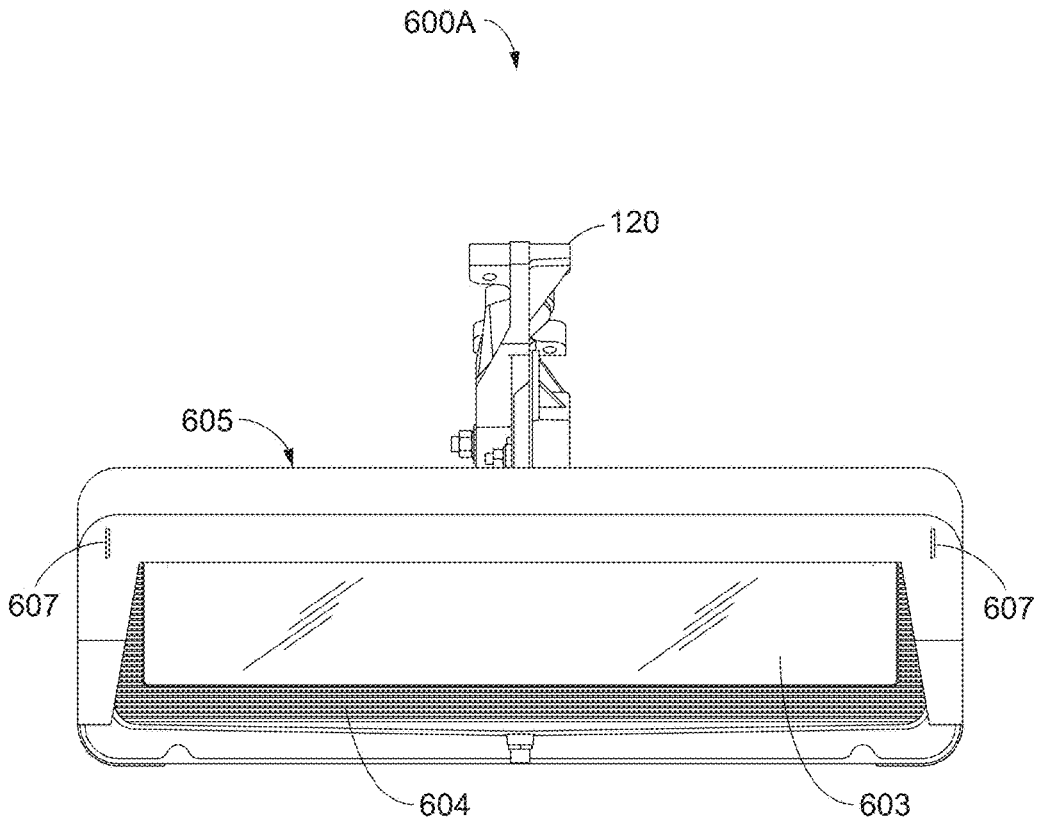
Figure 7:
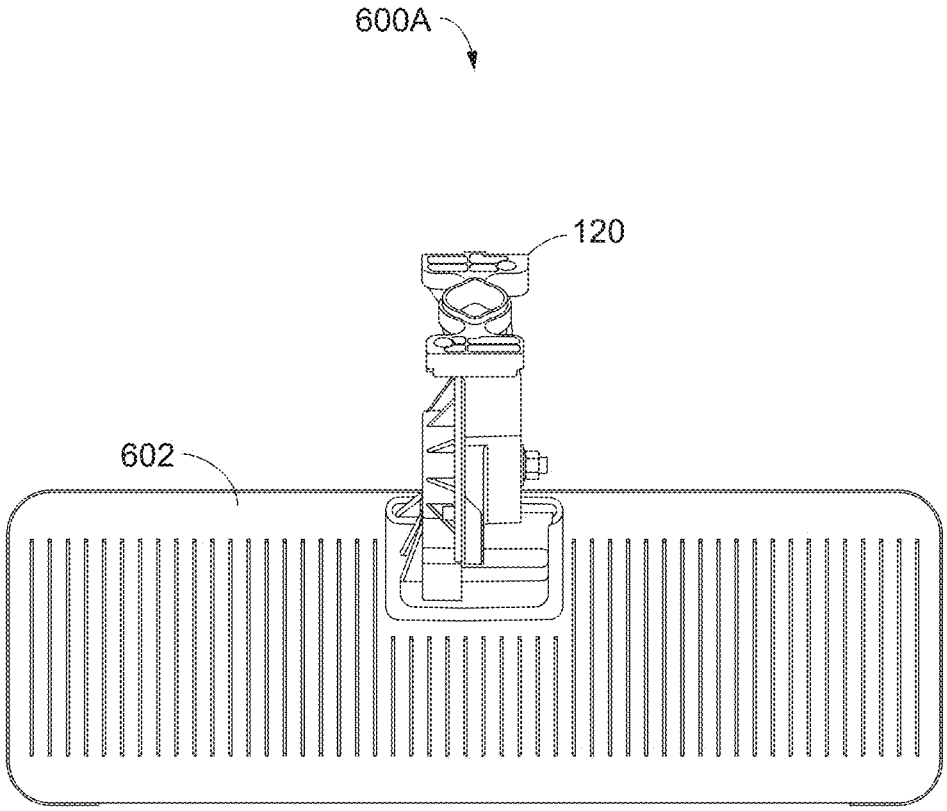
Figure 8:
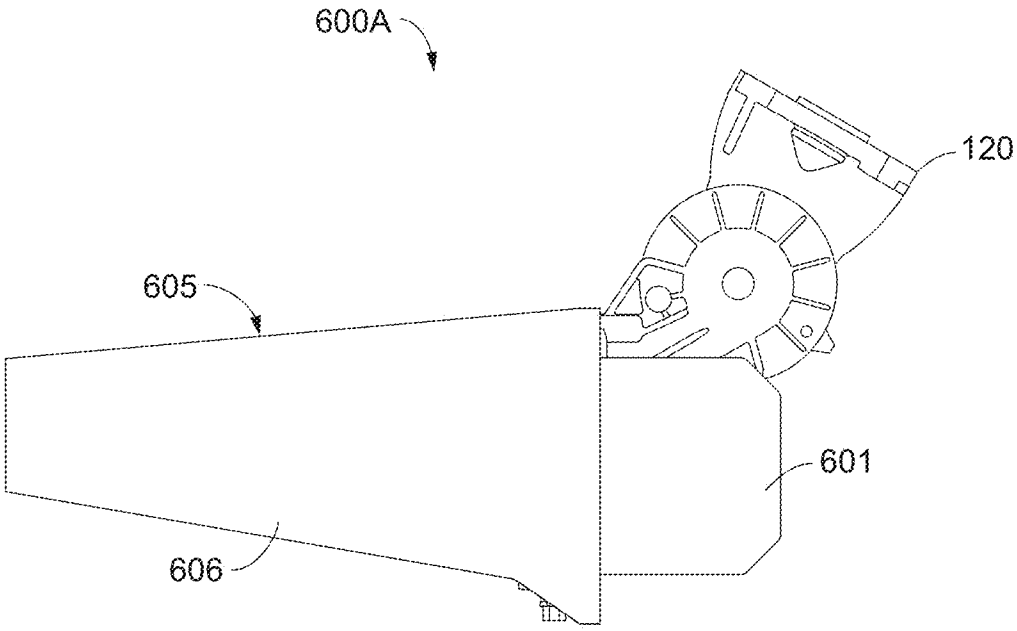
Figure 9:
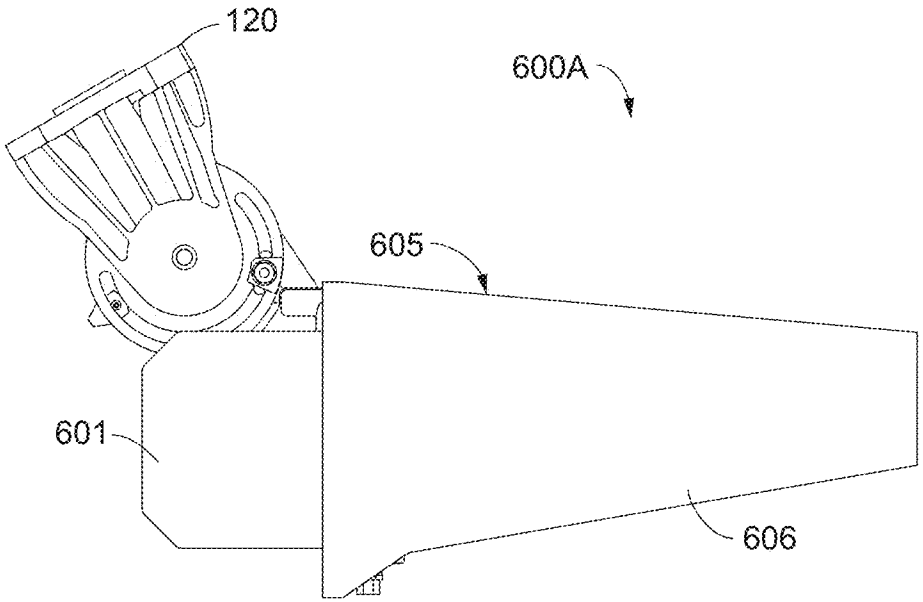
Figure 10:
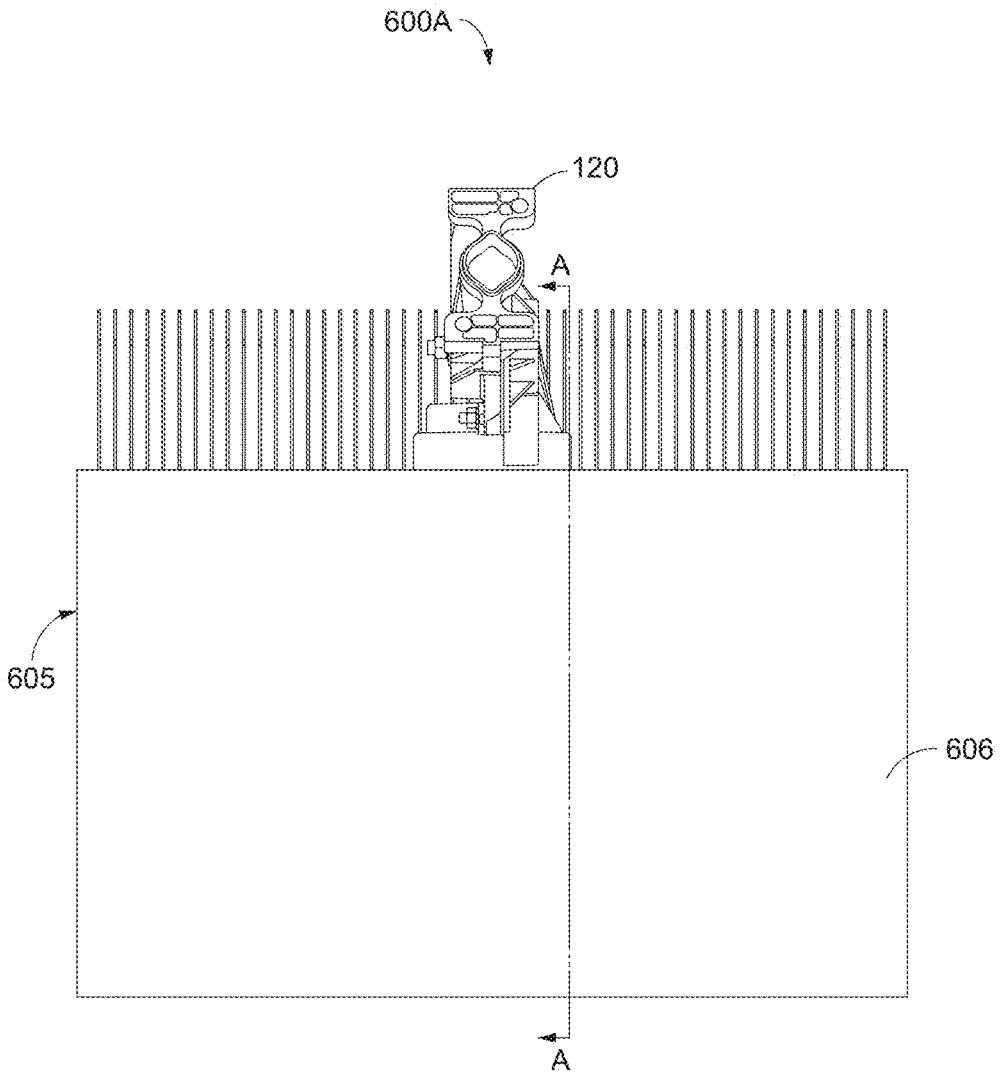
Figure 11:
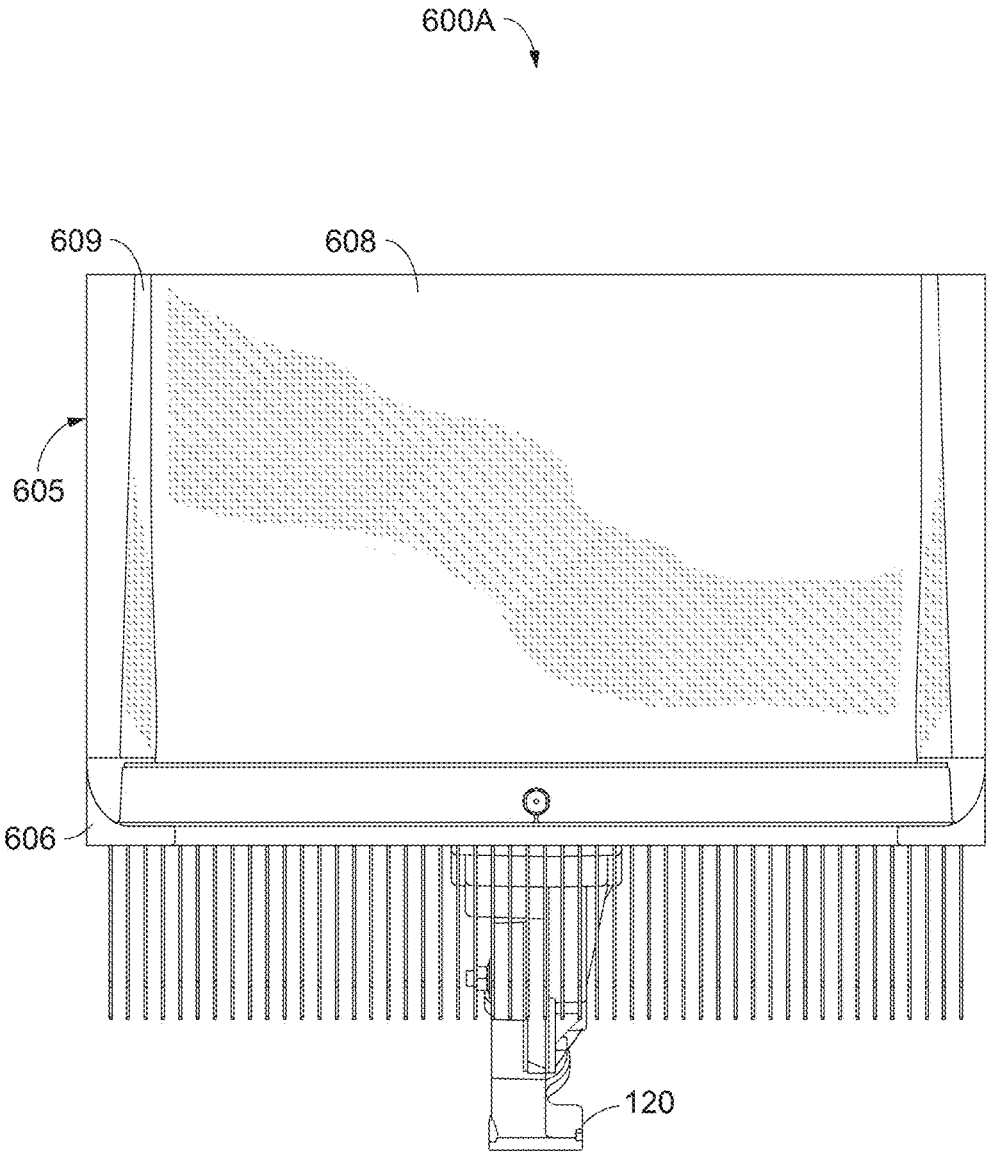
Figure 12:
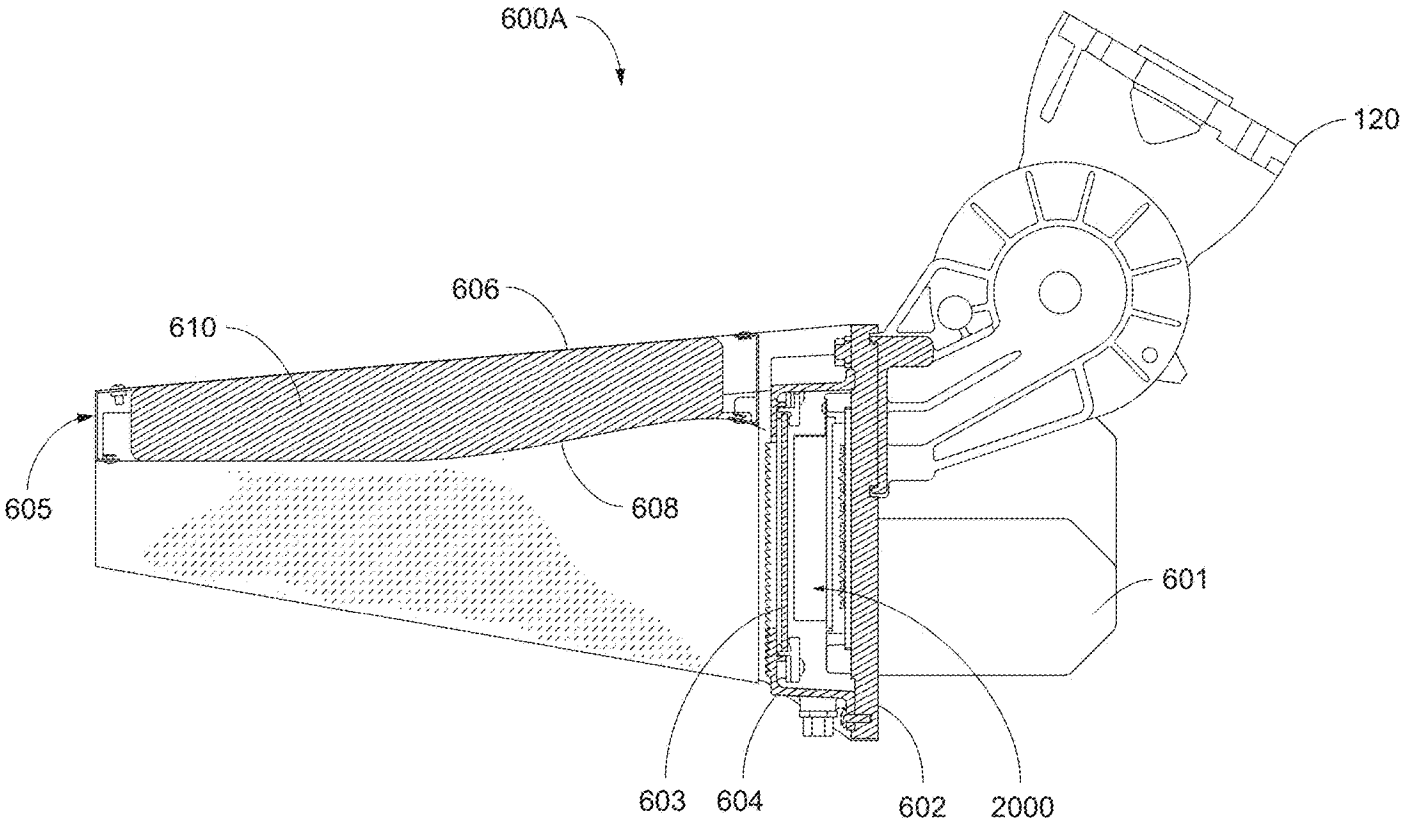
Figure 13:
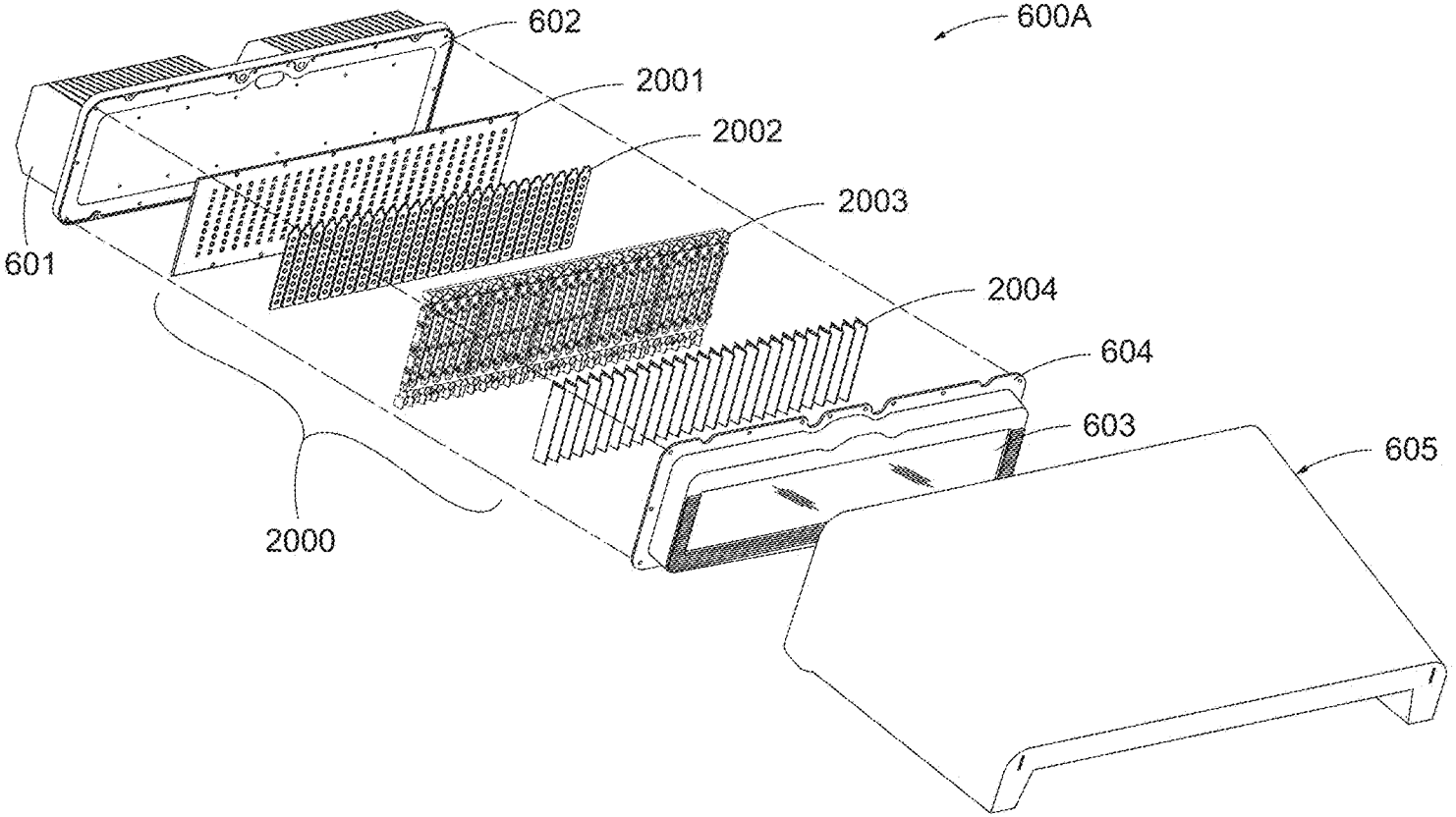
Figure 14:
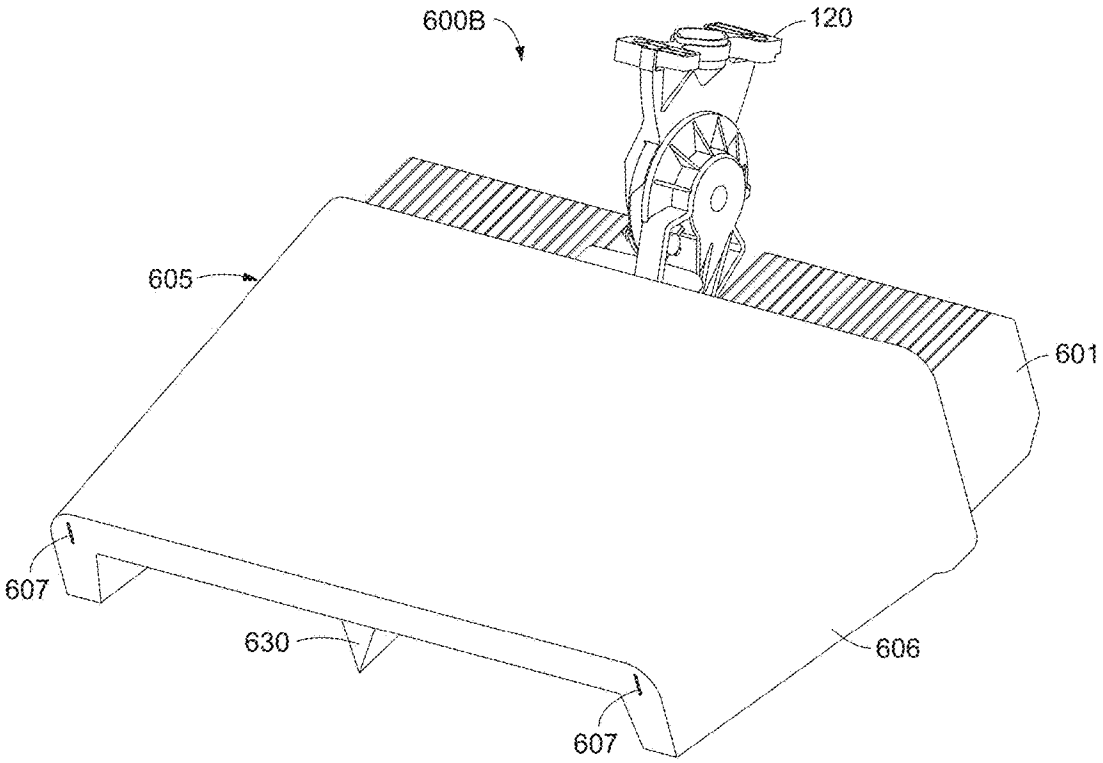
FIGS. 14-16 illustrate various views of another configuration of retrofit LED luminaire described in co-pending parent U.S. application Ser. No. 15/826,772.
Figure 15:
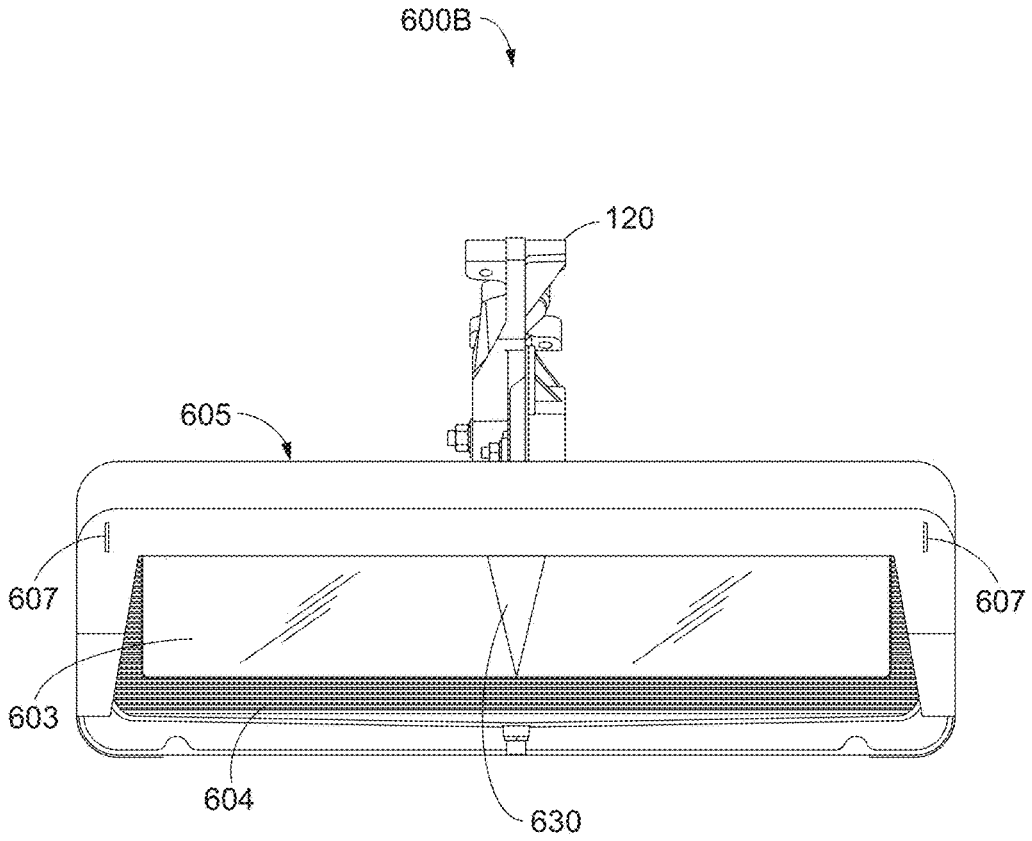
Figure 16:
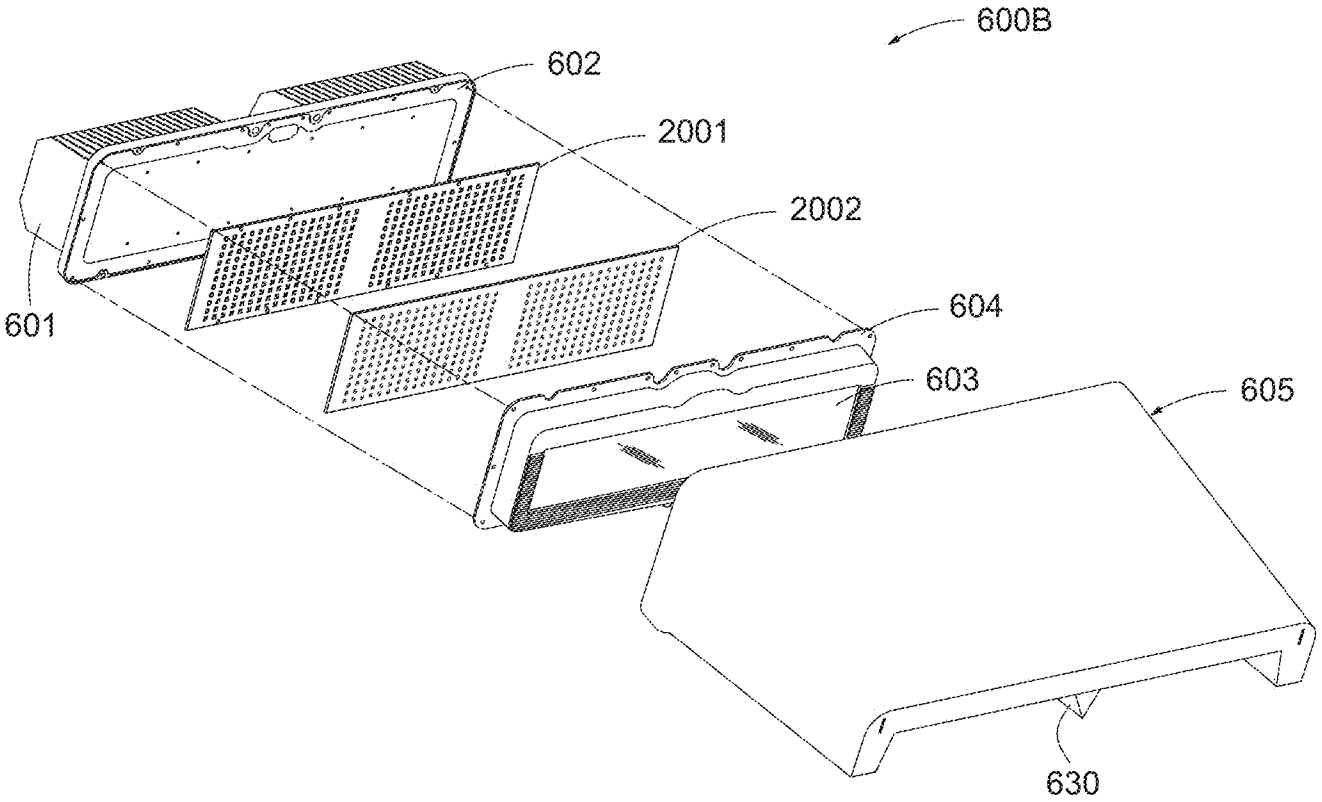
Figure 17:
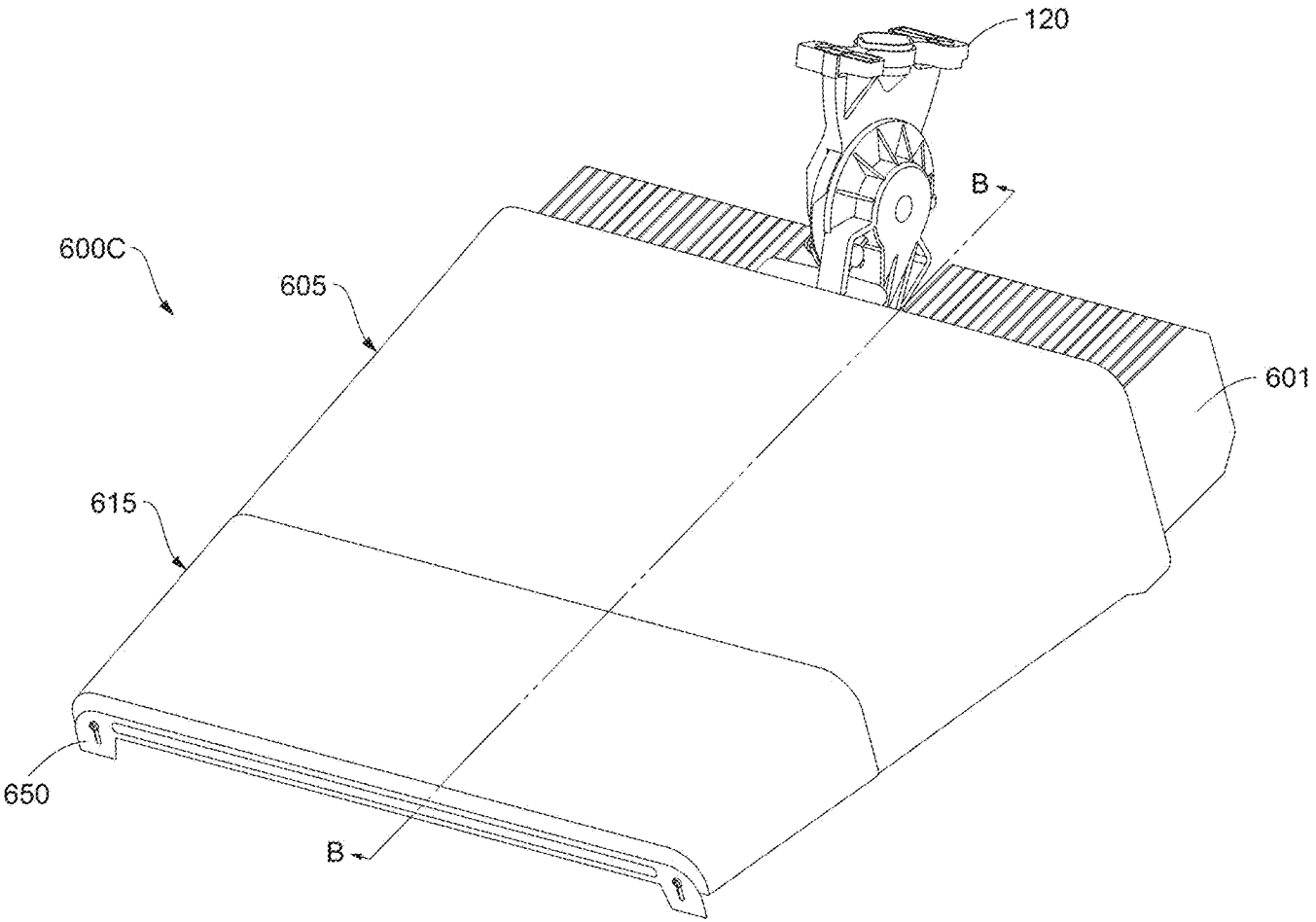
FIGS. 17 and 18 illustrate various views of another configuration of retrofit LED luminaire described in co-pending parent U.S. application Ser. No. 15/826,772.
Figure 18:
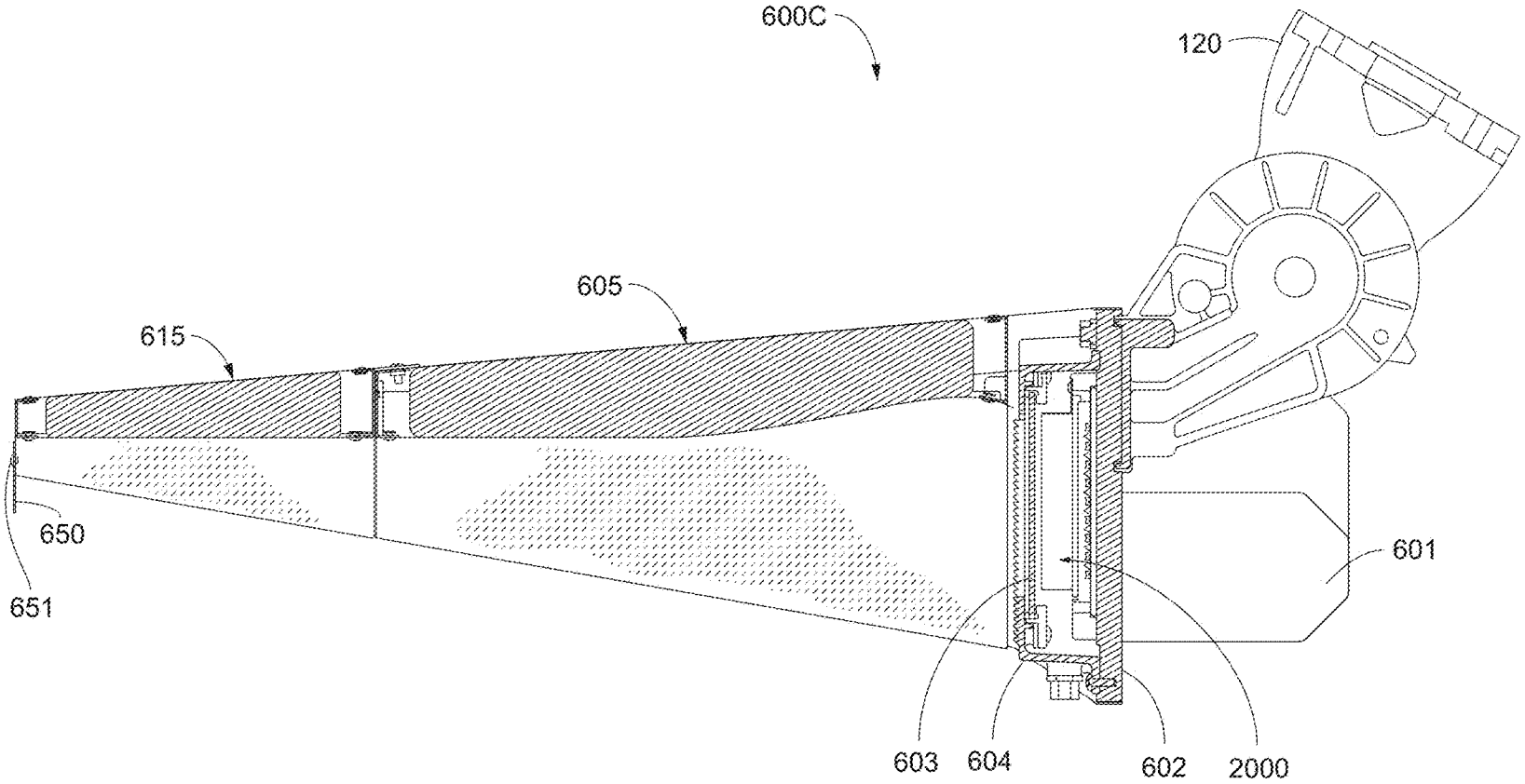
Figure 19:
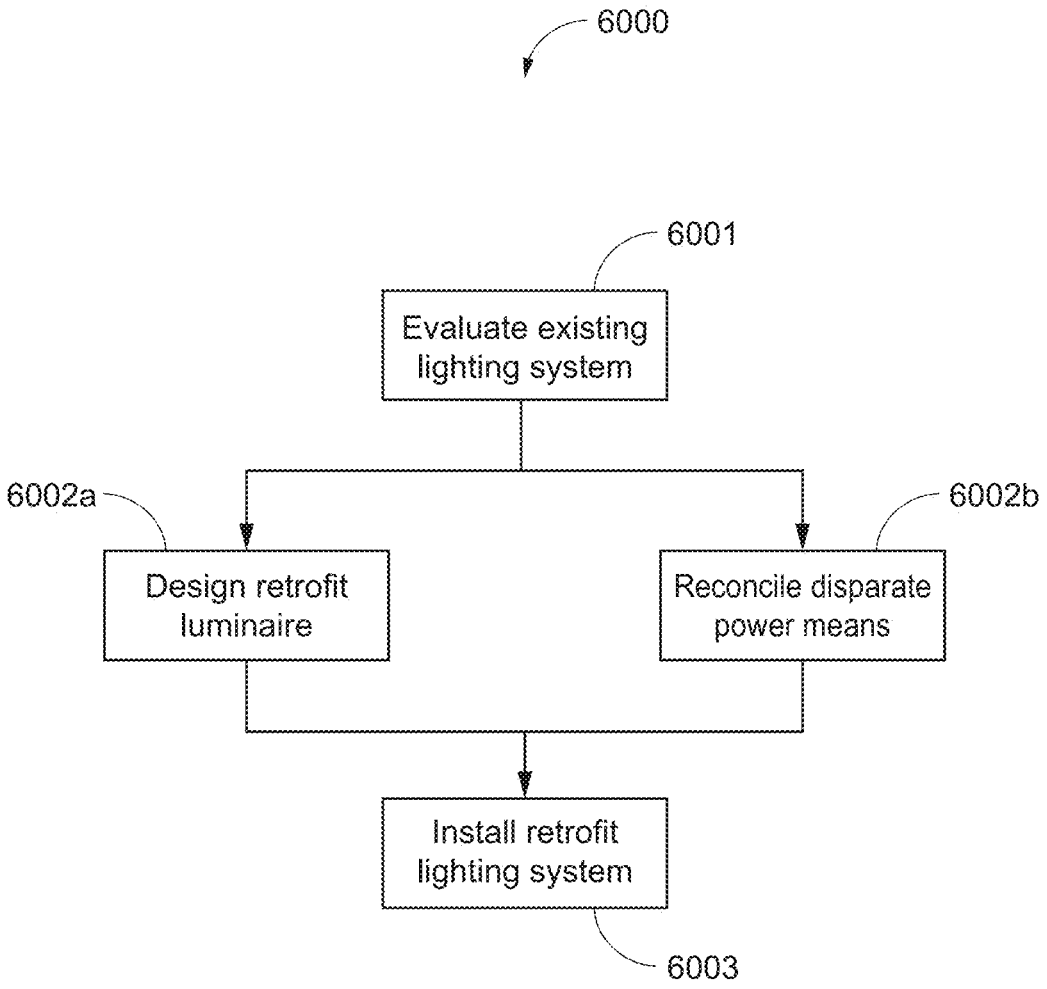
FIGS. 19 and 20 illustrate in flowchart form various methods of designing lighting system retrofits according to co-pending parent U.S. application Ser. No. 15/826,772.
Figure 20:
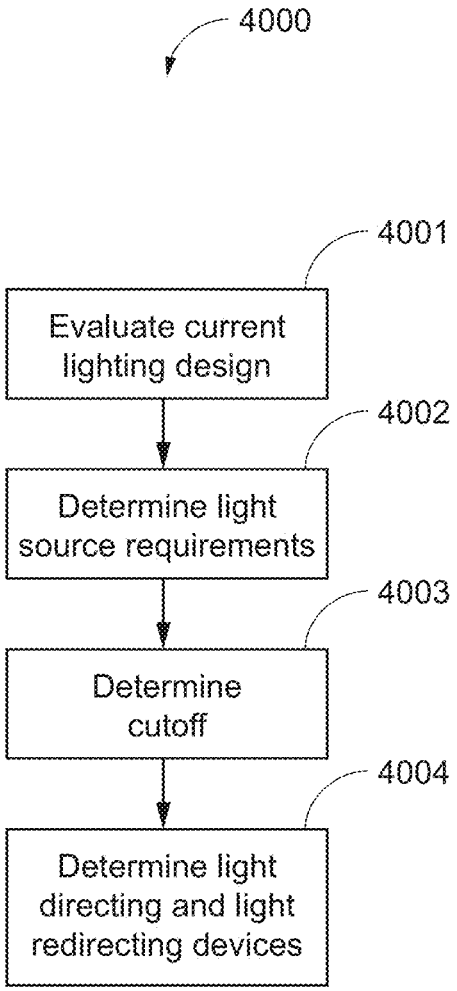
Figure 55:
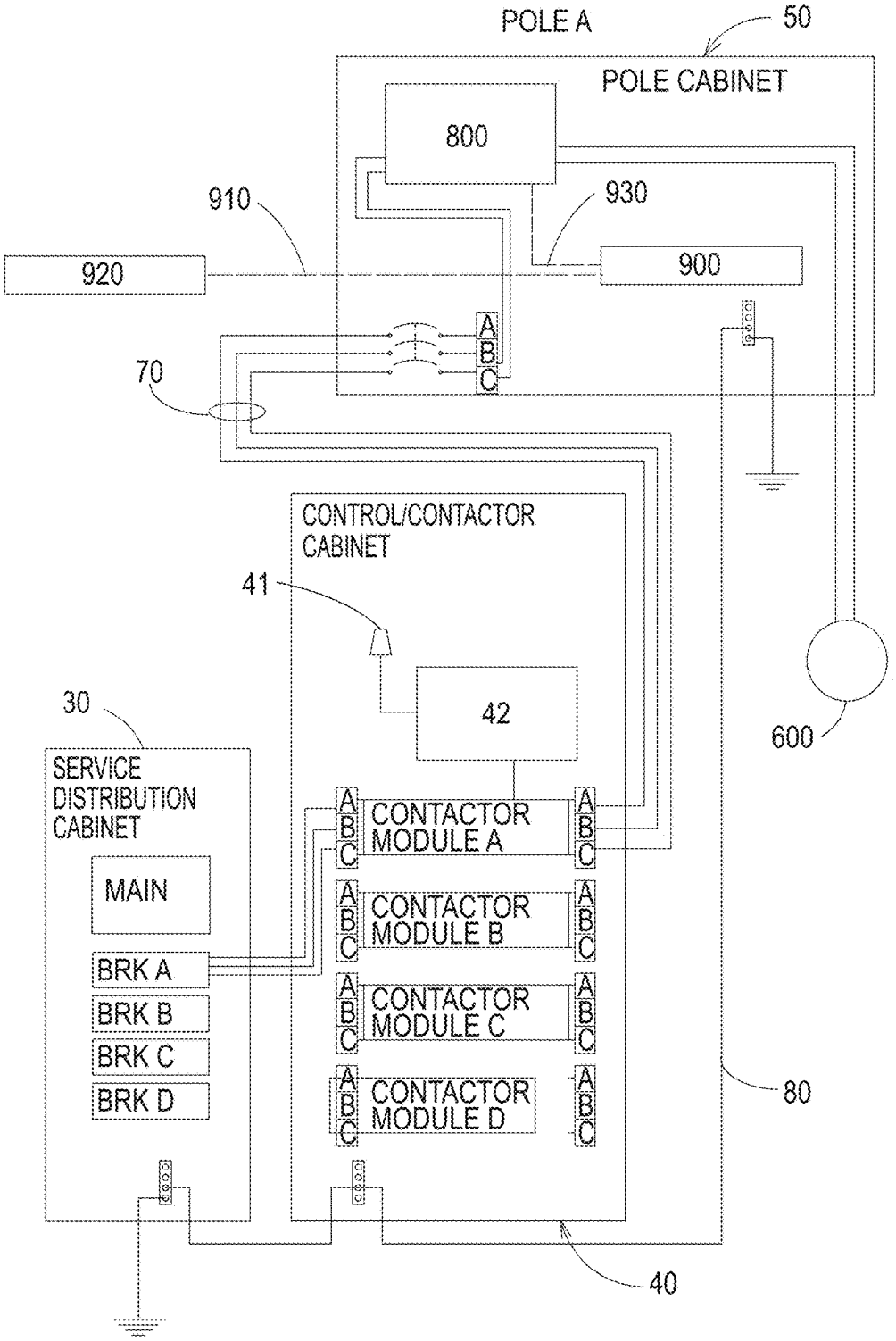
FIGS. 55-57 illustrate modification of the control means of FIGS. 3 and 4 according to the method of FIG. 22.
Figure 56:
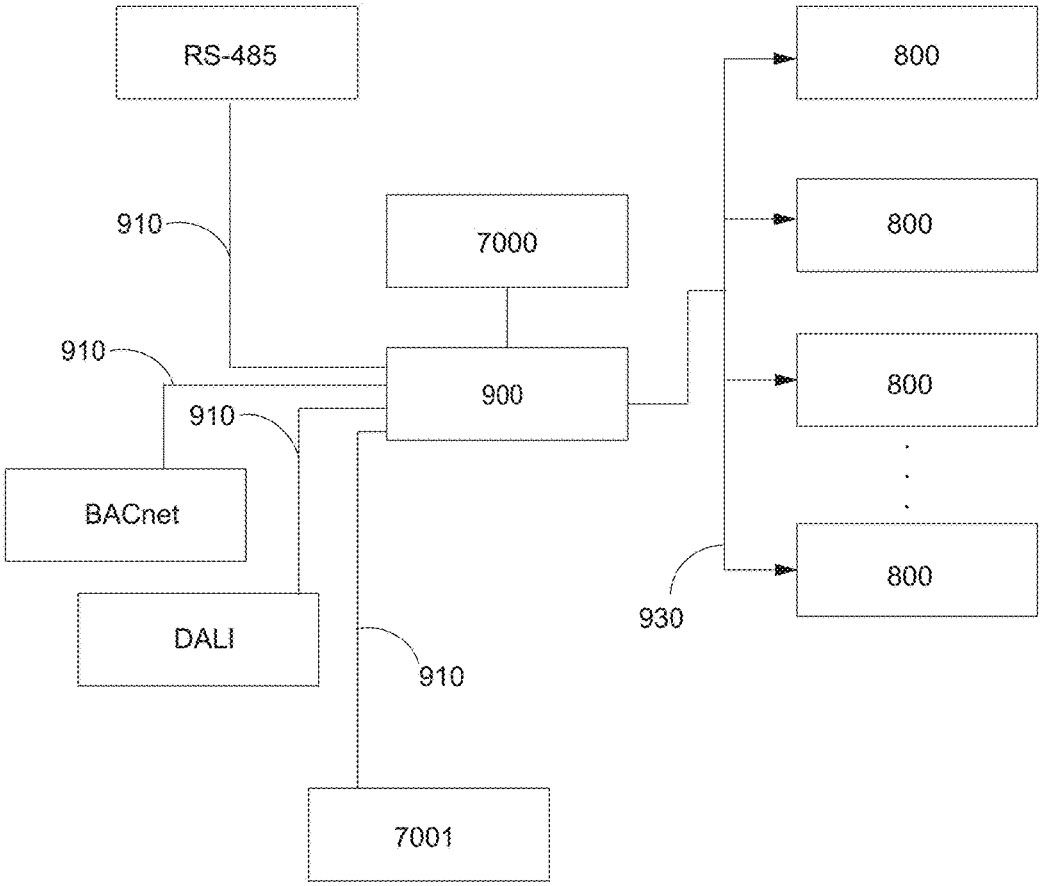
Figure 57:
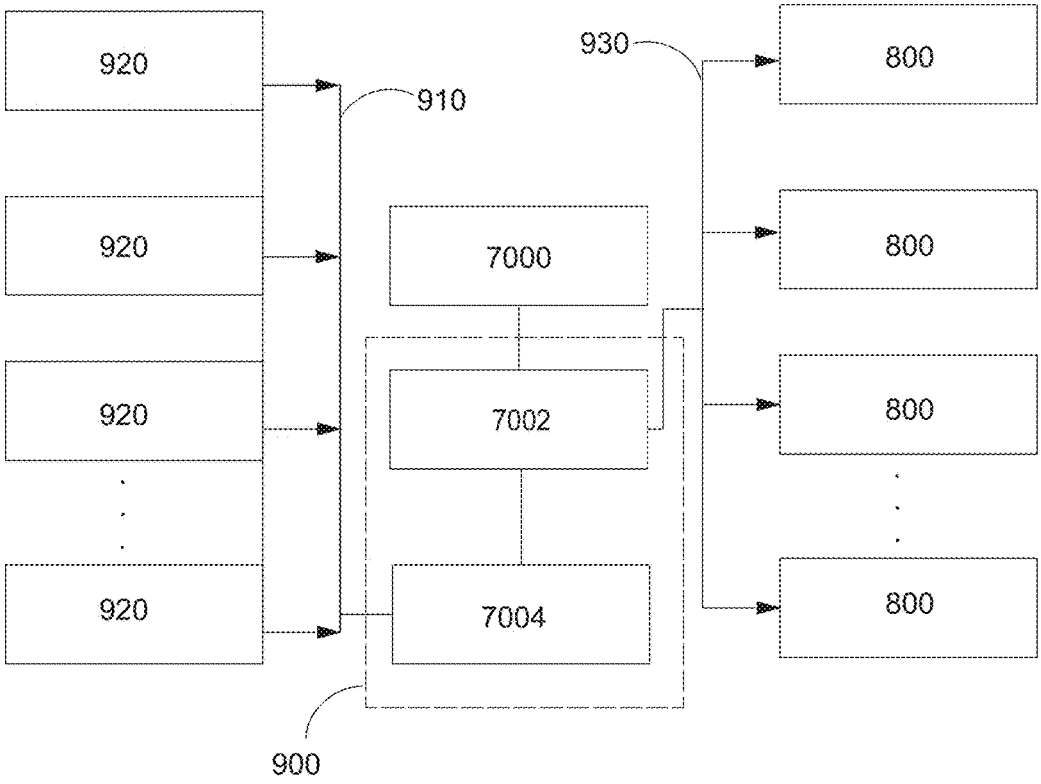

With regards to improving control functionality a first step 5001 of method 5000 comprises evaluating the existing controls—which generally encompasses determining not only what third party controls exist, but what control functionality is actually desired, what exists elsewhere at the site, what future communications development is planned, what connection speeds exist for communication means, and the like. This is a critical step because, like in method 3000, it will determine the baseline for the existing retrofit system, and will yield any hard boundaries beyond which the upgraded retrofit cannot exceed. For example, many times an LED lighting system retrofit will not take the approach of modifying the ballast as illustrated in FIGS. 3 and 4, but will simply gut an enclosure and add an LED driver. Unfortunately, many LED drivers are not compatible with third party control systems that exist elsewhere at a site; for example, many building management systems cannot operate controls for specialized lighting systems. So in this situation an upgraded retrofit control system may include a gateway to bridge the gap between incompatible LED drivers and third party controls rather than take the approach of FIGS. 3 and 4; this is illustrated in FIGS. 55-57. As another example, an existing lighting system retrofit may include simple on/off control at a centralized location (e.g., cabinet 30, FIG. 1) or at each pole (e.g., 50, FIG. 1), or even from a remote location (e.g., control center 10, FIG. 1), but no dimming capability. There are well established communication protocols such as DALI that are used in the control of some lighting systems, and such as BACnet that are used in the control of non-lighting systems, which may already be present on site and which can be used to provide upgraded functionality like dimming. All of the aforementioned may be gleaned from step 5001 and used to determine which of paths 5002*a* and 5002*b* may be undertaken.

Assuming it is possible to provide an upgraded retrofit with respect to controls, an appropriate communication interface is first developed (step 5002*a*); if it is not possible or is economically infeasible, non-retrofit options must be explored (step 5002*b*) such as not trying to interface with existing third party controls and relying instead on a new control system for specialized lighting systems (e.g., CONTROL-LINK® control system available from Musco Sports Lighting, LLC, Oskaloosa, Iowa, USA). Collective step 5002 is a critical step because understanding and designing to the available communication means will dictate the speed at which control commands can be communicated, whether or not data (e.g., for diagnostics) can be communicated in addition to control commands, and whether or not active performance feedback can be gathered, for example.

Following step 5002*a* software and hardware for the upgraded retrofit are developed more or less in unison (steps 5003*a* and 5003*b*). Collective step 5003 may require circling back to information gathered in step 5001. For example, it is important to understand how the end user of the lighting system intends to use controls (e.g., by phone, app on a mobile device, onsite control panel) pursuant to developing the software. Likewise, it is important to know what systems, wiring, and power exists (e.g., room for a dedicated power supply, microprocessors pull power from the driver, high voltages requiring isolation of components) pursuant to developing the hardware. Ultimately, software and hardware need to work together to ensure a user input results in the intended output. The end result (step 5004) is installation of upgraded retrofit control functionality; here added dimming functionality because the lighting system of FIGS. 1-18 was used as the existing retrofit system (and it lacked such functionality when first retrofitted). In practice step 5004 may differ depending on what upgrade is desired and what baseline control functionality exists.

C. Exemplary Method and Apparatus Embodiment 1

Figure 46:
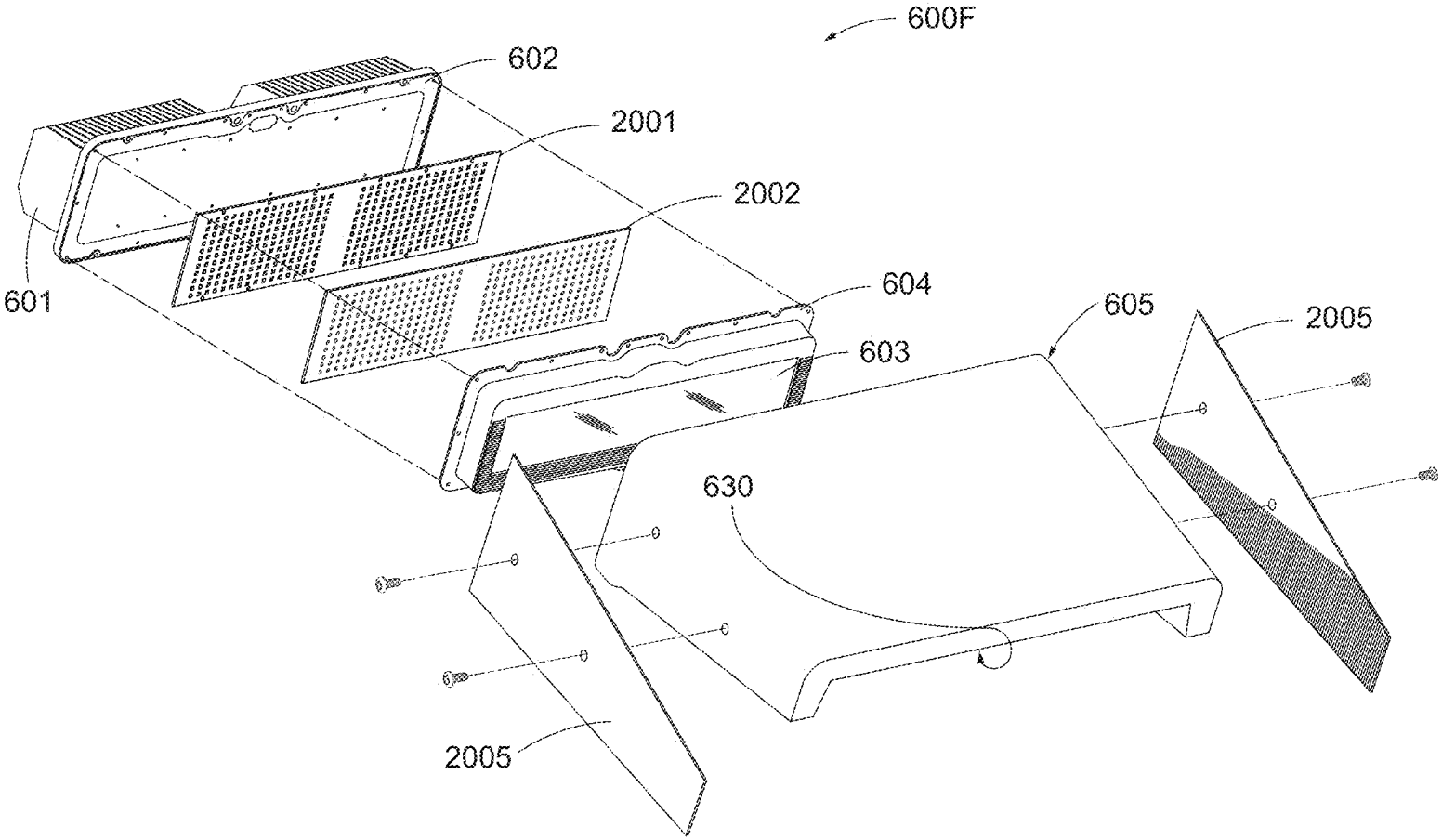
Figure 47:
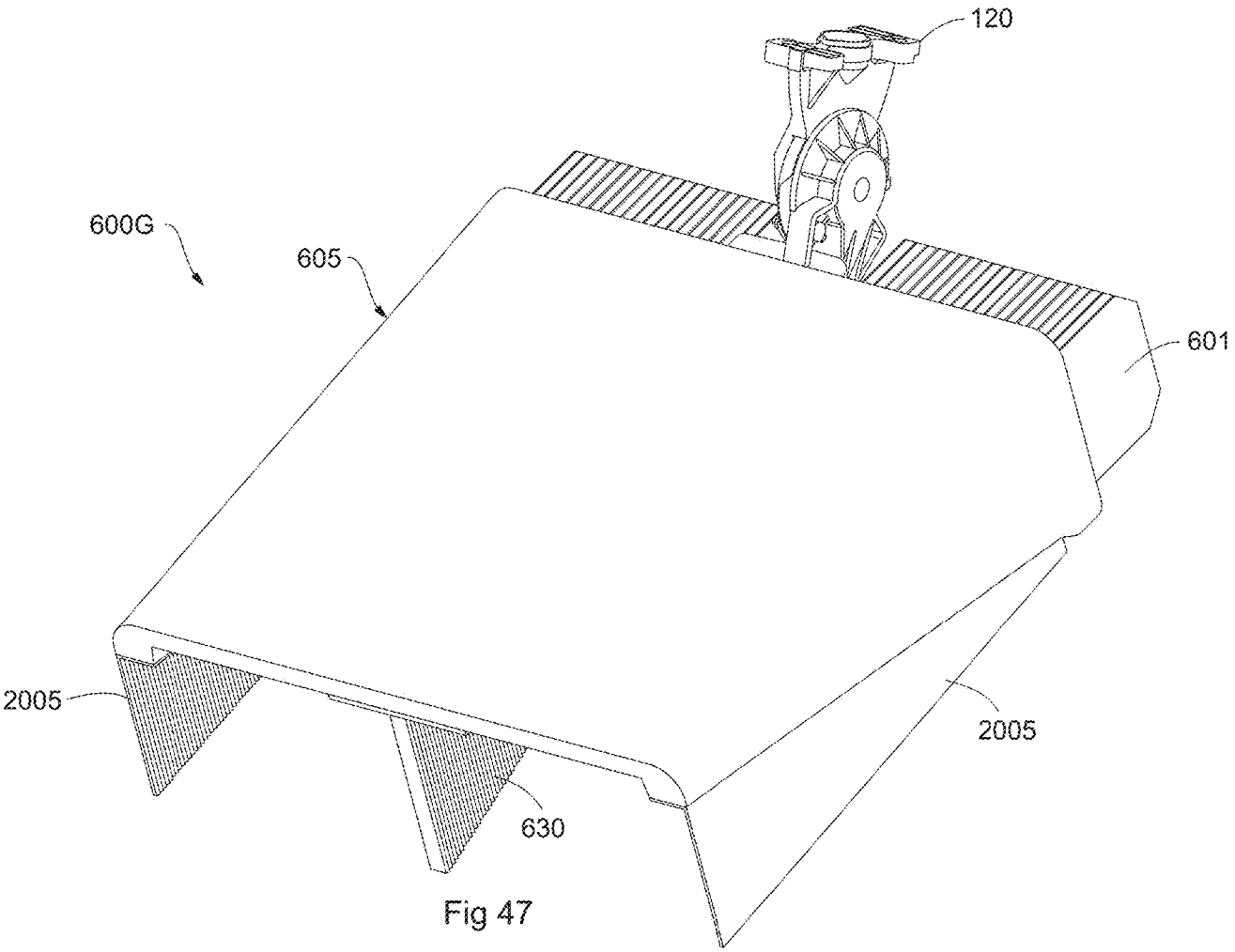
FIGS. 47-54 illustrate a fourth embodiment according to aspects of the present invention; here a version using removable visors on either or both bottom sides of a luminaire for improved glare control and horizontal beam containment.

FIGS. 23-30 illustrate a first embodiment for improved glare control and horizontal beam containment according to aspects of the present invention. As can be seen, retrofit LED luminaire 600D includes aspects of previously described retrofit LED luminaire 600C (note distalmost light absorbing device 650 to permit in situ adjustable beam cutoff (fastening devices omitted for clarity—see FIG. 46 of said co-pending parent application)), and includes a center v-visor as in previously described retrofit LED luminaire 600B, but in the present embodiment center v-visor 630 is shaved according to method 3000 of FIG. 21. In this embodiment inner upper and inner side portions 608, 609 are reflective, as is shaved center v-visor 630, and containment is provided via light absorbing louvers 2006 bolted to optic holder 2003 (which receives and positions silicone secondary lenses 2002). As discussed in said co-pending parent application, device 650 is light absorbing and can be extended partially into the composite beam emitted from the fixture so to effectuate selectable and variable beam cutoff in a vertical plane (which can aid in preserving playability).

In practice, light absorbing louvers 2006 can be machined and black anodized aluminum, or even 3D printed from lightweight, black plastic (e.g., acrylic, polycarbonate) with louver spacing such that each column of LEDs is bounded on either side by a louver approximately ½" in height; the precise height will be determined by desired horizontal containment which is further determined by the sport and needed playability (here, ½" provides a 45 degree cutoff to either side of horizontal (i.e., a 90 degree horizontal spread) when using single die LEDs (e.g., model XM-L available from Cree, Inc., Durham, N.C., USA)). Experiments have shown a 20% decrease in transmission efficiency (i.e., total fixture lumens) from a baseline condition (i.e., with no louver) but no perceived glare from an onsite position (i.e., adequate playability)—even when parts 608, 609, 630 were coated in dust.

D. Exemplary Method and Apparatus Embodiment 2

FIGS. 31-38 illustrate a second embodiment for improved glare control and horizontal beam containment according to aspects of the present invention. As can be seen, retrofit LED luminaire 600E does not include distalmost light absorbing device 650, but does includes a shaved center v-visor 630 that is reflective (as are inner upper portion 608 and inner side portions 609), and in the present embodiment light absorbing louvers 2006 are installed outside of housing cap 604; here bolted directly to housing cap 604 (e.g., using a blind hole).

In practice, light absorbing louvers 2006 may be the same as in Embodiment 1, but by installing them externally the internal space bounded by housing 602 and housing cap 604 can be reduced in depth. This can result in a more easily formed part 604, and can aid in reducing the amount of light trapped in the fixture by reducing the distance from the LEDs to the emitting face of the fixture; reducing trapped light reduces internal glow which in turn reduces perceived onsite glare and improves playability. Additionally, installation is simplified, and one can avoid introducing dust or debris into the sealed housing. Experiments have shown a 22% decrease in transmission efficiency (i.e., total fixture lumens) from a baseline condition (i.e., with no louver) but no perceived glare from an onsite position (i.e., adequate playability)—even when parts 608, 609, 630 were coated in dust.

E. Exemplary Method and Apparatus Embodiment 3

FIGS. 39-46 illustrate a third embodiment for improved glare control and horizontal beam containment according to aspects of the present invention. As can be seen, retrofit LED luminaire 600F includes a shaved center v-visor 630, inner upper portion 608, and inner side portions 609, all of which are reflective. There are no louvers in the present embodiment; rather, containment is provided via bolt-on or otherwise removable visors 2005 which are affixed to the side(s) of the luminaire and blackened and ribbed on the inner sides to trap light at more extreme angles than in either Embodiments 1 and 2, albeit with an increase to luminaire weight. The overall length of removable visors 2005 will again depend on the sport and sight lines (i.e., needed playability), but for a 24" row of LEDs (e.g., aforementioned XM-L LEDs) with a 10" width of optics on either side of shaved v-visor 630, a length of 26" is suitable to provide a 90 degree horizontal spread; though again, more extreme containment is possible.

In practice, removable visors 2005 will likely be formed from machined and black anodized aluminum for suitable rigidity and corrosion resistance when used in an elevated outdoor location (as in FIG. 1). However, removable visors 2005 could also be formed from blackened silicone (e.g., to provide less of an injury hazard from the sharp ribbed teeth when installing); in this case rigidity can be added by molding dimples into a ribbed silicone sheet so the sheet can be riveted or otherwise affixed to a rigid substrate (e.g., aluminum sheet). Experiments have shown a 11% decrease in transmission efficiency (i.e., total fixture lumens) from a baseline condition (i.e., with no removable visors) but no perceived glare from an onsite position (i.e., adequate playability)—even when parts 608, 609, 630 were coated in dust—when visors are installed on both sides of retrofit fixture 600F (~7% decrease when only one side was installed).

F. Exemplary Method and Apparatus Embodiment 4

Figure 48:
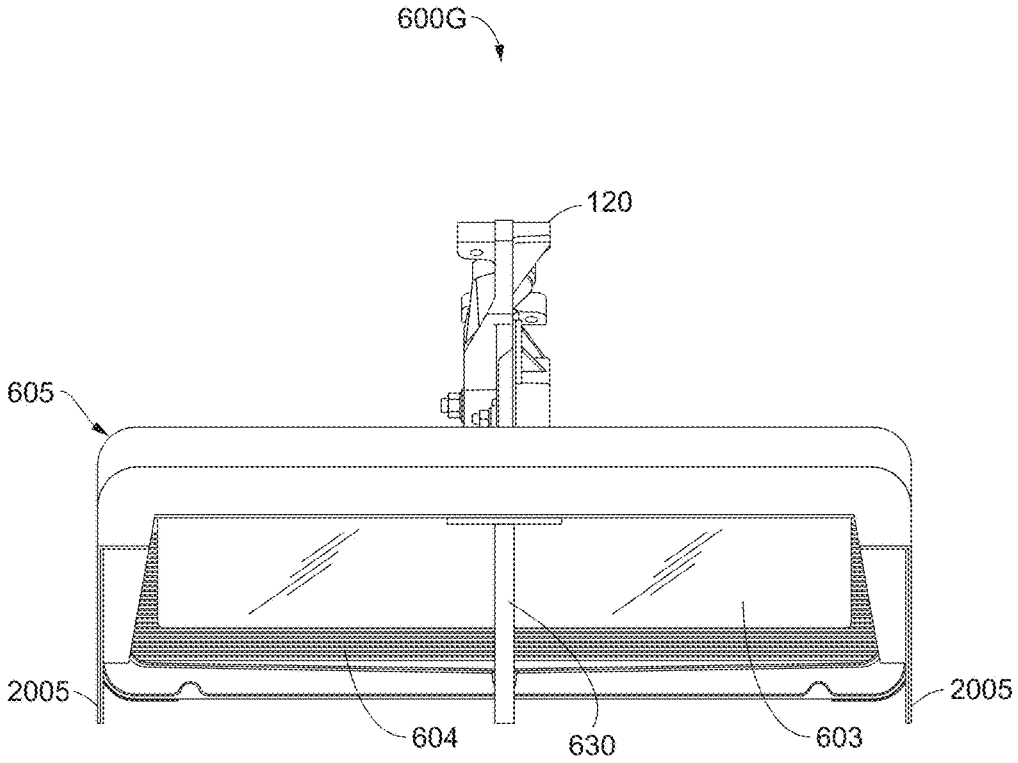
Figure 49:
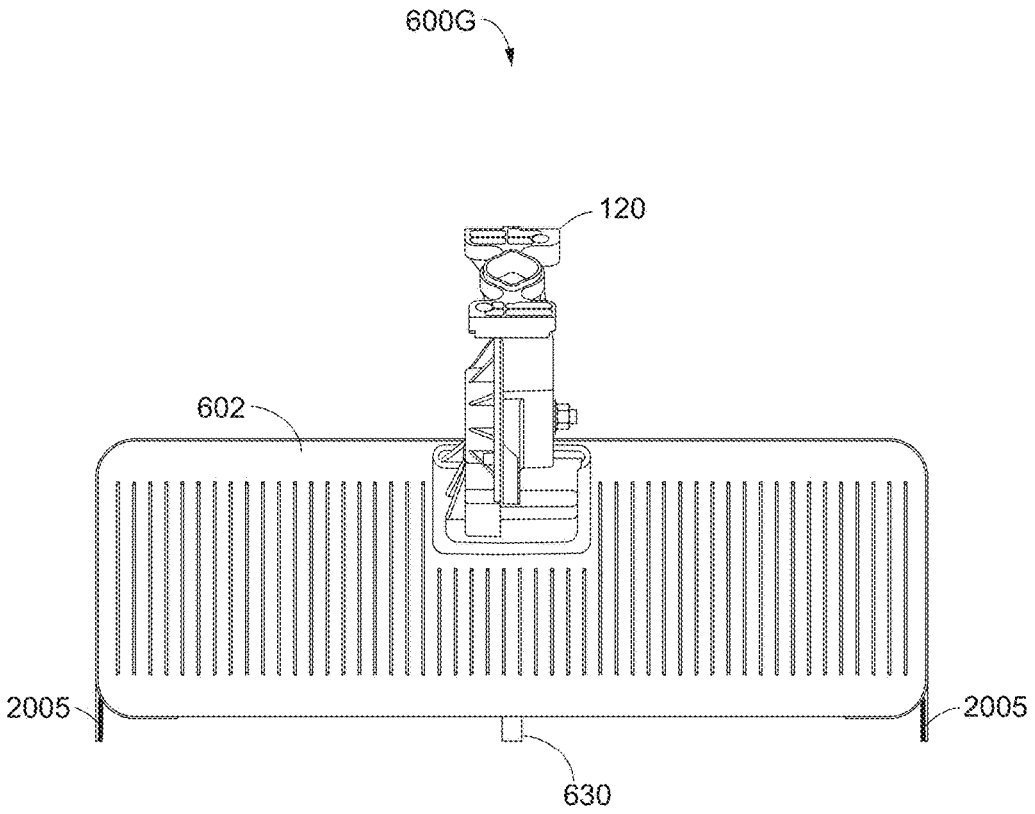
Figure 50:
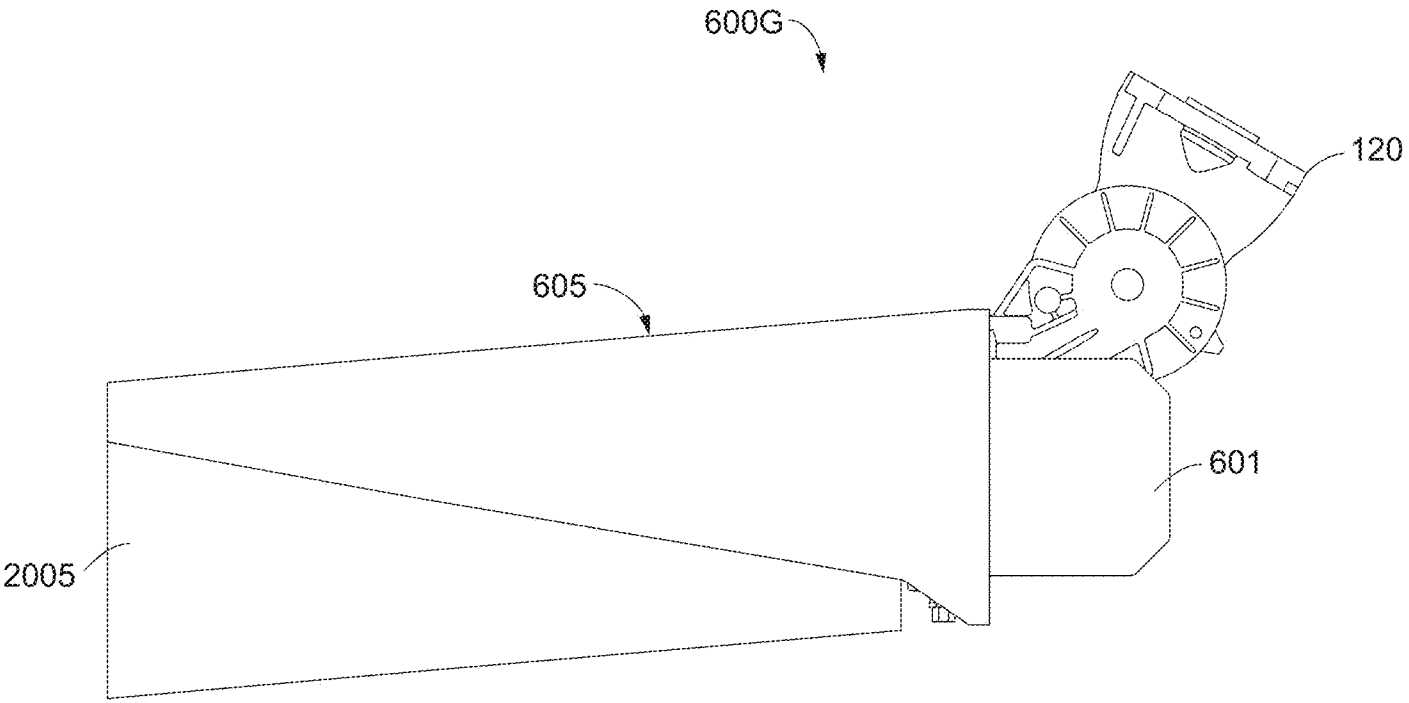
Figure 51:
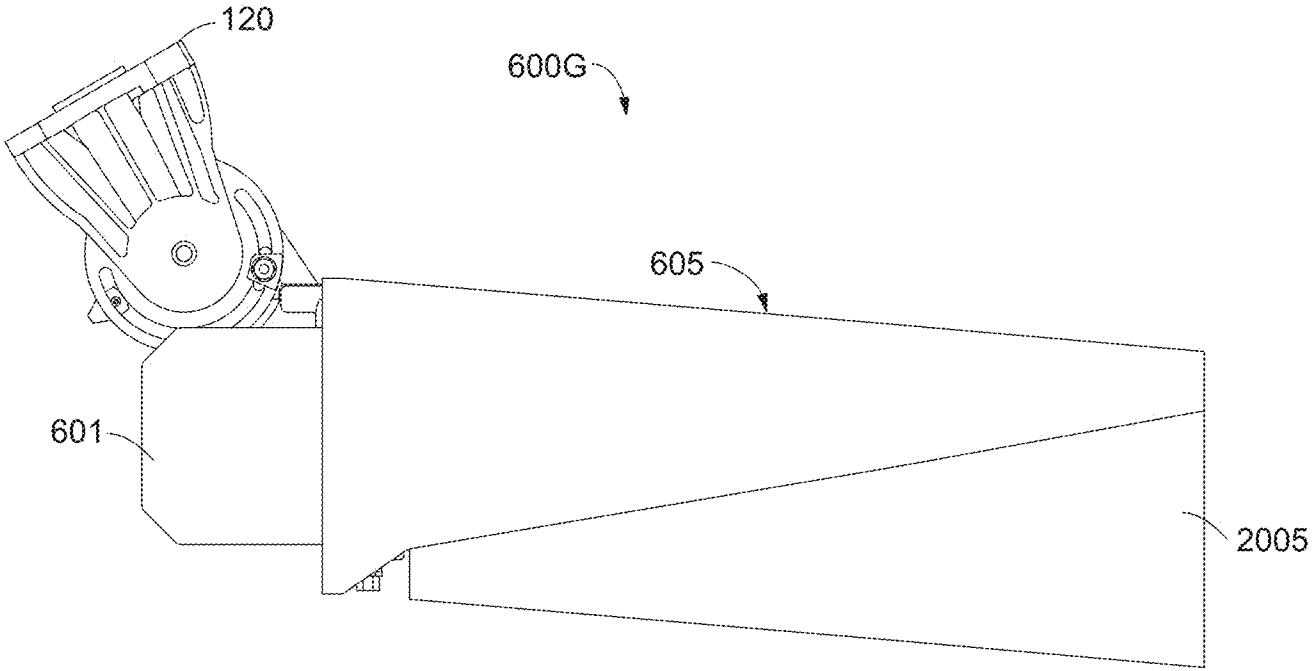
Figure 52:
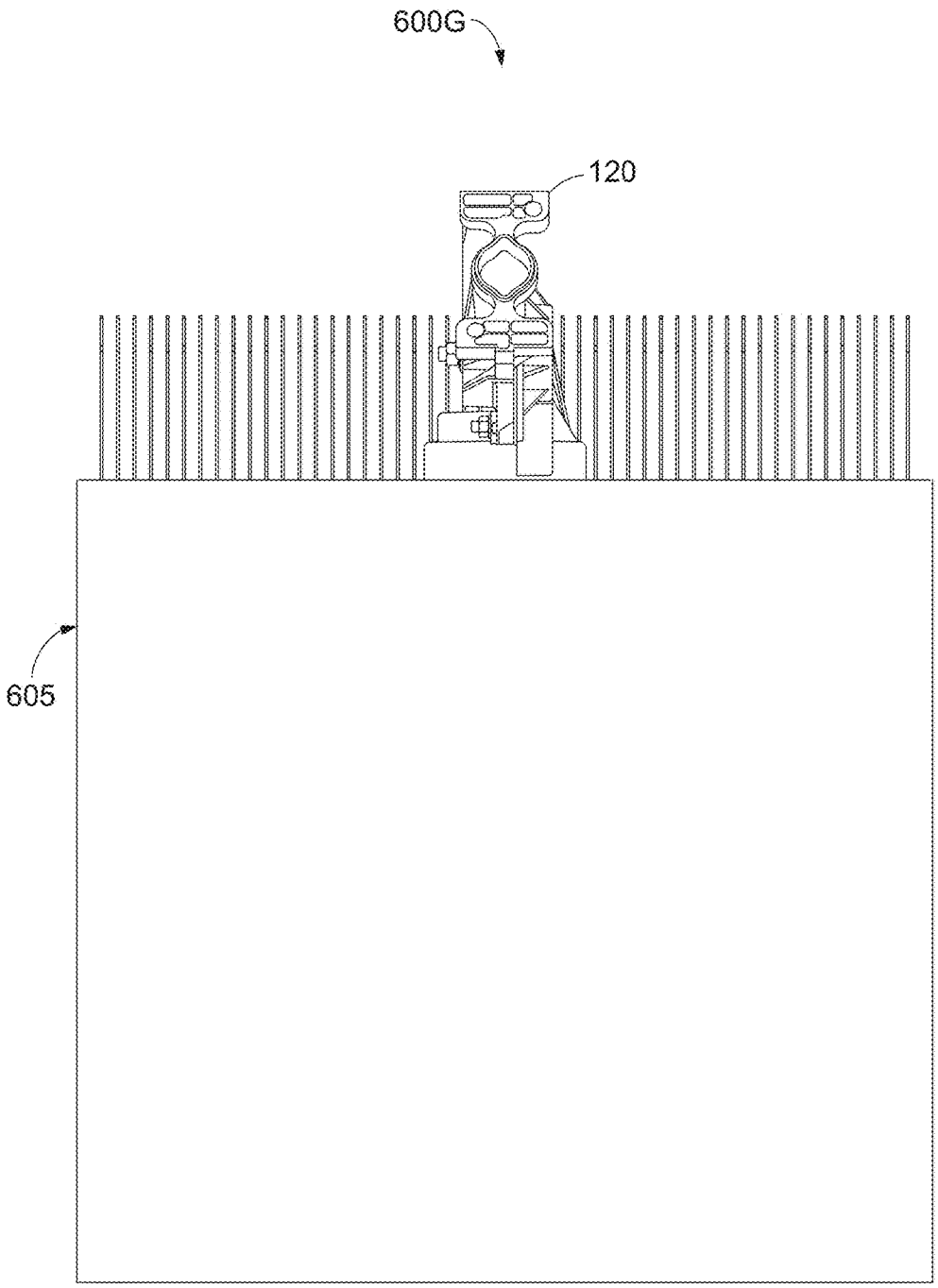
Figure 53:
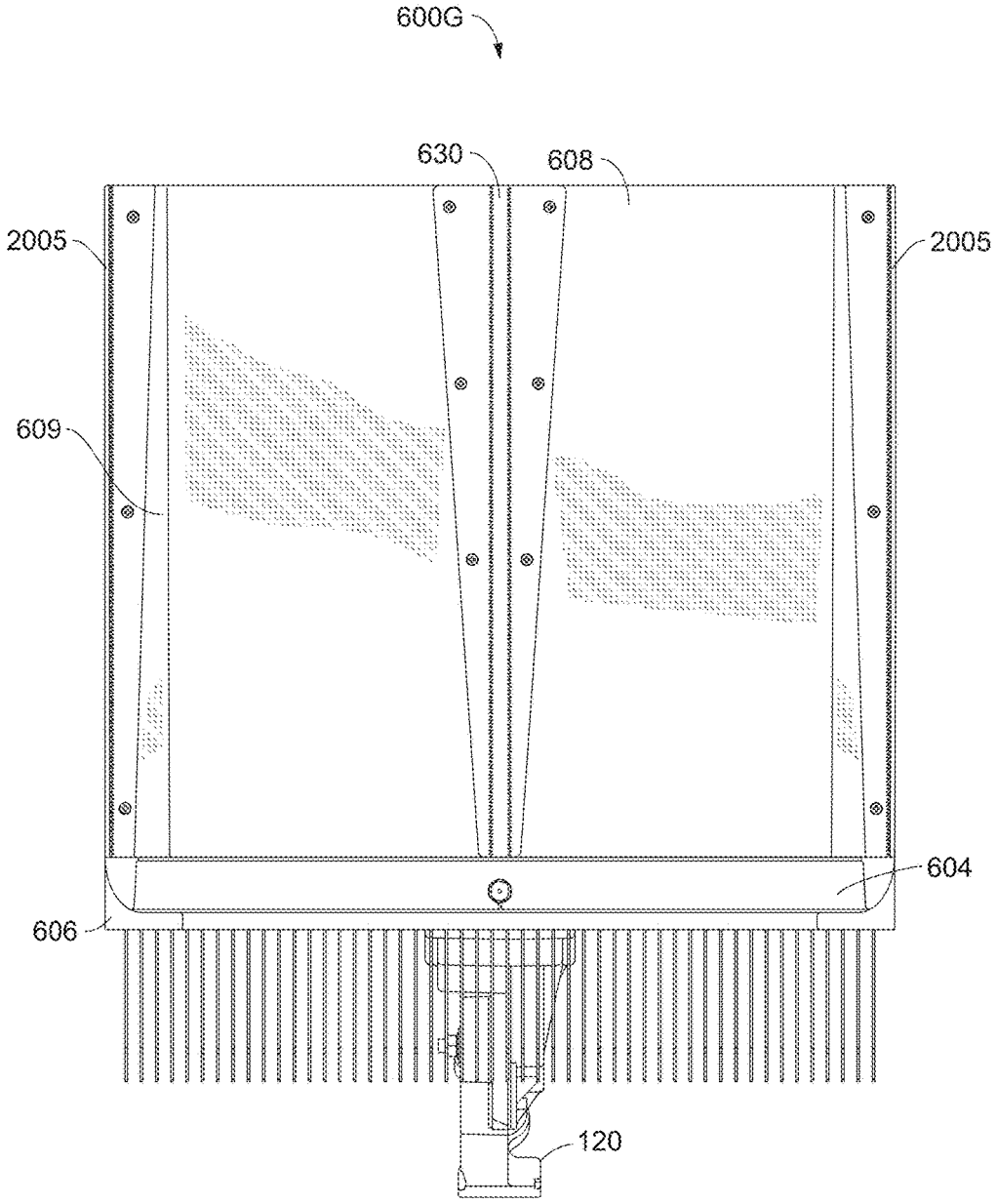
Figure 54:
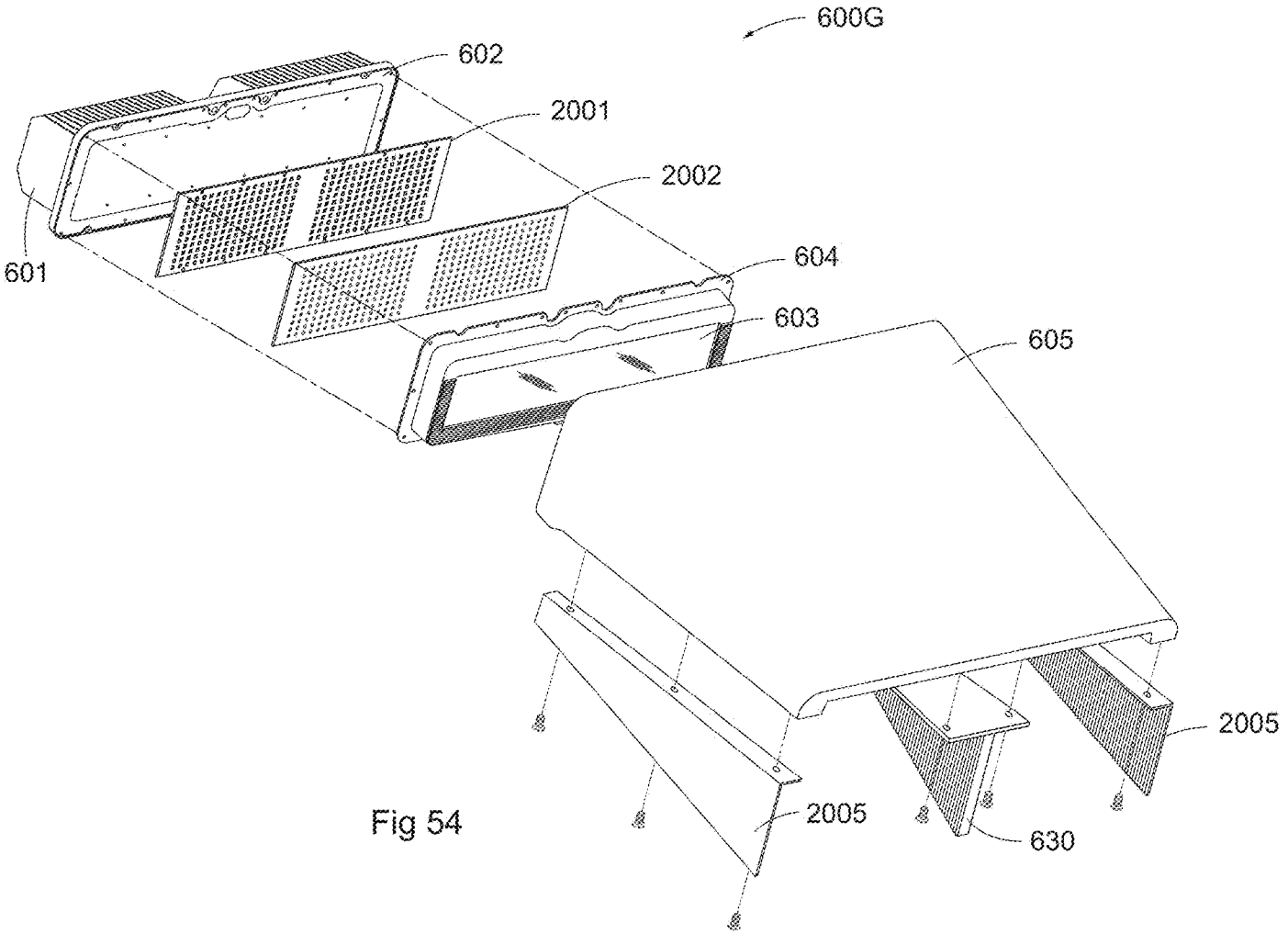

FIGS. 47-54 illustrate a fourth embodiment for improved glare control and horizontal beam containment according to aspects of the present invention. As can be seen, retrofit LED luminaire 600G includes inner upper portion 608 and inner side portions 609 (both of which are reflective), and as in Embodiment 3, there are no louvers; rather, containment is provided via bolt-on or otherwise removable visors 2005 which are blackened and ribbed on the inner sides to trap light at more extreme angles than in either Embodiments 1 and 2, albeit with an increase to luminaire weight. The primary difference between Embodiments 3 and 4 is that the present embodiment works with the existing external visor—and provides an extension primarily in the vertical plane—whereas Embodiment 3 modifies the external visor profile—and provides an extension primarily in the horizontal plane. Additionally, and unlike Embodiment 3, in the present embodiment center v-visor 630 is ribbed and blackened on both sides (and as can be seen from FIG. 48, is the same vertical length as removable visors 2005).

As in Embodiment 3, removable visors 2005 will likely be formed from machined and black anodized aluminum for suitable rigidity and corrosion resistance when used in an elevated outdoor location (as in FIG. 1). Experiments have shown a 8% decrease in transmission efficiency (i.e., total fixture lumens) from a baseline condition (i.e., with no removable visors) but no perceived glare from an onsite position (i.e., adequate playability)—even when parts 608, 609, 630 were coated in dust—when visors are installed on both bottom sides of retrofit fixture 600G (~4% decrease when only one side was installed).

G. Control Means

FIGS. 55-57 illustrate an embodiment for improved control functionality according to aspects of the present invention which can be used with any of the aforementioned embodiments of upgraded retrofit luminaires, or otherwise. Assuming again a lighting system such as that illustrated in co-pending parent U.S. application Ser. No. 15/826,772, a first attempt at a retrofit may entail gutting enclosure 50 so to remove all ballasts 400 with associated capacitors 500 and installing drivers 800. However, as has been stated, (i) some drivers are incompatible with third party controls, and (ii) some sites have third party controls but which have never been adapted for a lighting load. Here, communication from a third party control system 920 (e.g., LIGHTGRID™ control system available from GE Lighting, Nela Park, Cleveland, Ohio, USA) is translated into instructions for one or more drivers 800 by a gateway device 900. In practice, communication 910 between third party controls 920 and gateway device 900 may be hard wired (e.g., fiber optic, powerline, copper) or wireless (e.g., IR, radio, cellular), and standalone (e.g., controls and/or communications restricted to devices at a single field or a single site with multiple fields) or networked (e.g., patched into an existing Zigbee, Wi-Fi, or Bluetooth network that includes controls and/or communications for other lighting and/or non-lighting systems at one or more site locations); this is likewise true for communications 930 between said gateway 900 and driver(s) 800.

As previously stated, the type of communication and instruction (or signal or command) can vary depending on the needs of the application but for illustrative purposes, and to set forth improvements to said co-pending parent application, communication assumes a BACnet, DALI, or RS-485 protocol and instruction comprises dimming instructions; this particular configuration is illustrated in block diagram form at a gateway level in FIG. 56 and at a board level in FIG. 57. As can be seen from FIG. 56, communication 910 from a third party control device flows as an input into dimming gateway 900; RS-485, BACnet, and DALI communication means are all illustrated (here as separate communications 910 due to the different physical interfaces on the hardware side), but any 0-10V dimming control command (7001) could be communicated as an input. The gateway itself receives a power input 7000 from a 10-30 VDC power supply (max power 5 W, max current 500 mA), but could also pull the needed power from drivers 800. Communication 930 to drivers 800 from dimming gateway 900 comprises a 0-10V output signal which is based on the third party control input.

At the board level (FIG. 57), said communication inputs 910 are fed into a conditioning subcircuit 7004 which translates (e.g., level-shifts, scales) the communications into a suitable input for a microprocessor 7002. Each third party control system 920 could have its own input 910, or the inputs 910 from multiple third party control systems 920 could be combined into a single input for conditioning subcircuit 7004 (e.g., to avoid master-slave device issues). The number and type of conditioning subcircuit(s) 7004 could also vary depending on the communication protocol; for example, for an RS-485 protocol, a single model SN65HVD1781DR transceiver available from Texas Instruments Inc., Dallas, Tex., USA could be used with any of the LPC1763 family of microprocessors available from NXP Semiconductors N.V., Eindhoven, The Netherlands.

Communication outputs 930 may comprise a dimming command according to any of the aforementioned protocols, or, for example, a simple 0-10V command that correlates linearly to a dimming profile of each luminaire 600. In practice, if the latter approach is taken it is more likely that the existing driver(s) 800 will have some non-linear relationship that will need to be characterized according to aforementioned method 5000 and communication 930 weighted accordingly to ensure that an end user selecting "50% max" on a control panel, as an example, will in fact see luminous output which is half of maximum output at the target area. Also, LED efficacy can vary widely from manufacturer to manufacturer, and can differ depending on operating temperature and phosphoring, for example. As such, to further simplify operation said 0-10V command might actually correlate to a current input, and selection of said "50% max" on a control panel may actually indicate 50% maximum input current (even if this results in slightly different than 50% maximum luminous output of luminaires 600). Regardless of the approach, communication outputs 930 may be combined and applied to all drivers 800, or each driver 800 may have its own communication output 930 (e.g., to facilitate independent dimming of each luminaire 600 at a site).

H. Options and Alternatives

The invention may take many forms and embodiments. The foregoing examples are but a few of those. To give some sense of some options and alternatives, a few examples are given below.

As has been stated, aspects according to the present invention may be applied to new installations, retrofit situations as defined in co-pending parent U.S. application Ser. No. 15/826,772, or so-called retrofit-of-a-retrofit or other upgrade situations. Aspects according to the present invention could be used with or in lieu of embodiments in said co-pending parent application, but could also be used to retrofit other kinds of lighting systems (e.g., general purpose or non-specializes lighting). Aspects according to the present invention could be used with light sources other than LEDs (e.g., lasers). Aspects according to the present invention could be used with luminaires which are pre-aimed at the factory and thus already at least preliminarily aimed prior to mounting on an elevating structure (e.g., pole), or with luminaires which are first installed on an elevating structure and aimed in situ.

With respect to methodology, methods may include more, fewer, or different steps than those disclosed herein. For example, glare may be evaluated multiple times within the same method. Glare itself may be defined as onsite glare, offsite glare, and could be measured according to some metric (e.g., UGR) rather than based on end user perception. Likewise, evaluation of light source requirements (step 4002) could comprise evaluation of transmission efficiency (as discussed herein), or could instead or in addition consider such things as lighting uniformity, overall light level, color of light, or any other relevant metric when considering purchase of a retrofit or designing to a specification (see again standard RP-6-15); this is likewise true for step 3004. All of the aforementioned are possible, and envisioned, according to aspects of the present invention.

In terms of the various embodiments set forth herein, a number of options are possible. For example, adjustable armatures 120 could be of the design in Embodiment 1 or Embodiment 2 (i.e., adjustable in both vertical and horizontal planes), or might simply be a static mount with no adjustability. Likewise, housing 602 may have more or fewer heat fins 601, may be of a different general shape or size, and may include a vent to maintain internal pressure/moisture (as in Embodiments 2-4) or not (as in Embodiment 1). External visors 605 may wrap around housing 602 (see FIGS. 37, 45, and 53), or may simply be affixed to the side of housing 602 (see FIGS. 24 and 29). Inner upper portion 608 may be curved (see FIGS. 12 and 18) to effectuate a beam shift, or flat like inner side portion 609. Said portions 608, 609 could be reflective or light absorbing, as could be v-visor 630. Containment means of Embodiments 3 and 4 could be installed on either or both sides or bottoms, respectively, of lighting fixtures. Vertical beam control (i.e., via light absorbing device 650) could be included in any embodiment. Optic holders 2003 could be of a variety of designs (see FIGS. 13 and 30), or omitted from the design (see FIGS. 16, 38, 46, and 54); if included they could merely receive and position optics, or resiliently restrain optics (see discussion in aforementioned U.S. Provisional Application Ser. No. 62/457,641). Components could be bolted (e.g., visor 605 bolted to edges of housing 602), or glued (e.g., inner upper portion 608 glued to foam insert 610).

What is claimed is:

1. A method of providing improved glare control and horizontal beam containment or control functionality of a lighting fixture having a plurality of light sources comprising:

a. defining a footprint, desired vertical cutoff, and one or more light source requirements of the lighting fixture;
b. defining a communication protocol and a desired lighting effect of the lighting fixture;
c. installing a visor of a size that fits within said footprint on the lighting fixture to achieve said desired vertical cutoff;
d. installing a reflective device on said visor to eliminate direct viewing of the plurality of light sources and reduce onsite glare or improve playability;
e. installing one or more light absorbing devices on the visor or lighting fixture to (i) absorb light from the plurality of light sources to improve horizontal containment while (ii) meeting the one or more light source requirements;

f. installing a control device to provide the desired lighting effect when electrically connected to the lighting fixture and instructed by a controller; and g. installing communication means to improve control functionality by translating the instructions from the controller to a control command for the control device using said communication protocol.

2. The method of claim 1 wherein the one or more light source requirements comprises transmission efficiency.

3. The method of claim 1 wherein the controller is preexisting and wherein the step of installing a control device comprises installing a gateway device.

4. The method of claim 3 wherein the step of installing communication means comprises installing hardware or software to condition the controller instruction as an input for the gateway device.

5. The method of claim 4 wherein the defined communication protocol is used for the input for the gateway device, used for an output of the gateway device, or used for both the input and output of the gateway device.

6. The method of claim 1 wherein the reflective device on the visor and the one or more light absorbing devices on the visor or lighting fixture are modular, interchangeable, or otherwise selectable to allow for a range of glare control and horizontal beam containment options.

7. The method of claim 1 further comprising installing an adjustable light absorbing device at a distalmost part of the visor to provide modular, interchangeable, or otherwise selectable vertical beam cutoff.

8. The method of claim 1 wherein the step of installing one or more light absorbing devices on the visor or lighting fixture comprises installing a light absorbing device on one or both sides of the lighting fixture when the lighting fixture is in an operational orientation.

9. The method of claim 1 wherein the step of installing one or more light absorbing devices on the visor or lighting fixture comprises installing a light absorbing device on one or both bottom sides of the lighting fixture when the lighting fixture is in an operational orientation.

10. The method of claim 1 wherein the step of installing one or more light absorbing devices on the visor or lighting fixture comprises installing a light absorbing device in an internal space of the lighting fixture.

11. The method of claim 1 wherein the step of installing one or more light absorbing devices on the visor or lighting fixture comprises installing a light absorbing device at an external surface of the lighting fixture but not on the visor.

12. A retrofit lighting fixture with improved glare control and horizontal beam containment having a plurality of light sources in a housing, one or more reflective devices to provide said glare control, and one or more light absorbing devices to provide said horizontal beam containment made by a process comprising:

a. defining a footprint, baseline glare level, and beam spread of an existing lighting fixture having a plurality of light sources in a housing and a visor;

b. installing said one or more reflective devices on the visor of the existing lighting fixture to eliminate direct viewing of the plurality of light sources and reduce glare over the baseline glare level; and c. installing said one or more light absorbing devices on the visor or lighting fixture housing of the existing lighting fixture without exceeding said footprint to improve horizontal containment by restricting beam spread in a horizontal plane.

13. The retrofit lighting fixture of claim 12 further comprising an adjustable light absorbing device at a distalmost part of the visor of the existing lighting fixture to provide modular, interchangeable, or otherwise selectable vertical beam cutoff made by the process of (i) defining a desired vertical beam cutoff, (ii) installing the adjustable light absorbing device to the distalmost part of the visor of the existing lighting fixture, and (iii) adjusting the light absorbing device to at least partially enter the beam spread in a vertical plane until the desired vertical beam cutoff is reached.

14. The retrofit lighting fixture of claim 12 wherein the one or more light absorbing devices are installed on (i) one or both sides of the existing lighting fixture when the existing lighting fixture is in an operational orientation or (ii) one or both bottom sides of the existing lighting fixture when the existing lighting fixture is in an operational orientation.

15. The retrofit lighting fixture of claim 12 wherein the one or more light absorbing devices are installed (i) in an interior space of the housing of the existing lighting fixture, or (ii) on an external surface of the housing of the existing lighting fixture but not on the visor of the existing lighting fixture.

16. A lighting system having improved glare control and horizontal beam containment or control functionality comprising:

a. a plurality of light sources;

b. a plurality of lighting fixture housings each of which contains a subset of the plurality of light sources and an emitting face though which a composite beam from said subsets is emitted towards a target area;

c. a plurality of visors each of which is attached to a lighting fixture housing;

d. an elevating structure;

e. a plurality of armatures adjustable in both horizontal and vertical planes each of which affix a lighting fixture housing to the elevating structure such that the lighting fixture housing and associated visor define a lighting fixture footprint when adjusted in the horizontal and vertical planes;

f. a reflective device installed on said visor at a position such that direct viewing of the light sources through the emitting face is eliminated at one or more sight lines at the target area;

g. one or more light absorbing devices installed on said visor or lighting fixture housing at a position to absorb light from the plurality of light sources and cut off the composite beam at a horizontal angle;

h. a controller adapted to provide a communication upon a user input;

i. a control device in communication with the controller and adapted to modify an input or output of the plurality of light sources upon a control command; and j. a communication device in communication with the controller and control device adapted to translate the communication from the controller into the control command for the control device.

17. The lighting system of claim 16 further comprising a plurality of elevating structures spaced about the target area each of which has associated light sources, lighting fixture housings, visors, and adjustable armatures.

18. The lighting system of claim 17 wherein the target area is a sports field and wherein the sight lines comprise sight lines of a player on the sports field.

19. The lighting system of claim 16 wherein:

a. the controller is preexisting;

b. the plurality of light sources comprise LEDs;

c. the communication device comprises a gateway device; and d. the control device comprises one or more drivers for the LEDs.

20. The lighting system of claim 19 wherein the gateway device comprises multiple outputs to permit independent control of the one or more drivers.

* * * * *